US008328293B2

(12) United States Patent
Kondo et al.

(10) Patent No.: US 8,328,293 B2
(45) Date of Patent: Dec. 11, 2012

(54) SHIELD MACHINE

(75) Inventors: Yasunori Kondo, Kakogawa (JP); Hiroyoshi Iwata, Kako-gun (JP); Yasuyuki Sakai, Kako-gun (JP); Makoto Oda, Kako-gun (JP); Tooru Niihara, Tokyo (JP); Isao Makiuchi, Tokyo (JP); Kunihiro Nagamori, Tokyo (JP); Katsumi Inomata, Tokyo (JP); Hidekazu Anai, Tokyo (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 496 days.

(21) Appl. No.: 12/524,550

(22) PCT Filed: Jan. 26, 2007

(86) PCT No.: PCT/JP2007/051244

§ 371 (c)(1),
(2), (4) Date: Feb. 18, 2010

(87) PCT Pub. No.: WO2008/090623

PCT Pub. Date: Jul. 31, 2008

(65) Prior Publication Data

US 2010/0164274 A1 Jul. 1, 2010

(51) Int. Cl.
*E21D 9/87* (2006.01)

(52) U.S. Cl. ..... 299/59; 299/85.1

(58) Field of Classification Search ..... 299/55, 299/56, 58, 85.1, 59

See application file for complete search history.

(56) References Cited

U.S. PATENT DOCUMENTS

| | | | | | |
|---|---|---|---|---|---|
| 2,207,536 | A | * | 7/1940 | Dunkum | 299/56 |
| 2,385,251 | A | * | 9/1945 | Ayers | 405/146 |
| 2,466,709 | A | * | 4/1949 | Karr | 405/143 |
| 3,004,753 | A | * | 10/1961 | Sik | 299/60 |
| 4,436,345 | A | * | 3/1984 | Silks et al. | 299/59 |

(Continued)

FOREIGN PATENT DOCUMENTS

JP SHO54-154131 12/1979

(Continued)

OTHER PUBLICATIONS

Machine translation of JP2001-336384,A http://dossier1.ipdl.inpit.go.jp/cgi-bin/tran_web_cgi_ejje?u=http%3A%2F%2Fdossier1%2E . . . Apr. 7, 2012.*

(Continued)

*Primary Examiner* — John Kreck
(74) *Attorney, Agent, or Firm* — Alleman Hall McCoy Russell & Tuttle LLP

(57) ABSTRACT

A shield machine including an excavator capable of excavating tunnels of various cross-sectional shapes, the excavator including: a rotary drum supported at a front end side portion of a shield machine main body to be rotatable around a first center axis; a cutter supporting frame supported by the rotary drum to be rotatable around a second center axis; a rotary cutter head supported by the cutter supporting frame to be rotatable around a third center axis and including a plurality of cutter bits on a surface thereof; a rotary auxiliary cutter head supported by the rotary drum to be rotatable around a fourth center axis; and first, third, and fourth rotating mechanisms, and a swinging drive mechanism configured to respectively cause the rotary drum, the rotary cutter head, the rotary auxiliary cutter head, and the cutter supporting frame to independently rotate.

16 Claims, 38 Drawing Sheets

U.S. PATENT DOCUMENTS 7,631,942 B2 * 12/2009 Bechem et al. ..... 299/85.1

FOREIGN PATENT DOCUMENTS

| | | |
|---|---|---|
| JP | 02-311695 | 12/1990 |
| JP | 09-119288 | 5/1997 |
| JP | 2898968 | 3/1999 |
| JP | 2001-055890 | 2/2001 |
| JP | 2001140585 | 5/2001 |
| JP | 2001-336384 | 12/2001 |
| JP | 2007-039976 | 2/2007 |

OTHER PUBLICATIONS

Machine translation of JP2001-140585 printed Sep. 10, 2012.*

ISA Japanese Patent Office; International Search Report of PCT/JP2007/051244; Mar. 20, 2007; Japan.

* cited by examiner $\theta = 0°$
$\alpha = +59°$ $\theta = -75°$
$\alpha = +103°$ $\theta = -81°$
$\alpha = +59°$ $\theta = -181°$
$\alpha = +121°$ $\theta = \pm 0°$
$\alpha = -120°$ $\theta = -88°$
$\alpha = -66°$ $\theta = -105°$
$\alpha = -104°$

SHIELD MACHINE

TECHNICAL FIELD

The present invention relates to a shield machine including an excavator capable of excavating various cross-sectional shapes.

BACKGROUND ART

A shield machine includes a shield machine main body having a body, a plurality of shield jacks configured to cause the shield machine main body to move ahead, and an excavator provided on a front end side of the shield machine main body to excavate natural ground. In a general shield machine, the body of the shield machine main body is formed to have a cylindrical shape, and the excavator includes a plurality of cutter bits provided on a front surface of a cutter head having the same diameter as the body. The cutter head is supported by a front end side portion of the shield machine main body to be rotatable around a central axis of the shield machine main body, and is rotated by a driving machine, such as a plurality of hydraulic motors. The shield machine excavates a tunnel of a circular cross section by causing the shield machine main body to move ahead (drill ahead) while rotating the cutter head.

In recent years, shield machines capable of excavating tunnels of various cross-sectional shapes, such as a rectangular cross section and an oval cross section in addition to the circular cross section, have been developed. Examples of such shield machines are described in Patent Documents 1 to 3.

In the shield machine of Patent Document 1, a disc cutter is supported to be rotatable around a central axis of the shield machine main body, and a planetary cutter is rotatably supported by a disc main body of the disc cutter. In accordance with this shield machine, when the disc main body is rotated, the planetary cutter revolves integrally with the disc main body, and rotates in sync with the rotation of the disc main body by a planetary gear mechanism. Thus, the shield machine can excavate a tunnel of a predetermined cross-sectional shape by the disc main body and the planetary cutter.

In the shield machine of Patent Document 2, four spokes radially extend from a small-diameter main cutter provided to excavate a center of a tunnel and are provided with extensible arms, respectively, and each of the extensible arms is provided with a corner cutter and a hydraulic motor configured to cause the corner cutter to rotate. The extensible arms are configured to be extensible and retractable in a radial direction by hydraulic jacks. A peripheral portion of a unique cross section is excavated by causing the corner cutters to rotate while extending and retracting the extensible arms, and a center portion of the cross section is excavated by the main cutter.

In the shield machine of Patent Document 3, a fixed shaft is provided at a central axis of the shield machine main body, and a first casing is provided to be rotatable around the fixed shaft. A second casing is provided to project forward from a tip end portion of the first casing. In the first casing, a fixed gear provided on the fixed shaft, a planetary gear engaging the fixed gear, and a first gear wheel engaging the planetary gear are rotatably supported. Moreover, in the second casing, a second gear wheel engaging the first gear wheel is fixedly provided, and a third gear wheel engaging the second gear wheel is rotatably supported. An excavating cutter is fixedly provided on the third gear wheel. By a casing drive motor and a cutter drive motor provided in the shield machine main body, the first and second casings are rotated around the fixed shaft. Then, in sync with this rotation, the cutter is rotated around a shaft member, and the cutter is independently rotated to rotate. Thus, a predetermined cross section is excavated.

Patent Document 1: Japanese Patent No. 2898968

Patent Document 2: Japanese Laid-Open Patent Application Publication 2001-55890

Patent Document 3: Japanese Laid-Open Patent Application Publication Hei 9-119288

DISCLOSURE OF THE INVENTION

Problems To Be Solved By the Invention

However, in the shield machine of Patent Document 1, to excavate a tunnel having a predetermined cross-sectional shape, a contour shape of the planetary cutter needs to be set in accordance with a ratio of the number of rotations of the planetary cutter to the number of revolutions of the planetary cutter. Therefore, in the case of excavating a tunnel having a cross-sectional shape different from the set cross-sectional shape, the above setting needs to be changed. To change the setting, the contour shape of the planetary cutter, the number of teeth of the planetary cutter, and the like need to be changed. Since such change requires cost and time, the versatility of the shield machine of Patent Document 1 is low.

Moreover, the shield machine of Patent Document 2 excavates a tunnel by the cutters provided at the tip ends of the extensible arms provided at four radially-extending spokes while extending and retracting the extensible arms by the hydraulic jacks. Therefore, it is difficult to maintain the seal performance and strength reliability of the extensible arms while supporting the excavation reaction force by the extensible arms extending and retracting with large load applied to the cutter head. For example, in the case of using this shield machine for excavating natural ground including ground conditions such as very hard rocks, it is unlikely to endure practical use.

Further, in the shield machine of Patent Document 3, the cutter is rotated around the fixed shaft, and in sync with this, the cutter is rotated around the shaft member. Further, the cutter is independently rotated by the cutter drive motor provided on the shield machine main body side. Therefore, the configuration of the gear wheel for causing the cutter to rotate using the first and second casings becomes extremely complex, and manufacturing such a configuration while maintaining the reliability requires extremely high cost and much time. Moreover, in the case of this shield machine, extremely large force for causing the cutter to rotate around the fixed shaft and causing the cutter to rotate around the shaft member is transferred through the first and second casings. Therefore, problems regarding the strength and the durability may occur. In addition, in the case of this configuration, the ratio of the number of teeth of the fixed gear to the number of teeth of the first gear wheel needs to be set to realize the excavation of a tunnel of a predetermined cross-sectional shape.

Means For Solving the Problems

An object of the present invention is to provide a shield machine including an excavator capable of stably excavating tunnels while easily changing an excavating cross section of the shield machine in accordance with cross-sectional shapes of various tunnels to be excavated.

Here, a shield machine of the present invention includes: a shield machine main body including a body; a plurality of shield jacks configured to cause the shield machine main body to move ahead; and an excavator configured to excavate a natural ground on a front end side of the shield machine main body, and the shield machine further includes: a first rotating member supported at a front end side portion of the shield machine main body to be rotatable around a first center axis parallel to a central axis of the shield machine main body; a first rotating device configured to cause the first rotating member to rotate; a swinging member supported by the first rotating member so as to be swingable around a second center axis parallel to the first center axis and spaced apart from the first center axis; a swinging device configured to cause the swinging member to swing with respect to the first rotating member independently from the first rotating device; a rotary cutter head which is supported by the swinging member so as to be rotatable around a third center axis parallel to the second center axis and spaced apart from the second center axis, and includes a plurality of cutters on an excavating surface thereof; a third rotating device configured to cause the rotary cutter head to rotate with respect to the swinging member independently from the first rotating device and the swinging device; and a controller configured to control the first rotating device, the swinging device, and the third rotating device. The term "cutter" in DESCRIPTION and CLAIMS denotes all types of "excavating cutters" including "cutter bit" and "roller cutter". With this, the first rotating member is rotated around the first center axis, the swinging member swings around the second center axis with respect to the rotating first rotating member, and the rotary cutter head is rotated around the third center axis with respect to the swinging member. In addition, the first rotating member, the swinging member, and the rotary cutter head are independently driven by the first rotating device, the swinging device, and the third rotating device, respectively.

Therefore, by controlling the first rotating device and the swinging device by the controller, the rotary cutter head is caused to freely move in an excavation area spreading from the first center axis to the inner surface of the tunnel. Thus, the shield machine can excavate tunnels of various cross-sectional shapes. To be specific, in the case of excavating the tunnel of a predetermined cross-sectional shape, the first rotating device and the swinging device are controlled by controlling the swinging angle of the swinging member which angle is associated with the rotation phase angle of the first rotating member from the reference phase angle in accordance with the cross-sectional shape. Thus, the shield machine can excavate tunnels of various cross-sectional shapes. As above, the cross-sectional shape of the tunnel to be excavated can be easily changed by changing the control of the first rotating device and the swinging device without changing the mechanical structure. Therefore, the versatility is extremely high.

Moreover, the shield machine main body may include a chamber configured to recover excavated sand and a dividing wall defining a rear end of the chamber, and the first rotating member may be constituted by a rotary drum which forms a part of a wall surface of the dividing wall. With this, since the shield machine excavates while a part of the dividing wall defining the rear end of the chamber configured to recover the excavated sand rotates, the excavated sand can be stirred simultaneously with the excavation such that the excavated sand is easily discharged.

Further, the first rotating device, the swinging device, and the third rotating device may be respectively constituted by different actuators from one another. With this, these devices can be independently driven by controlling respective actuators, and the shield machine can easily deal with the excavation of a wide range of excavated cross sections. In addition, since it is unnecessary to link the first rotating device, the swinging device, and the third rotating device, the configuration of the shield machine can be simplified.

Moreover, the swinging member may be constituted by a cutter supporting frame rotatably supported by an outer peripheral portion of the first rotating member, and the rotary cutter head supported by the cutter supporting frame may be configured to be able to move to an area outside an outer periphery of the first rotating member when viewed from front. With this, since the rotary cutter head can excavate the area outside the outer portion of the first rotating member, the shield machine can surely excavate tunnels of various cross-sectional shapes each having a larger outer shape than the first rotating member.

Further, the controller may be configured to control the first rotating device and the swinging device such that a rotation angle of the swinging member is controlled to be associated with a rotation phase angle of the first rotating member from a reference phase angle in accordance with a cross-sectional shape of a tunnel to be excavated. With this, the position of the rotary cutter head can be quickly controlled by the control of the rotation angle by the combination of the first rotating device and the swinging device. Thus, the shield machine can surely excavate the tunnel of a predetermined cross-sectional shape, and easily change the cross-sectional shape of the tunnel to be excavated.

Moreover, a center of the rotary cutter head may continuously move at a uniform speed. With this, since the moving speed is uniform, the amount of excavation is constant, and the shield machine can excavate smoothly.

Further, a front surface of the rotary cutter head may be formed to curve from a center portion of the front surface to an outer peripheral side toward the shield machine main body, and the excavating surface may be formed by providing the plurality of cutters on the front surface. With this, when the rotary cutter head moves in a horizontal direction intersecting with an excavating direction, the shield machine can stably excavate the natural ground by the cutters provided on the curved front surface of the cutter head. In this case, the rotary cutter head is formed to have, for example, the excavating surface including: a circular front surface; an annular tapered surface obliquely extending from the front surface to the shield machine main body side to be connected to an outer periphery; and a cylindrical outer peripheral surface connected to a rear end of the annular tapered surface. A plurality of cutters are provided on the excavating surface. Moreover, the annular tapered surface may be formed as a circular-arc surface.

Moreover, wherein the plurality of cutters may be spirally provided from a center portion of the front surface to an outer periphery of the front surface in a direction opposite a rotational direction of the rotary cutter head. With this, the excavated sand can be discharged along the spirally arranged cutters to the outer peripheral side.

Further, the rotary cutter head may be provided with a central supporting portion having a surface plate, and a plurality of spokes radially extending from the central supporting portion, and the plurality of cutters may be provided on front surfaces of the spokes. With this, by causing the rotary cutter head to rotate, the natural ground can be excavated by the circular excavating surface formed on the front surface of the rotary cutter head. In addition, the excavated sand can be quickly discharged through a wide space between the spokes to a rearward direction. In the case of this configuration, the shield machine can stably excavate the natural ground even if the natural ground is sticky (such as clay).

Moreover, a mud adding material inlet may be provided at a position which is located in a direction intersecting with an axial direction of the shield machine main body and located in a direction opposite a rotational direction of the spokes. With this, the mud adding material can be supplied to fluidize the excavated sand without causing the clogging of the mud adding material inlet. Thus, the shield machine can excavate stably.

Further, a plurality of the first rotating members may be provided at the front end side portion of the shield machine main body, the rotary cutter heads may be provided at the first rotating members, respectively, to configure a plurality of excavators, and the first rotating members may be rotated in directions opposite to each other. With this, the shield machine including a plurality of rotary cutter heads is configured. Thus, it is possible to cancel the reaction force in a direction opposite the rotational direction generated when the rotary cutter heads revolve in the excavation of the shield machine. Therefore, the shield machine can stably excavate tunnels of various excavated cross sections.

Moreover, the rotary cutter head provided on each of the first rotating members respectively rotating in the directions opposite to each other may be rotated in a direction which is the same as a rotational direction of the first rotating member provided with the rotary cutter head. With this, it is also possible to cancel the excavation reaction force of the rotary cutter head acting in a direction opposite the rotational direction. Therefore, the shield machine can further stably excavate tunnels of various excavated cross sections.

Further, the cutter supporting frame may be provided with a plurality of third center axes, and the shield machine further includes: a plurality of rotary cutter heads supported to be rotatable around the plurality of third center axes, respectively; and a plurality of third rotating devices configured to respectively cause the plurality of rotary cutter heads to rotate. With this, a wide area of the natural ground can be excavated by the rotary cutter heads rotating around a plurality of third center axes, respectively. Thus, the excavating ability can be improved.

Moreover, the first rotating member may be provided with a plurality of second center axes, and the shield machine may include: a plurality of cutter supporting frames supported to be rotatable around the plurality of second center axes, respectively; and a plurality of swinging devices configured to respectively cause the plurality of cutter supporting frames to rotate. With this, a wide area of the natural ground can be excavated by the rotary cutter heads provided at a plurality of cutter supporting frames rotating together with the first rotating member. Thus, the excavating ability can be further improved.

Further, the first rotating member may include a rotary auxiliary cutter head configured to rotate around a fourth center axis parallel to the first center axis and spaced apart from the first center axis and the second center axis, and the rotary auxiliary cutter head may include a plurality of cutters provided on an excavating surface thereof, and a fourth rotating device configured to cause the rotary auxiliary cutter head to rotate. With this, the shield machine can excavate the area of excavation of the rotary auxiliary cutter head in addition to the area of excavation of the rotary cutter head at the same time. By appropriately setting the area of excavation of the rotary cutter head and the area of excavation of the rotary auxiliary cutter head, the shield machine can excavate the tunnel further quickly, and the excavating ability can be improved. In this case, it is preferable that the second center axis of the swinging member and the fourth center axis of the rotary auxiliary cutter head be located at positions opposed to each other with respect to the first center axis of the first rotating member, since the shield machine can simultaneously excavate the tunnel at two positions opposed to each other with respect to the first center axis.

Moreover, the chamber may include therein: a stirring blade rotatably supported by the first rotating member; and a stirring blade rotating device configured to cause the stirring blade to rotate. With this, since the rotating stirring blade revolves together with the rotating first rotating member, the stirring performance in the chamber significantly improves. Thus, the excavated sand can be further efficiently stirred, and can be easily delivered from the chamber to an outside.

Further, it is preferable that the rotary cutter head include a cutter frame to which the cutter is attached, and an operation space to which an operator can get in from the dividing wall side to replace the cutter that is formed inside the cutter frame. With this, the cutter provided at the rotary cutter head can be replaced in a device inner side. Further, it is preferable that the shield machine include a mud adding material supplier configured to supply the mud adding material to the rotary cutter head and discharge the mud adding material to a front side of the rotary cutter head or a mud adding material supplier configured to supply the mud adding material to the stirring blade and discharge the mud adding material to a front side of the stirring blade. With this, by causing a mud pressure to act on the excavating surface according to need, the shield machine can excavate stably.

Effects of the Invention

The present invention can provide a shield machine capable of changing the excavating cross section of the shield machine by controlling the movement of the rotary cutter head by the above-explained components in accordance with various cross-sectional shapes of tunnels to be excavated, and capable of easily dealing with various excavated cross-sectional shapes.

Figure 1:
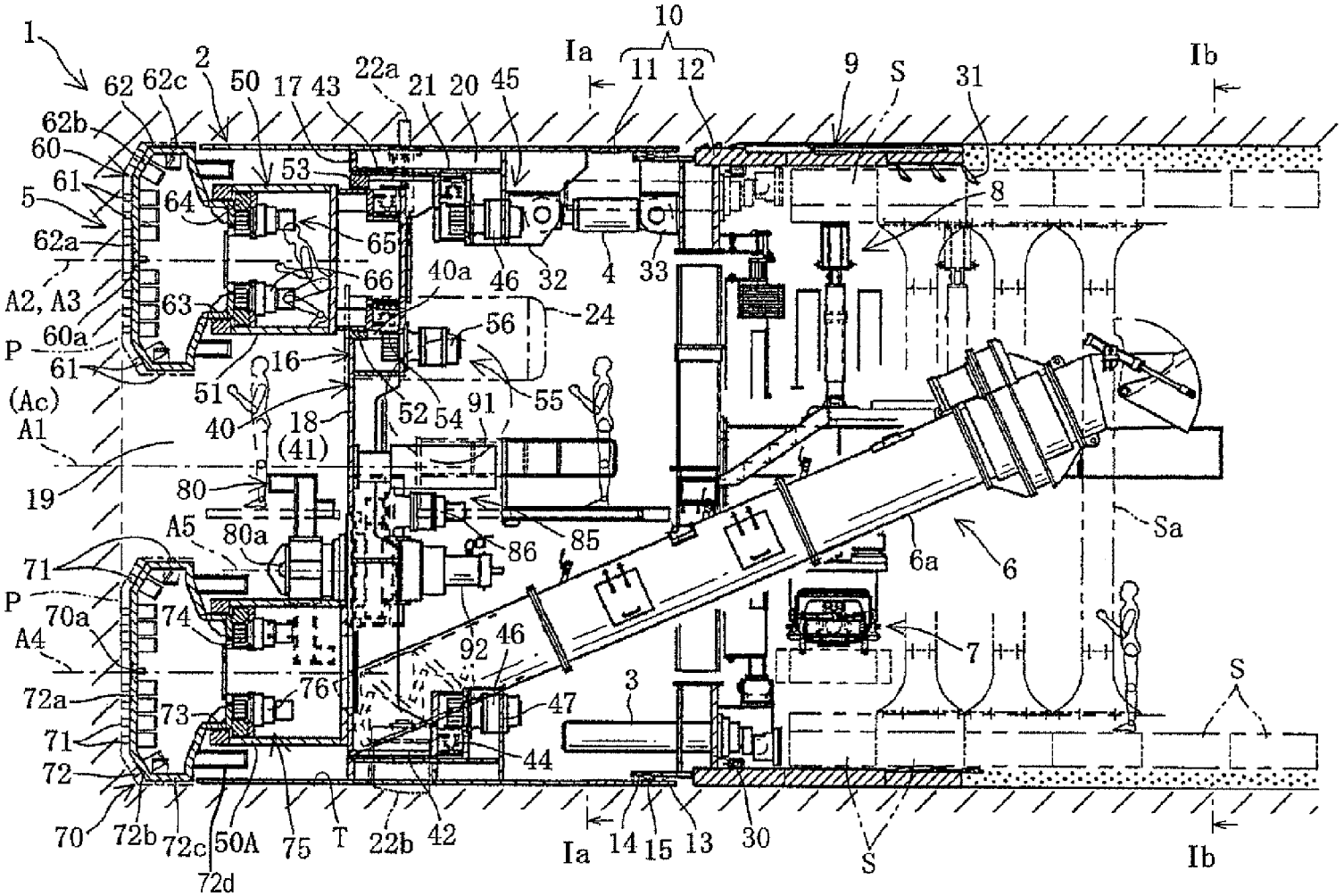
FIG. 1 is a longitudinal sectional view of a shield machine according to Embodiment 1 of the present invention.
Figure 3:
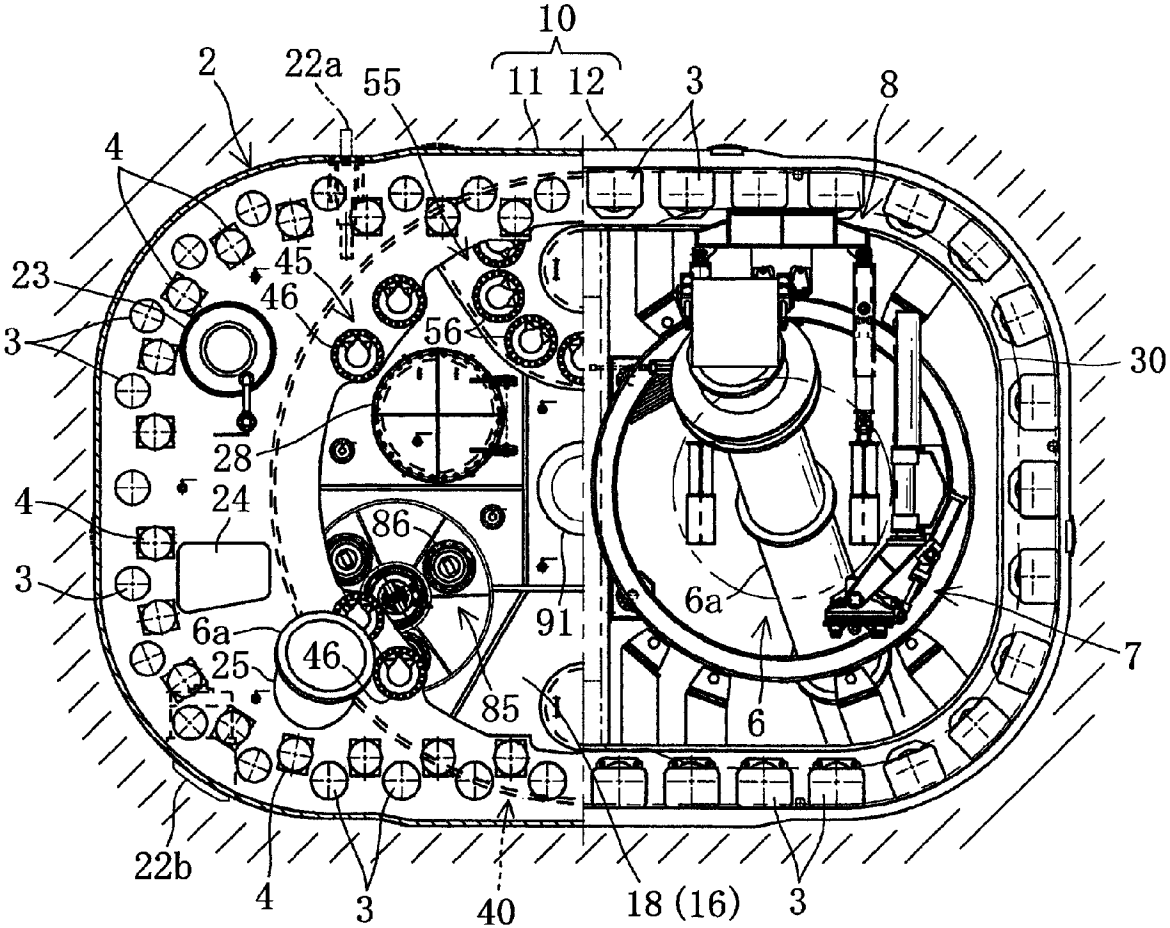

A left half of FIG. 3 is a cross-sectional view taken along line Ia-Ia of FIG. 1, and a right half of FIG. 3 is a cross-sectional view taken along line Ib-Ib of FIG. 1.

Figure 4:
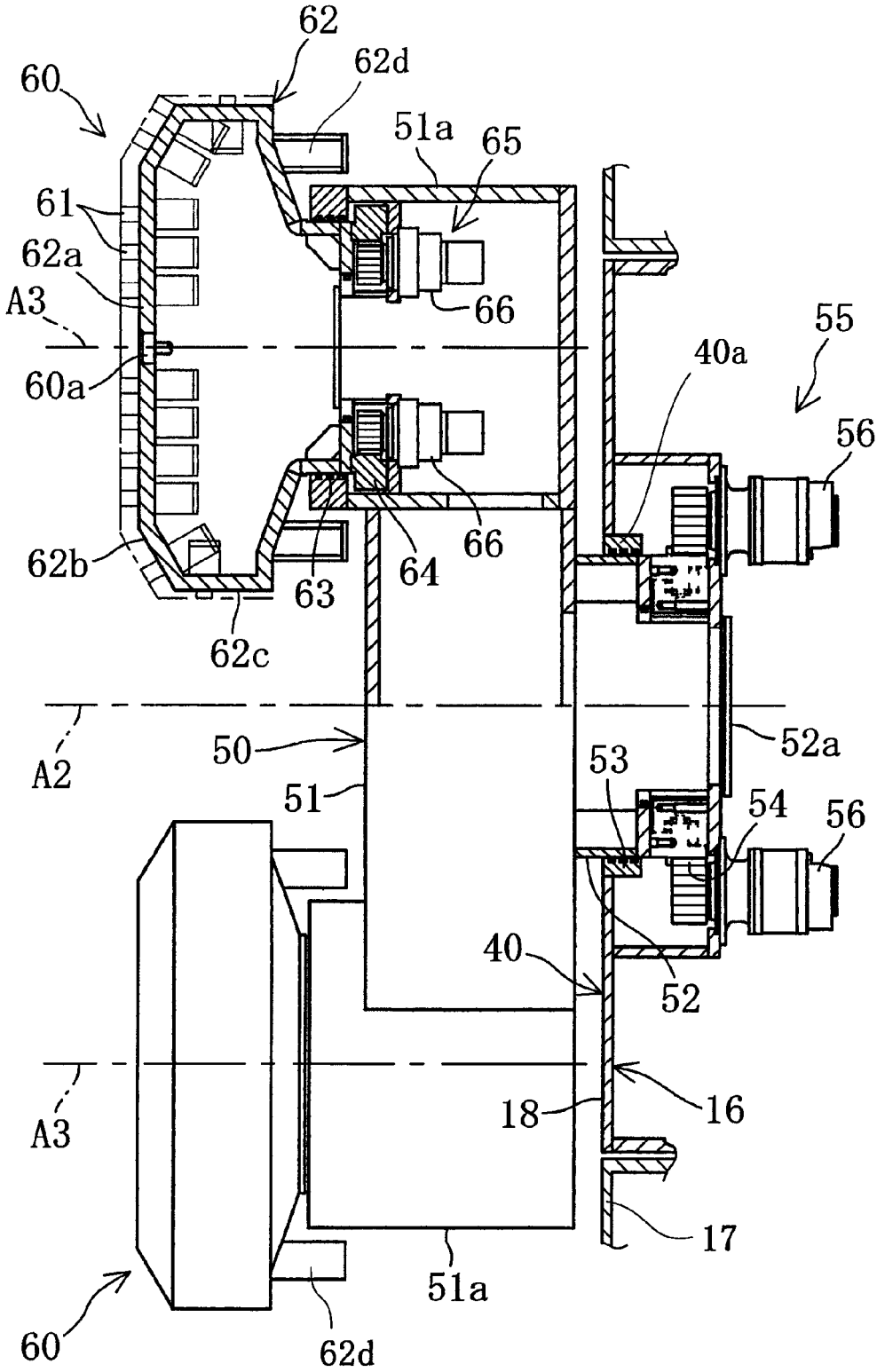

FIG. 4 is a half cross-sectional view showing main components including a cutter supporting frame and a rotary cutter head in the shield machine shown in FIG. 1.

Figure 5:
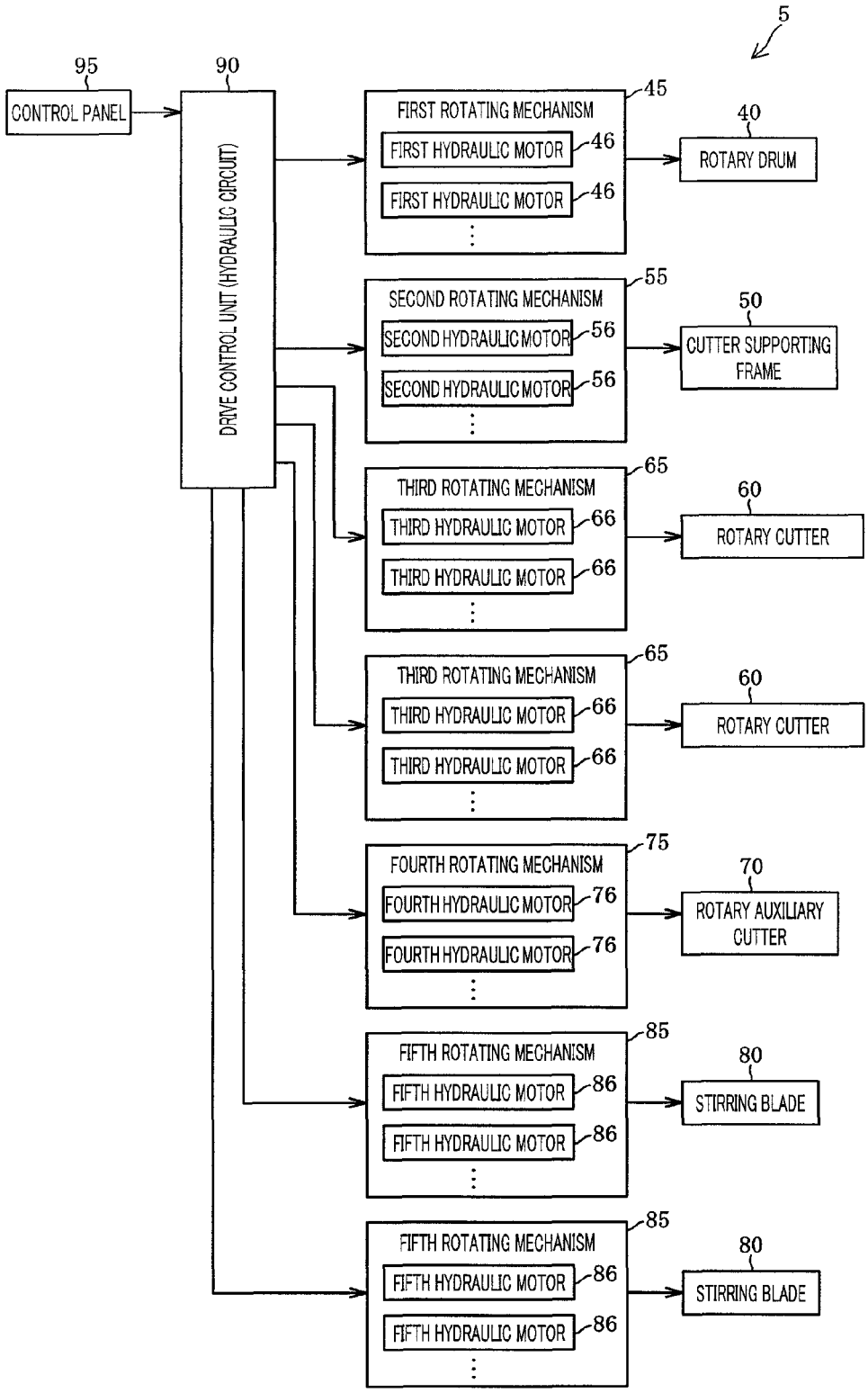

FIG. 5 is a block diagram showing a drive control system of the shield machine shown in FIG. 1.

Figure 6:
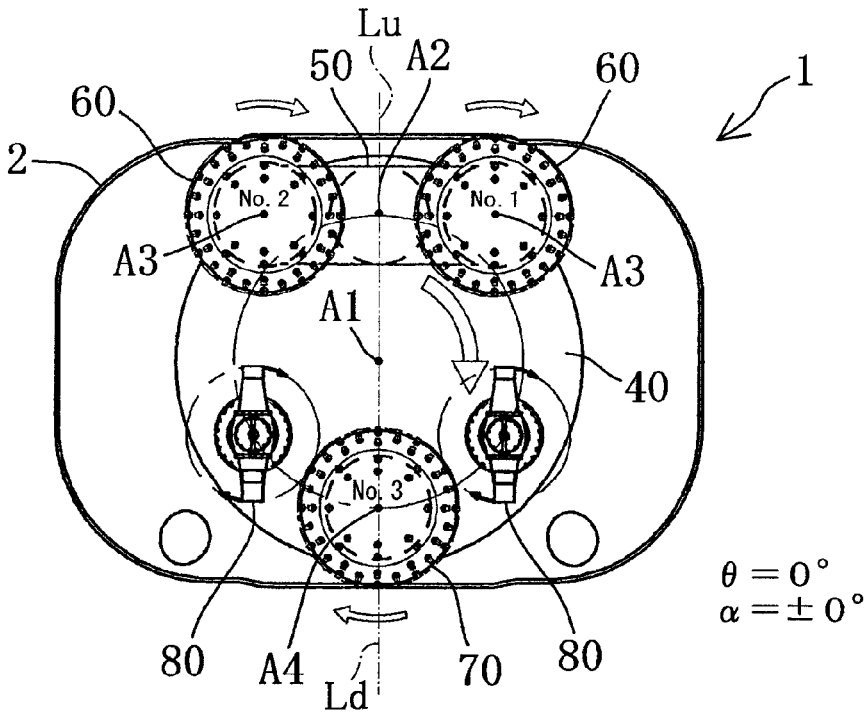

FIG. 6 is a front view showing a state where a drum rotation angle of the excavator included in the shield machine shown in FIG. 1 is ±0 degrees.

Figure 7:
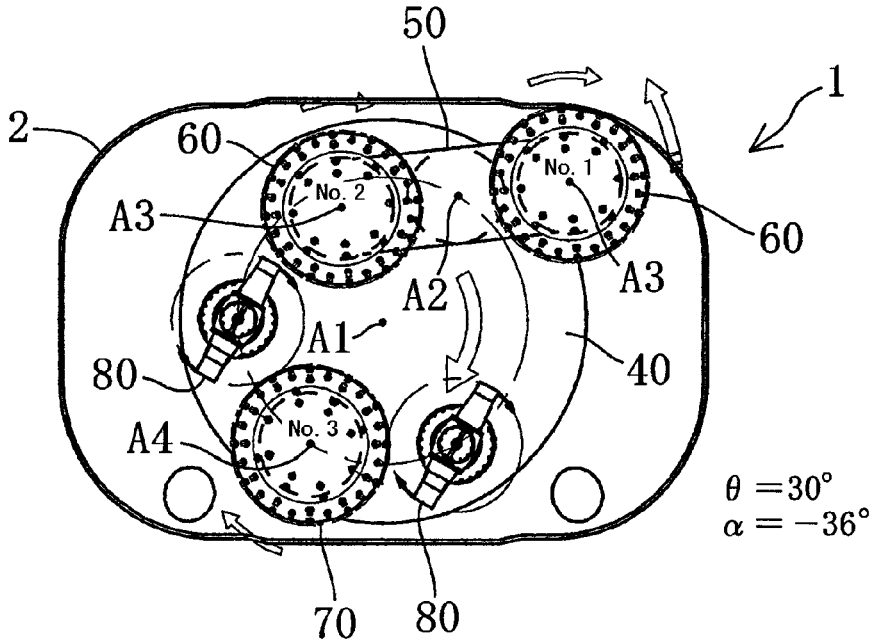

FIG. 7 is a front view showing a state where the excavator is rotated by a predetermined angle from the drum rotation angle of the excavator shown in FIG. 6.

Figure 8:
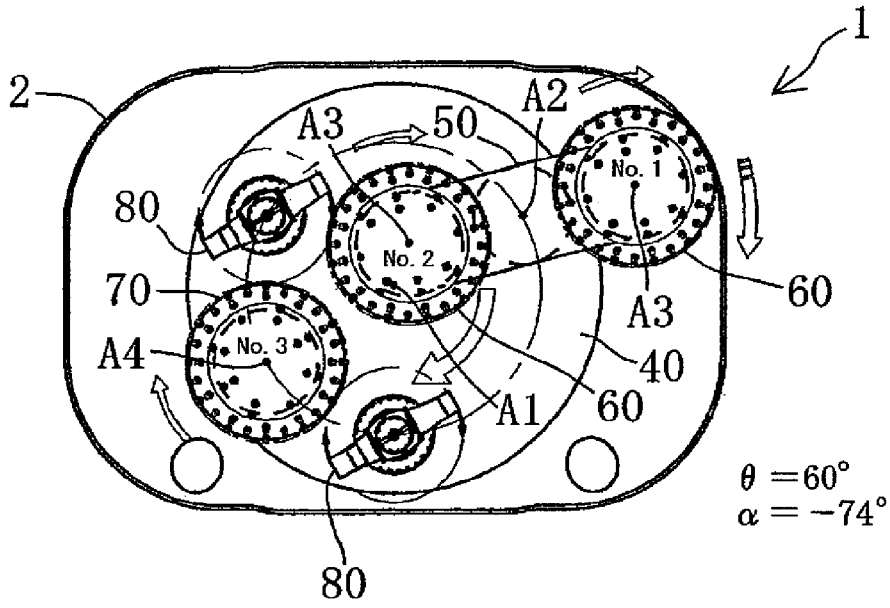

FIG. 8 is a front view showing a state where the excavator is rotated by a predetermined angle from the drum rotation angle of the excavator shown in FIG. 7.

Figure 9:
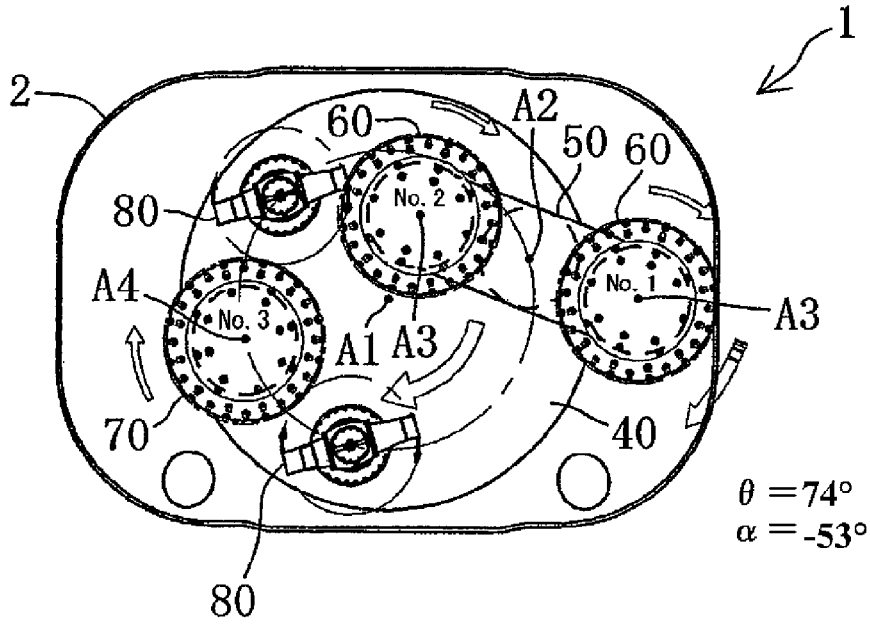

FIG. 9 is a front view showing a state where the excavator is rotated by a predetermined angle from the drum rotation angle of the excavator shown in FIG. 8.

Figure 10:
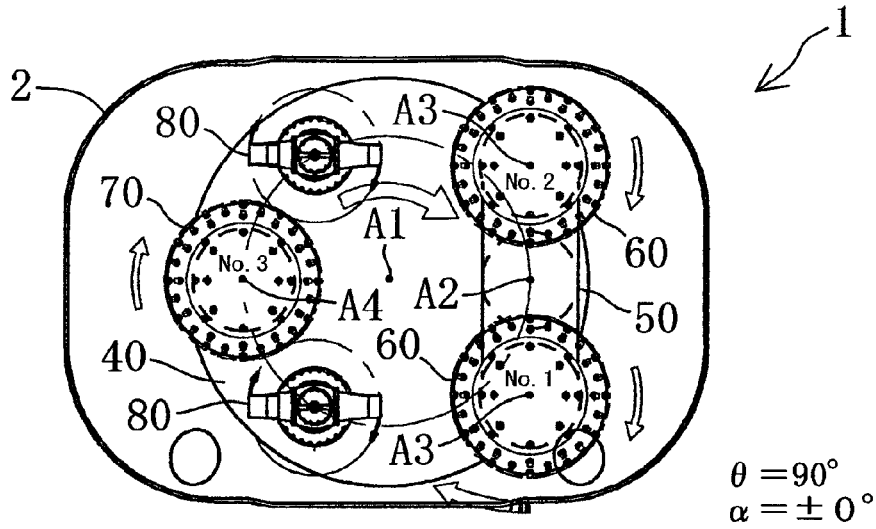

FIG. 10 is a front view showing a state where the excavator is rotated by a predetermined angle from the drum rotation angle of the excavator shown in FIG. 9.

Figure 11:
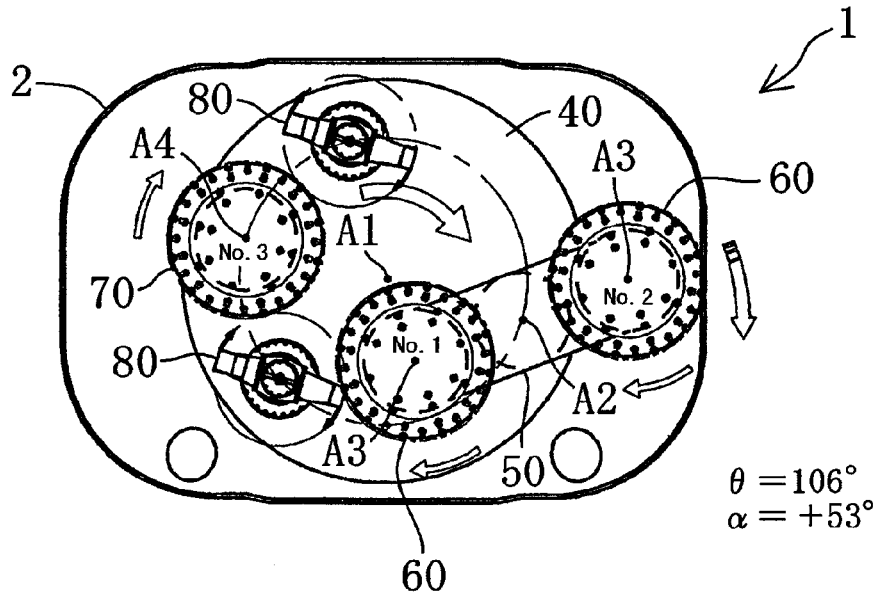

FIG. 11 is a front view showing a state where the excavator is rotated by a predetermined angle from the drum rotation angle of the excavator shown in FIG. 10.

Figure 12:
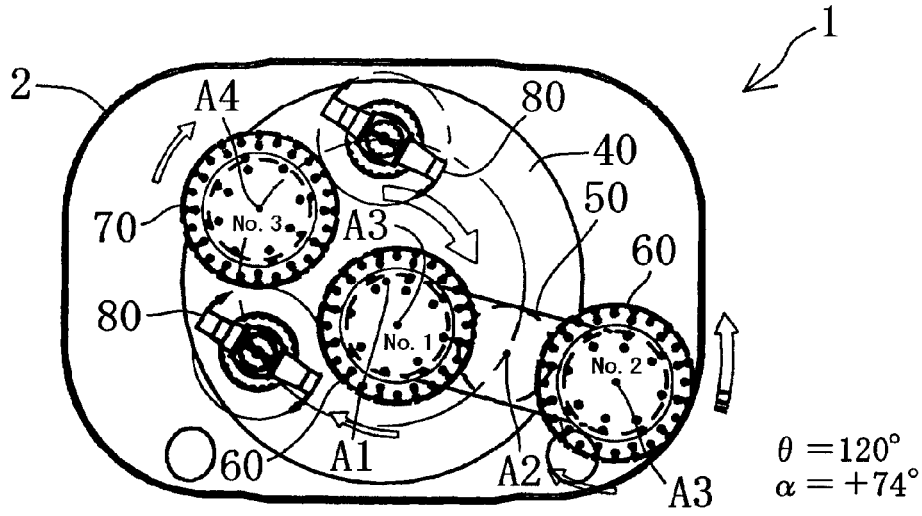

FIG. 12 is a front view showing a state where the excavator is rotated by a predetermined angle from the drum rotation angle of the excavator shown in FIG. 11.

Figure 13:
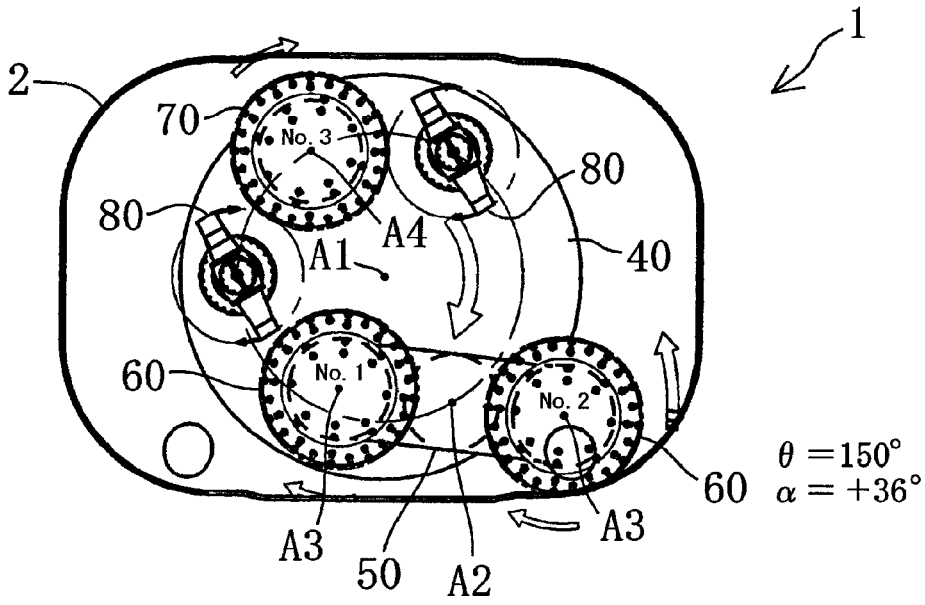

FIG. 13 is a front view showing a state where the excavator is rotated by a predetermined angle from the drum rotation angle of the excavator shown in FIG. 12.

Figure 14:
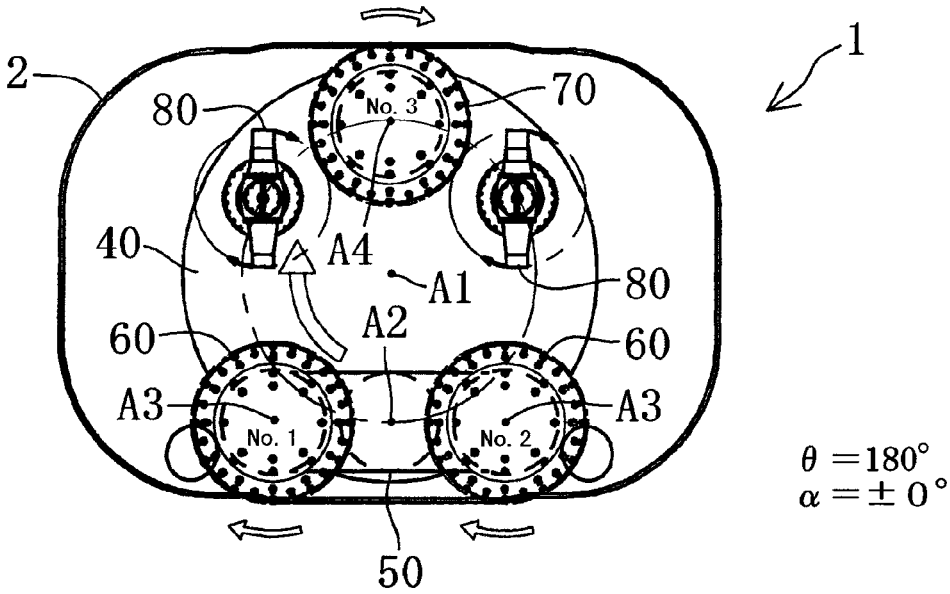

FIG. 14 is a front view showing a state where the excavator is rotated by a predetermined angle from the drum rotation angle of the excavator shown in FIG. 13.

Figure 15:
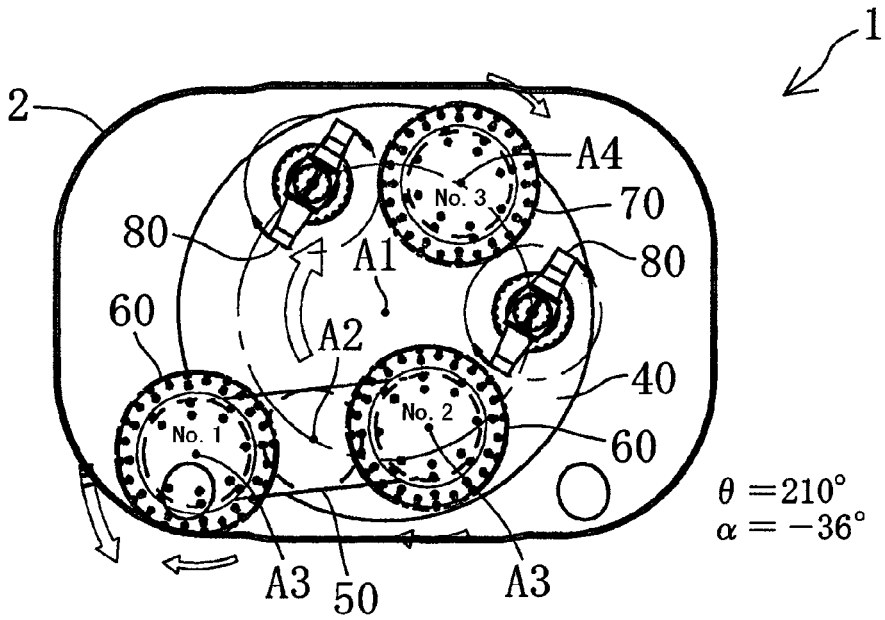

FIG. 15 is a front view showing a state where the excavator is rotated by a predetermined angle from the drum rotation angle of the excavator shown in FIG. 14.

Figure 16:
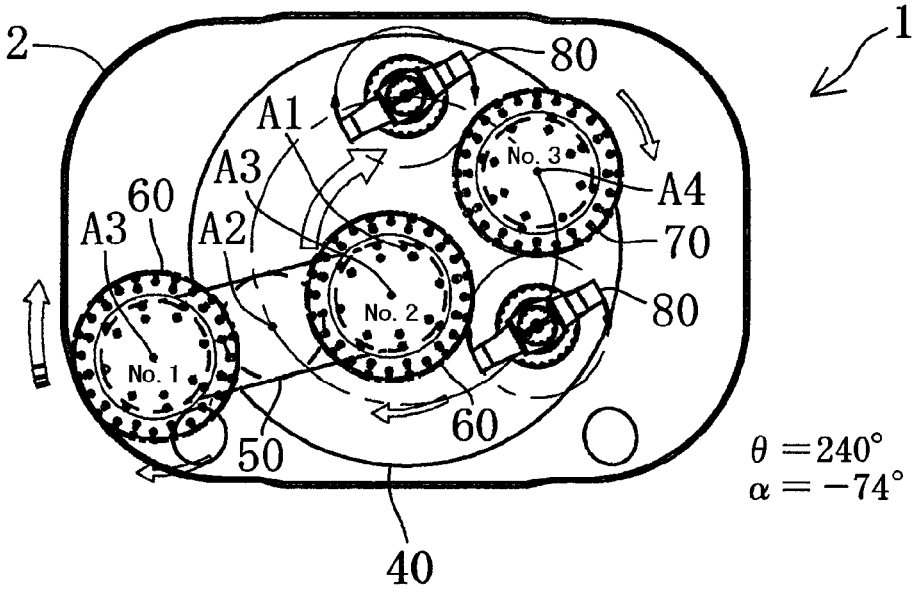

FIG. 16 is a front view showing a state where the excavator is rotated by a predetermined angle from the drum rotation angle of the excavator shown in FIG. 15.

Figure 17:
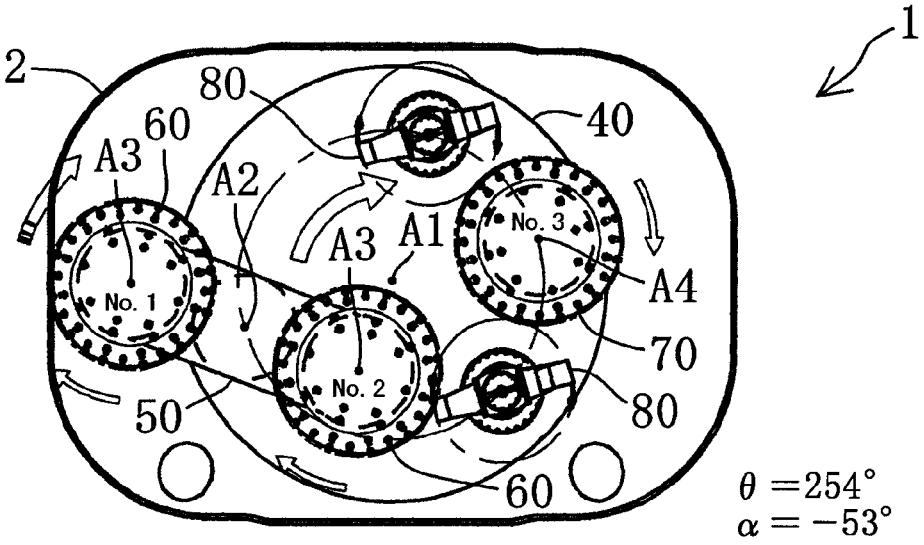

FIG. 17 is a front view showing a state where the excavator is rotated by a predetermined angle from the drum rotation angle of the excavator shown in FIG. 16.

Figure 18:
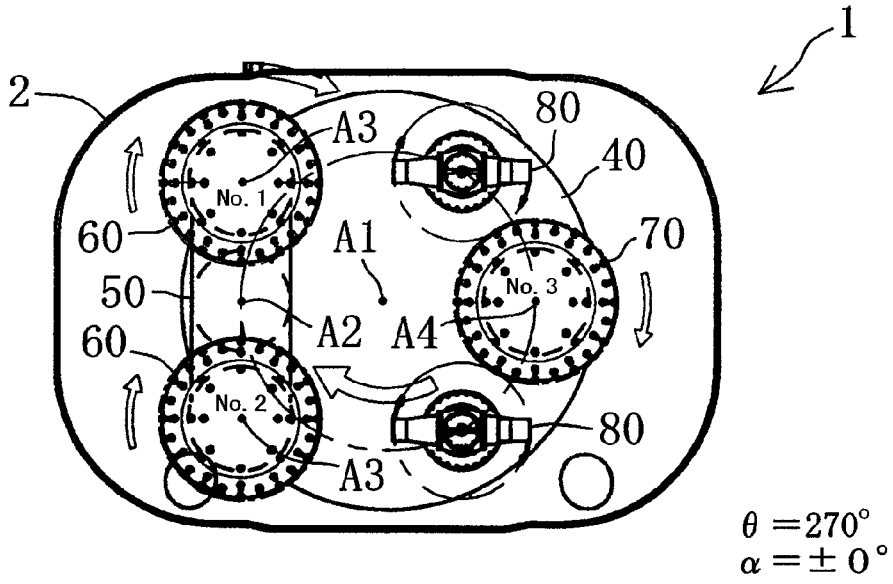

FIG. 18 is a front view showing a state where the excavator is rotated by a predetermined angle from the drum rotation angle of the excavator shown in FIG. 17.

Figure 19:
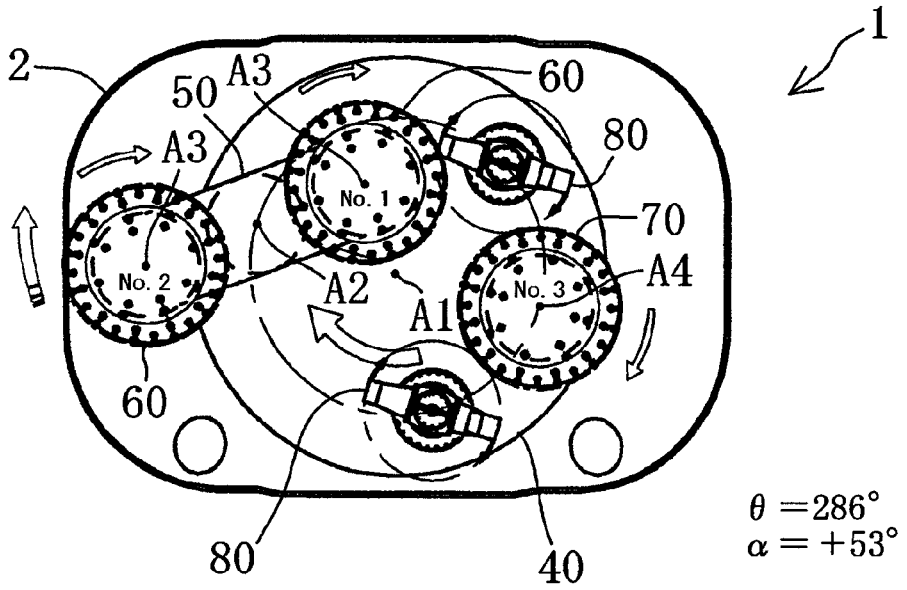

FIG. 19 is a front view showing a state where the excavator is rotated by a predetermined angle from the drum rotation angle of the excavator shown in FIG. 18.

Figure 20:
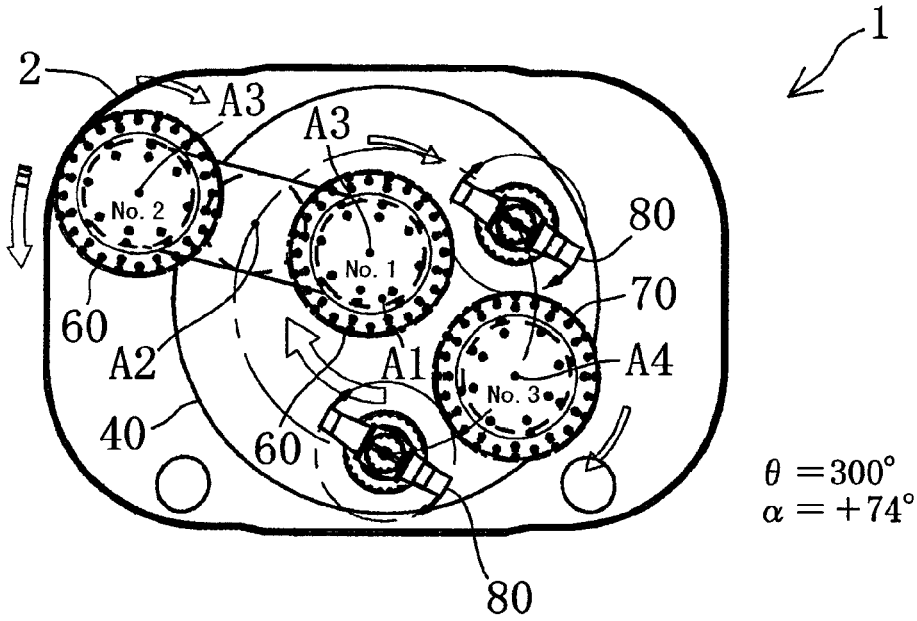

FIG. 20 is a front view showing a state where the excavator is rotated by a predetermined angle from the drum rotation angle of the excavator shown in FIG. 19.

Figure 21:
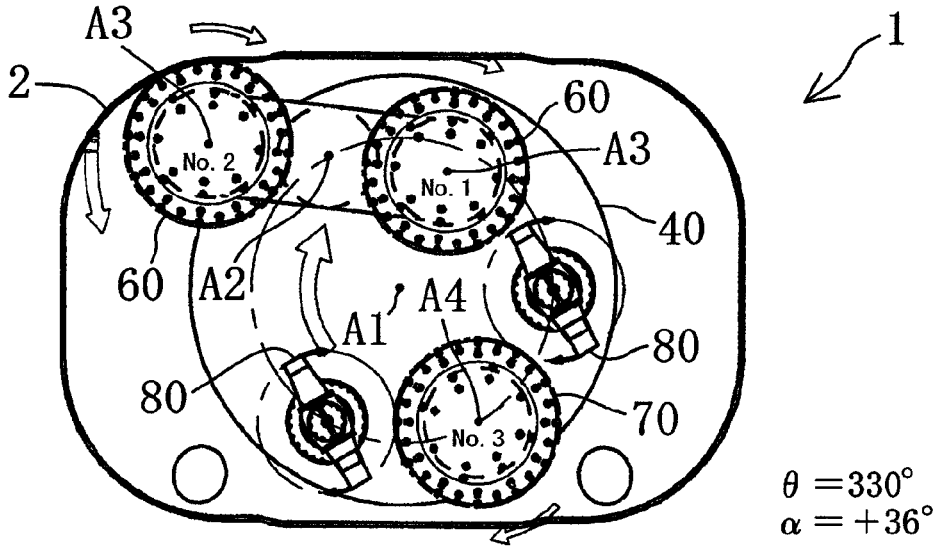

FIG. 21 is a front view showing a state where the excavator is rotated by a predetermined angle from the drum rotation angle of the excavator shown in FIG. 20.

Figure 22:
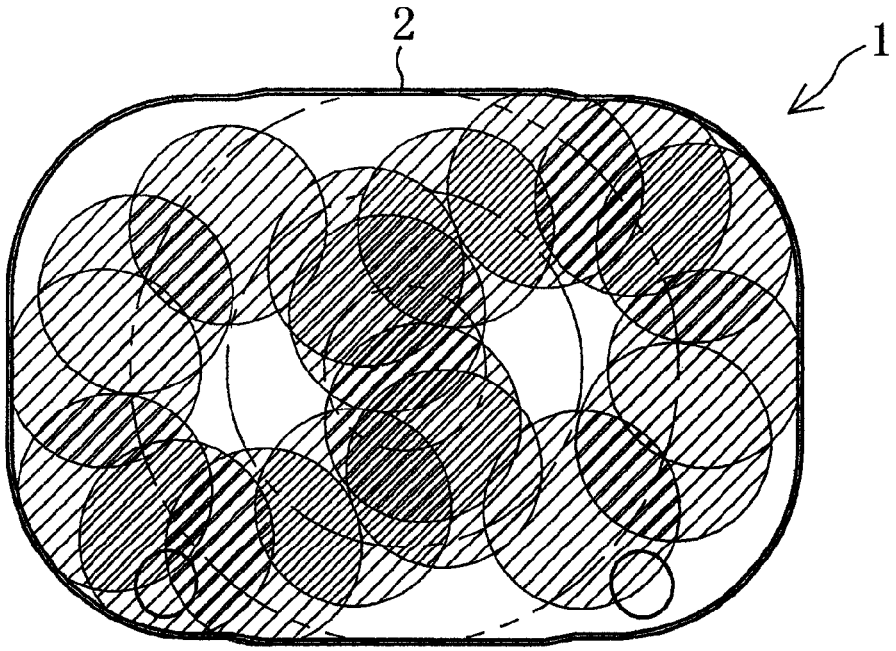

FIG. 22 is a diagram showing an area where a No. 1 cutter head included in the shield machine shown in FIG. 1 excavates.

Figure 23:
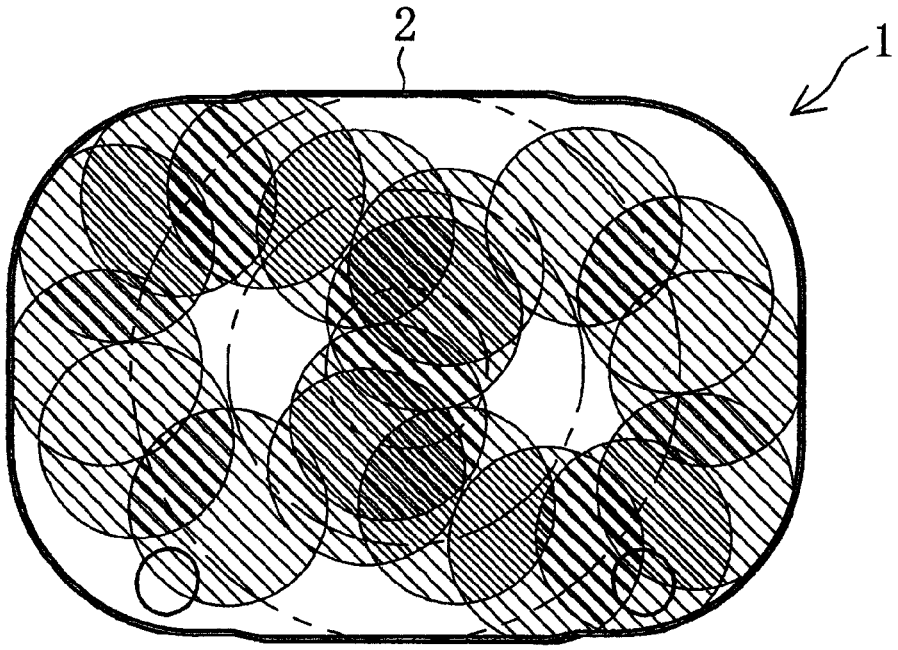

FIG. 23 is a diagram showing an area where a No. 2 cutter head included in the shield machine shown in FIG. 1 excavates.

Figure 24:
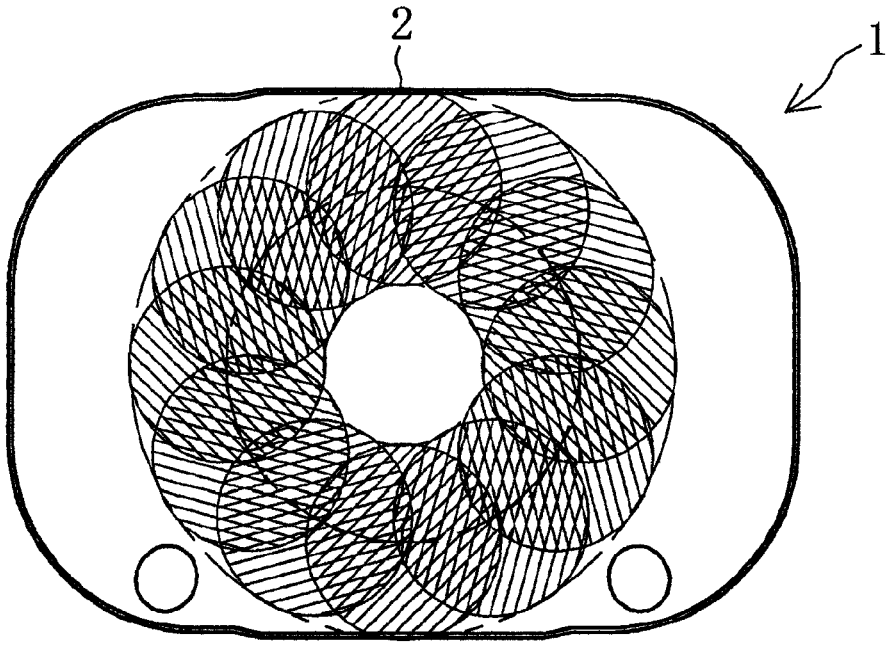

FIG. 24 is a diagram showing an area where a No. 3 cutter head included in the shield machine shown in FIG. 1 excavates.

Figure 25:
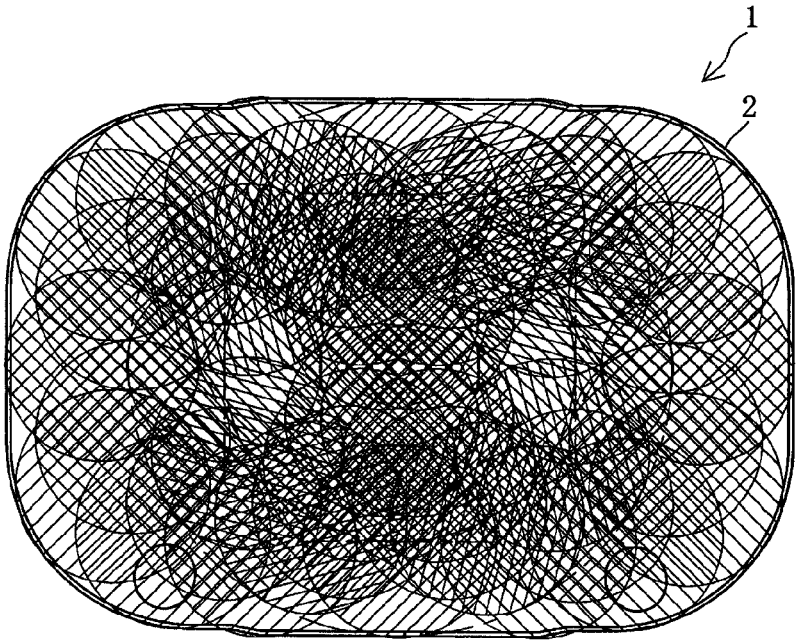

FIG. 25 is a diagram showing an area where the Nos. 1 to 3 cutter heads included in the shield machine shown in FIG. 1 excavate.

Figure 26:
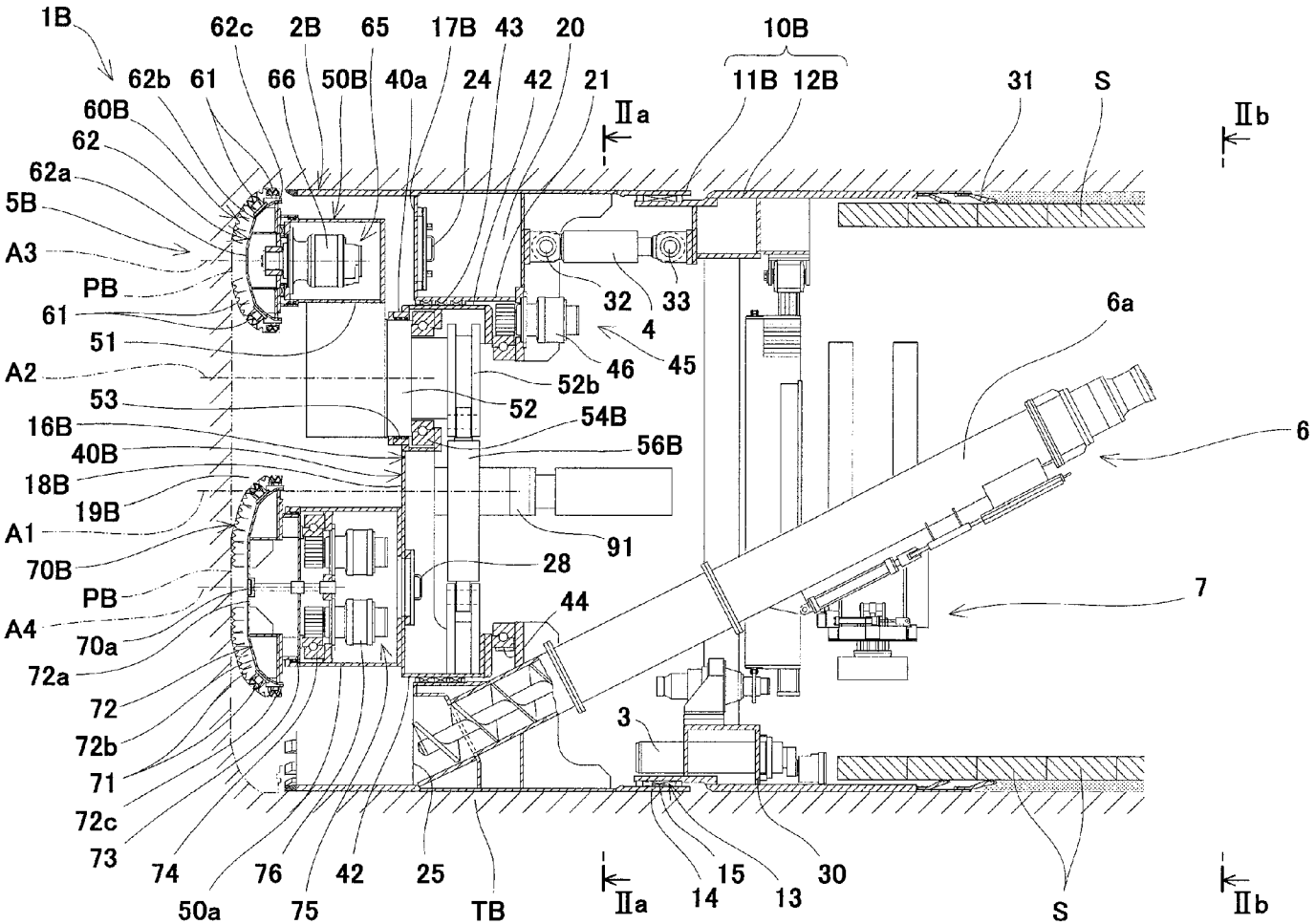

FIG. 26 is a longitudinal sectional view of the shield machine according to Embodiment 2 of the present invention.

Figure 27:
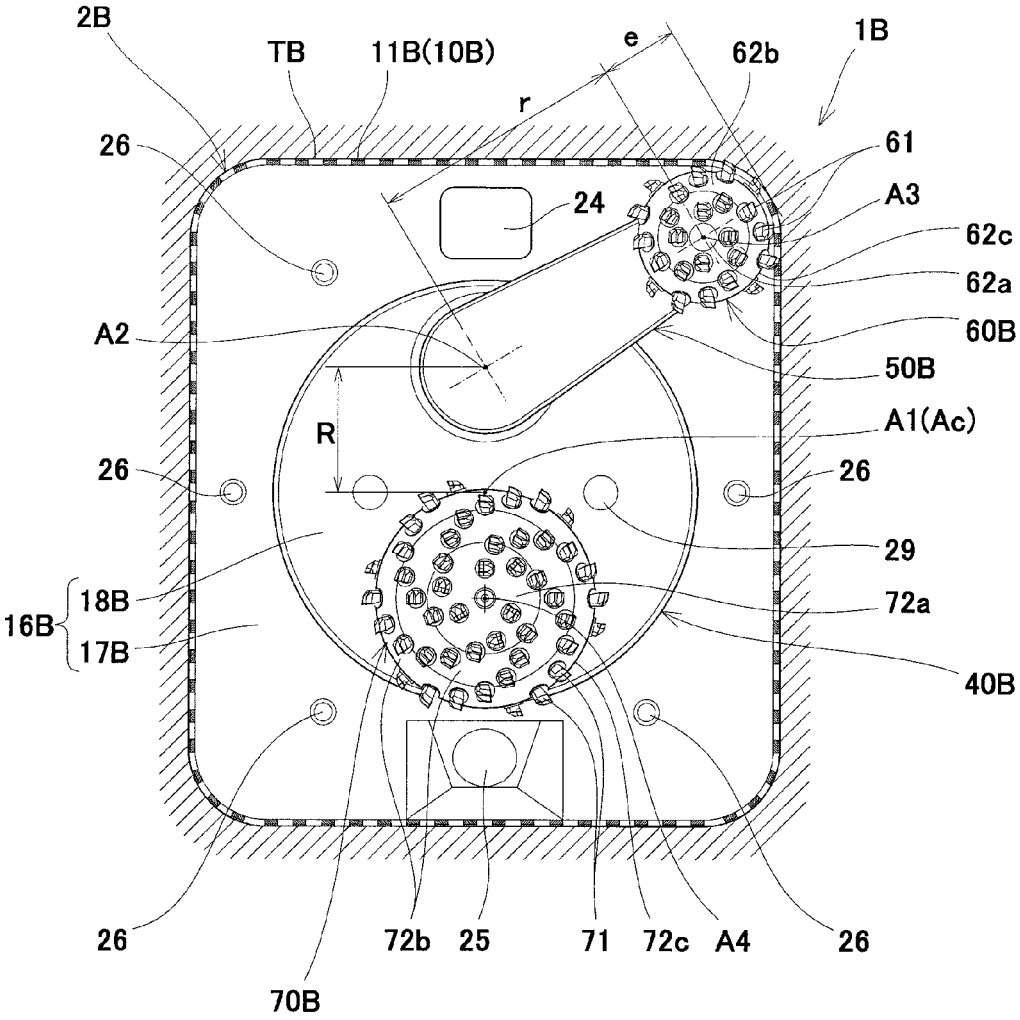

FIG. 27 is a front view of the shield machine shown in FIG. 26.

Figure 28:
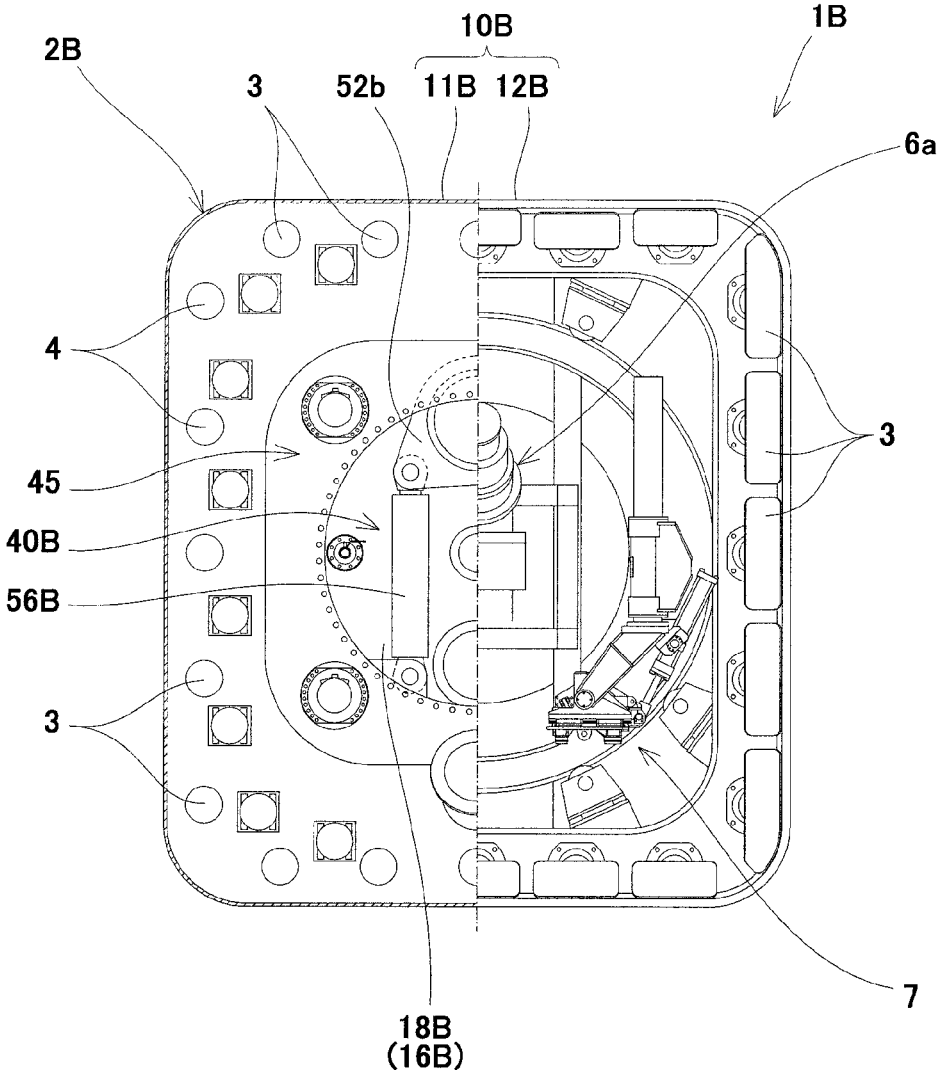

A left half of FIG. 28 is a cross-sectional view taken along line IIa-IIa of FIG. 26, and a right half of FIG. 28 is a cross-sectional view taken along line IIb-IIb of FIG. 26.

Figure 29:
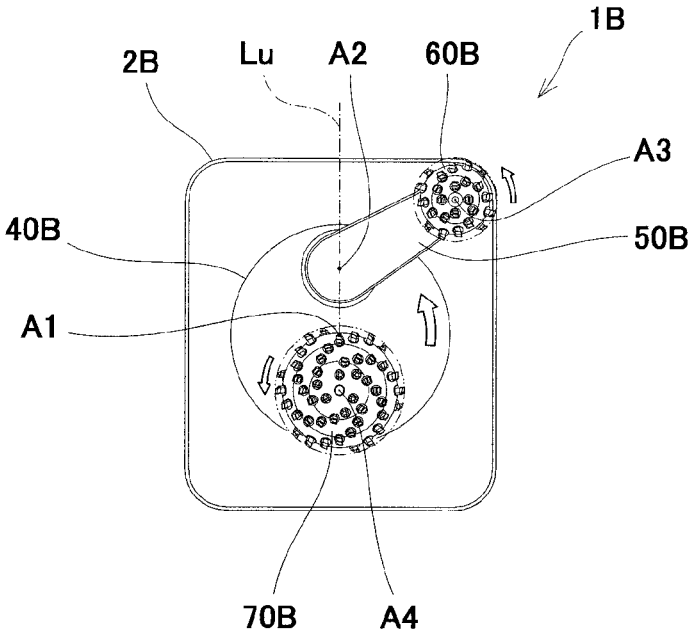

FIG. 29 is a front view showing a state where the drum rotation angle of the excavator included in the shield machine shown in FIG. 26 is ±0 degrees.

Figure 30:
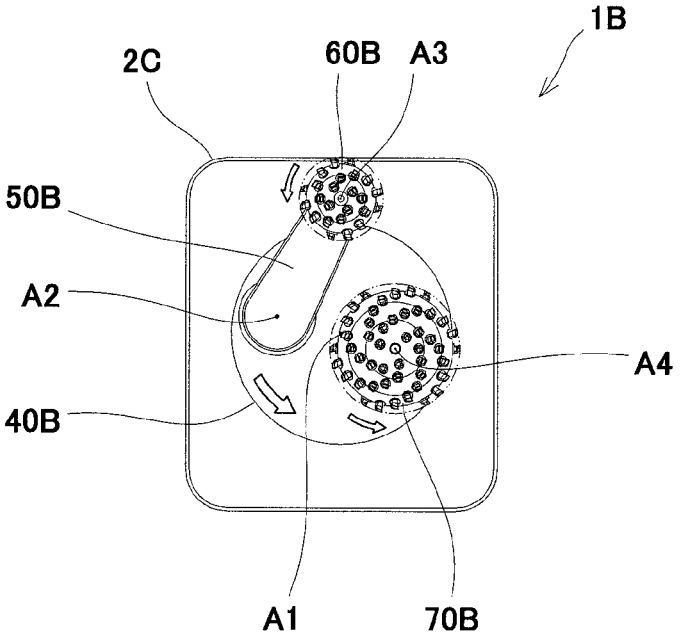

FIG. 30 is a front view showing a state where the excavator is rotated by a predetermined angle from the drum rotation angle of the excavator shown in FIG. 29.

Figure 31:
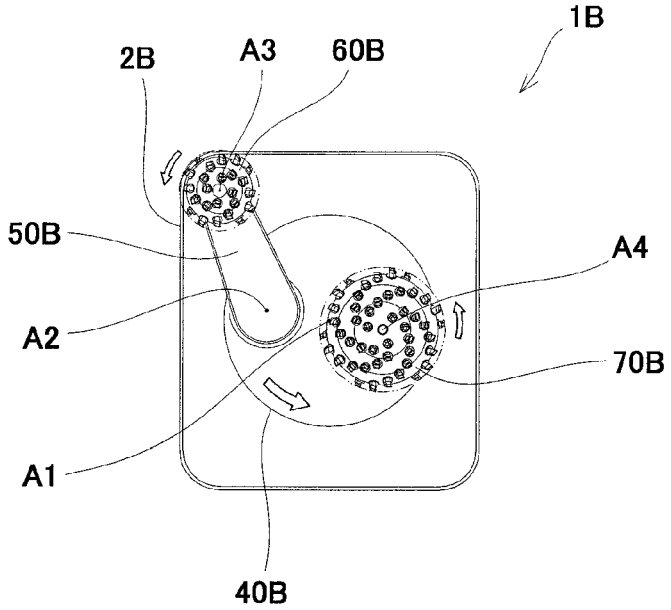

FIG. 31 is a front view showing a state where the excavator is rotated by a predetermined angle from the drum rotation angle of the excavator shown in FIG. 30.

Figure 32:
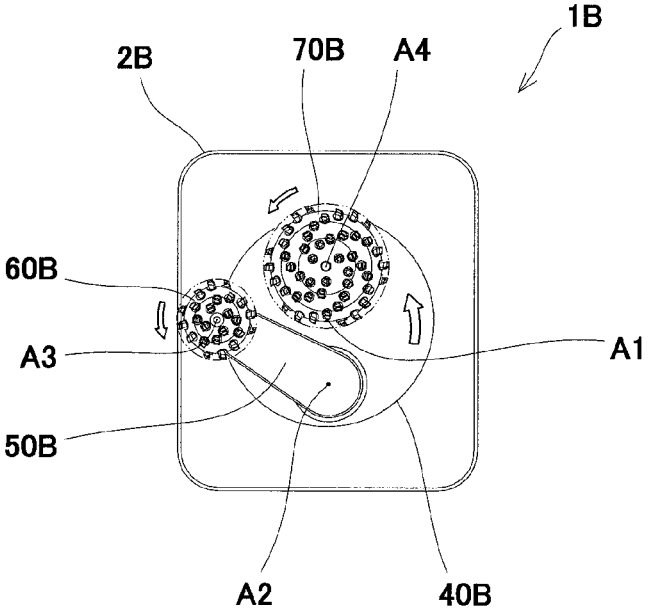

FIG. 32 is a front view showing a state where the excavator is rotated by a predetermined angle from the drum rotation angle of the excavator shown in FIG. 31.

Figure 33:
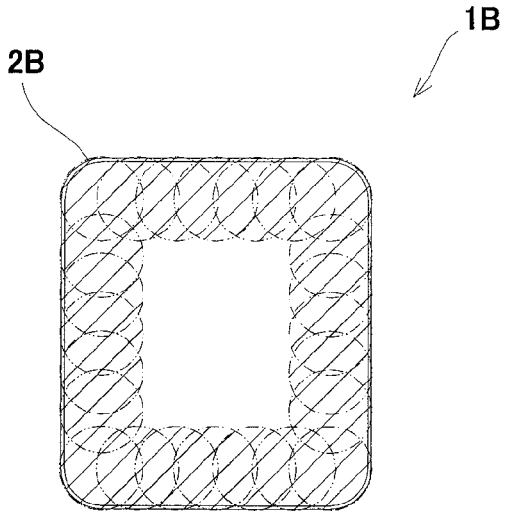

FIG. 33 is a diagram showing an area where the No. 1 cutter head included in the shield machine shown in FIG. 26 excavates.

Figure 34:
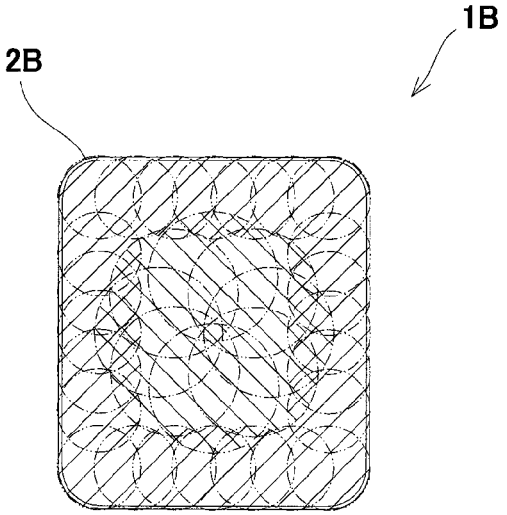

FIG. 34 is a diagram showing an area where the Nos. 1 to 3 cutter heads included in the shield machine shown in FIG. 26 excavates.

Figure 35:
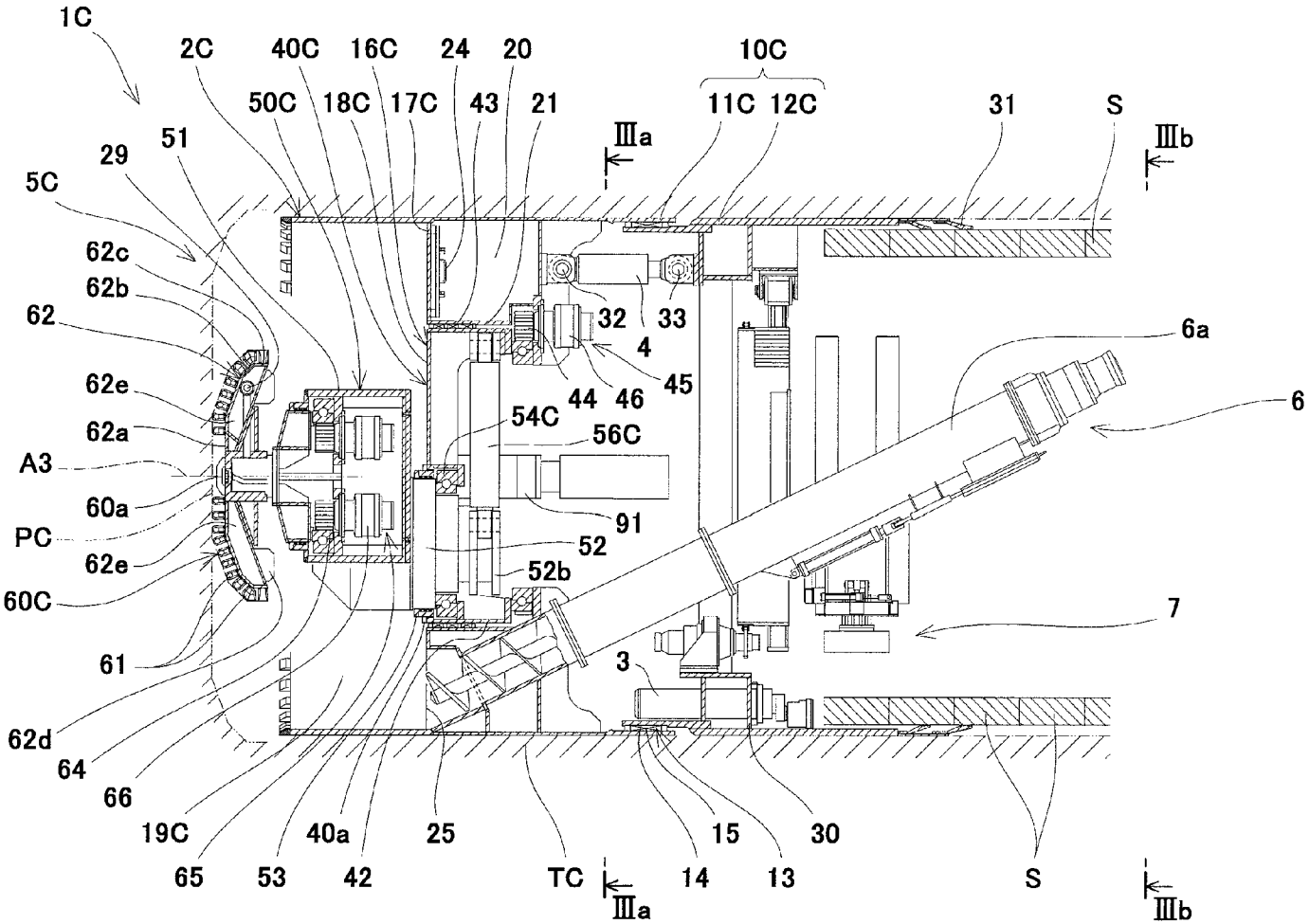

FIG. 35 is a longitudinal sectional view of the shield machine according to Embodiment 3 of the present invention.

Figure 36:
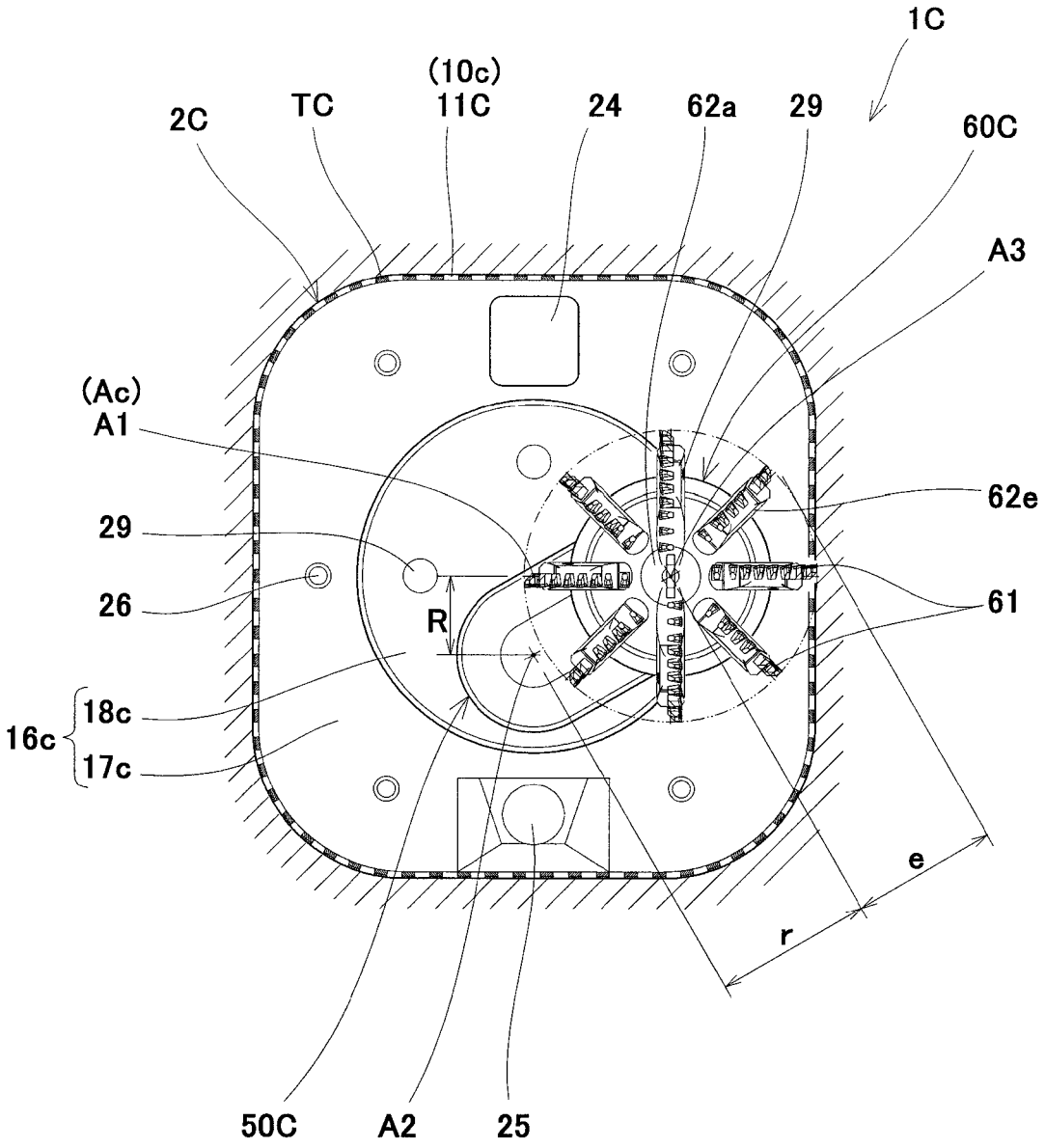

FIG. 36 is a front view of the shield machine shown in FIG. 35.

Figure 37:
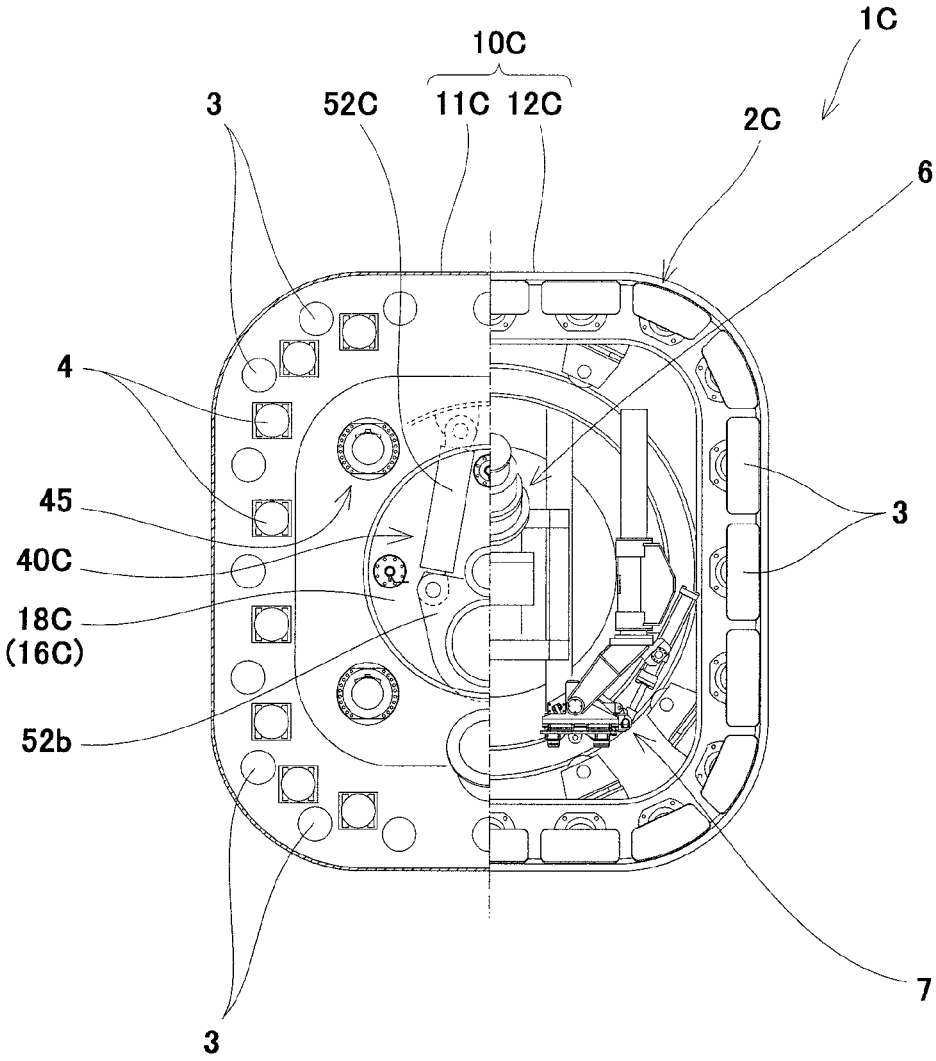

A left half of FIG. 37 is a cross-sectional view taken along line IIIa-IIIa of FIG. 35, and a right half of FIG. 37 is a cross-sectional view taken along line IIIb-IIIb of FIG. 35.

Figure 38:
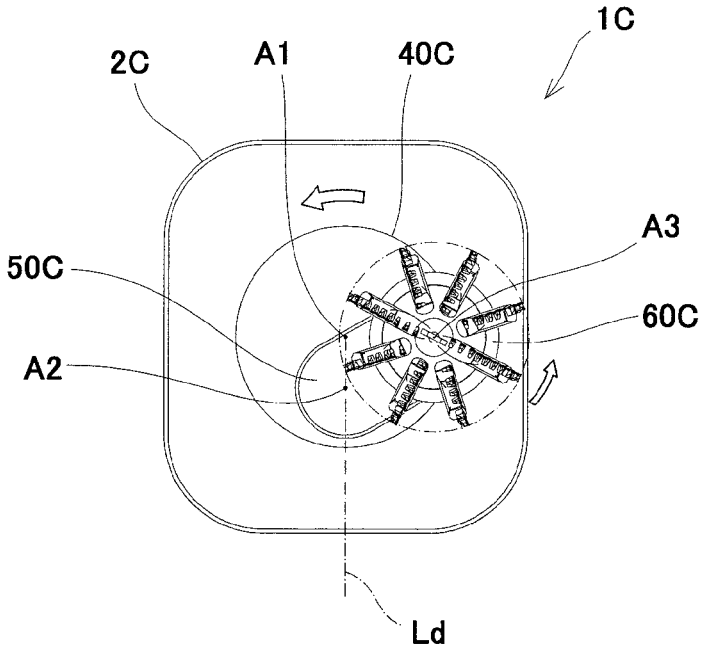

FIG. 38 is a front view showing a state where the drum rotation angle of the excavator included in the shield machine shown in FIG. 35 is ±0 degrees.

Figure 39:
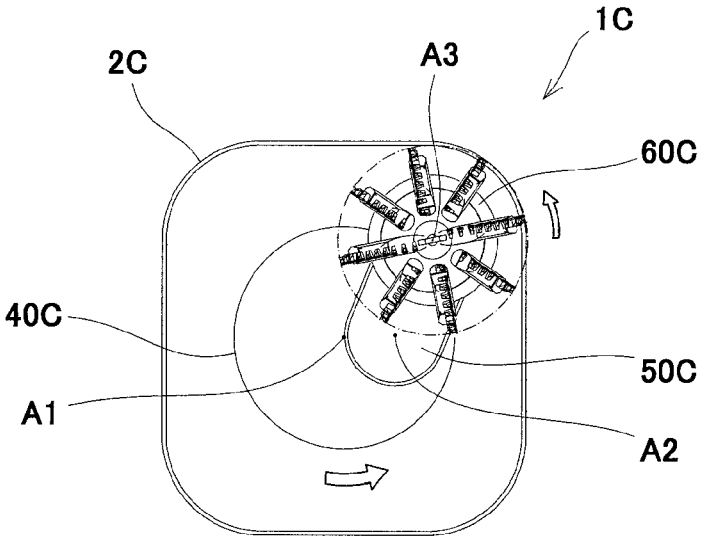

FIG. 39 is a front view showing a state where the excavator is rotated by a predetermined angle from the drum rotation angle of the excavator shown in FIG. 38.

Figure 40:
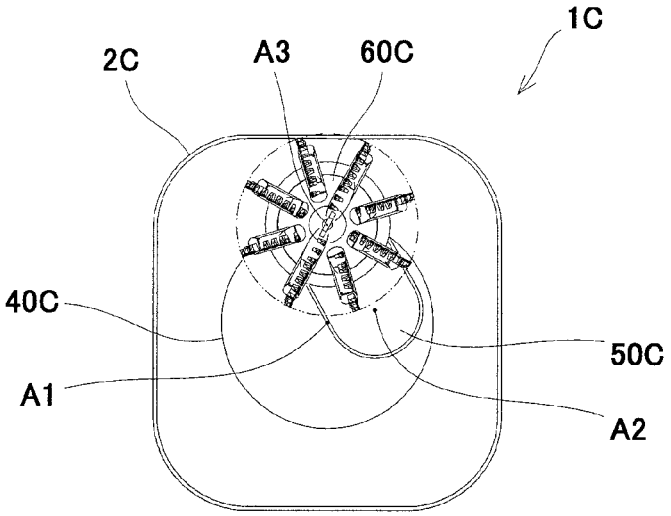

FIG. 40 is a front view showing a state where the excavator is rotated by a predetermined angle from the drum rotation angle of the excavator shown in FIG. 39.

Figure 41:
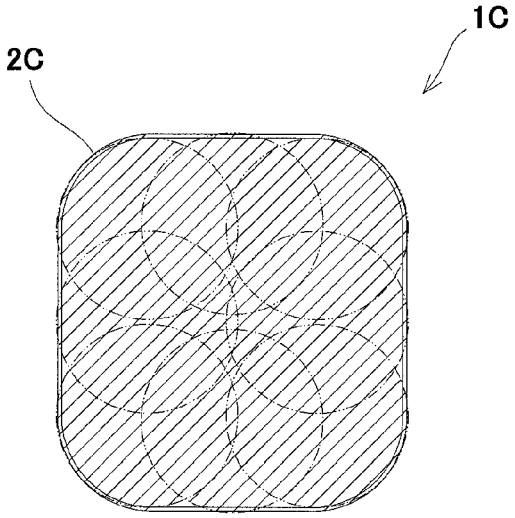

FIG. 41 is a diagram showing an area where the No. 1 cutter head included in the shield machine shown in FIG. 36 excavates.

Figure 42:
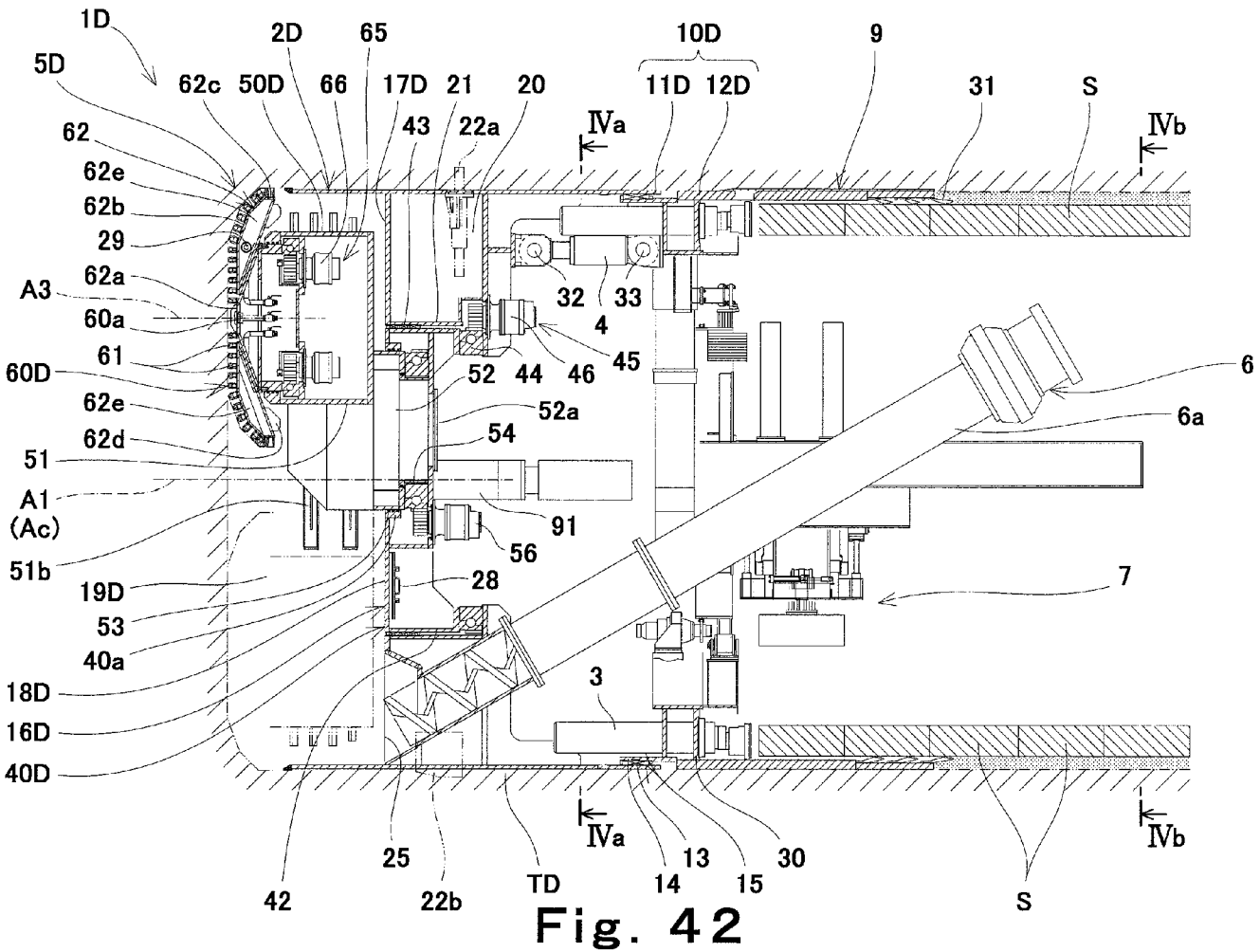

FIG. 42 is a longitudinal sectional view of the shield machine according to Embodiment 4 of the present invention.

Figure 43:
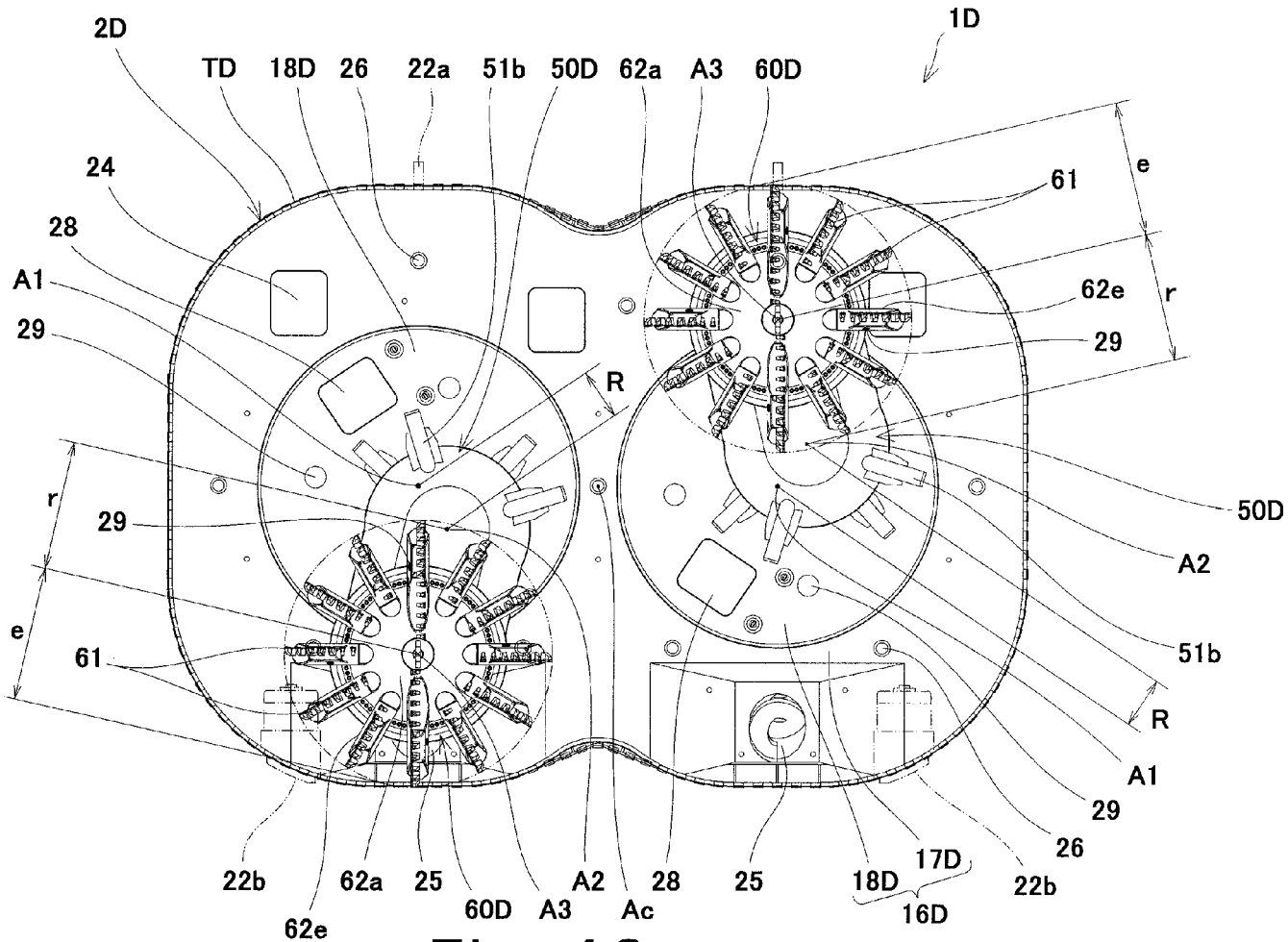

FIG. 43 is a front view of the shield machine shown in FIG. 42.

Figure 44:
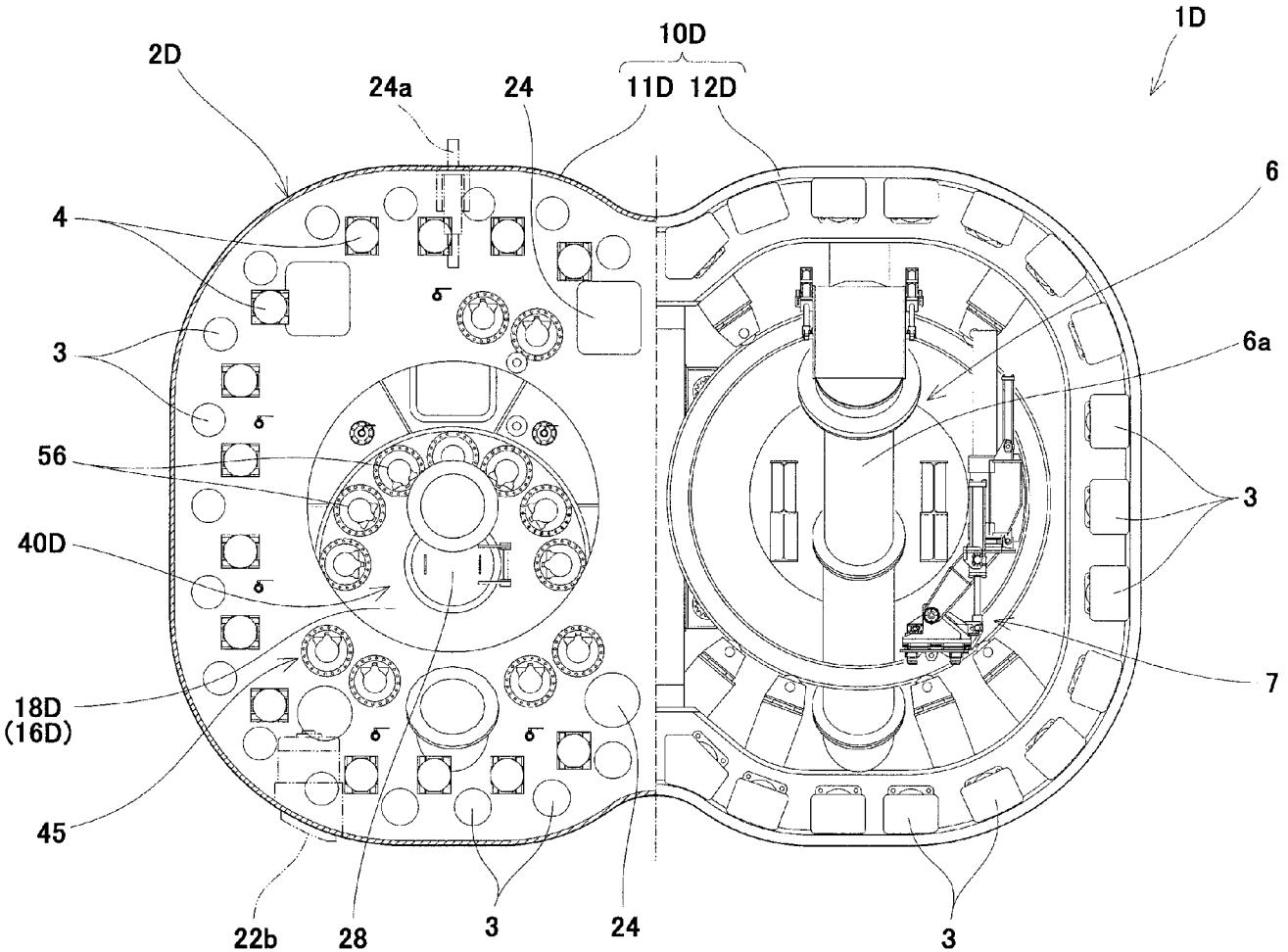

A left half of FIG. 44 is a cross-sectional view taken along line IVa-IVa of FIG. 42, and a right half of FIG. 44 is a cross-sectional view taken along line IVb-IVb of FIG. 42.

Figure 45:
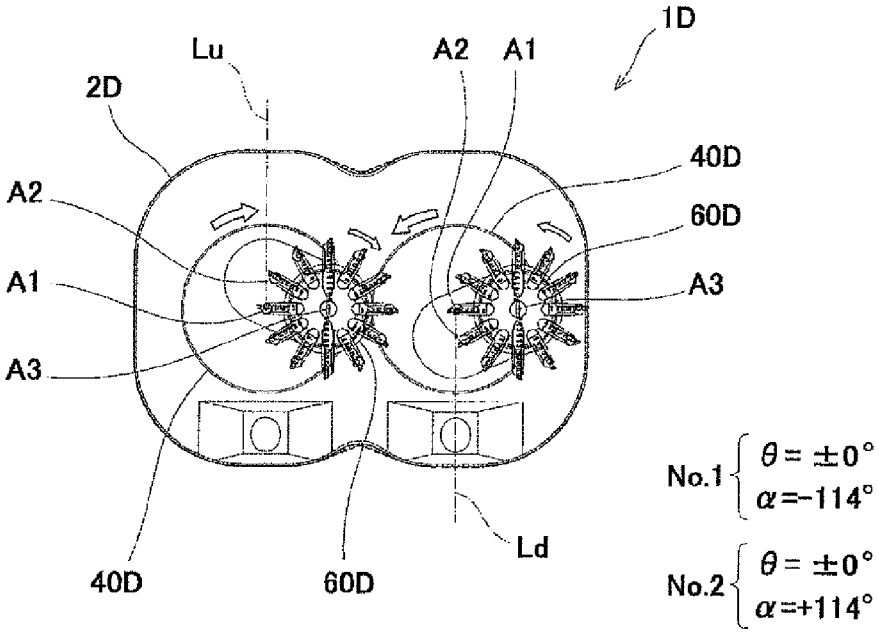

FIG. 45 is a front view showing a state where the drum rotation angle of the excavator included in the shield machine shown in FIG. 42 is ±0 degrees.

Figure 46:
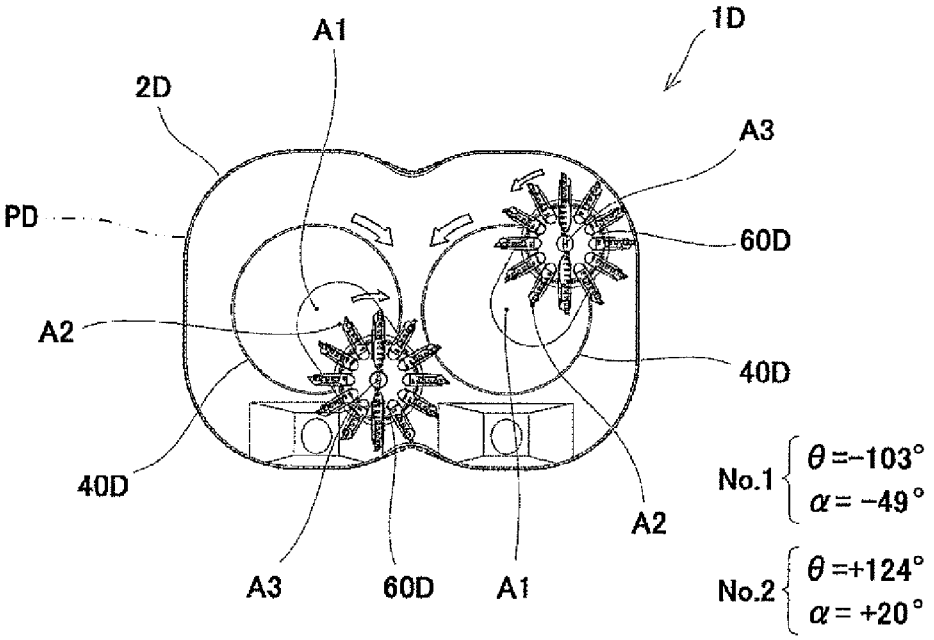

FIG. 46 is a front view showing a state where the excavator is rotated by a predetermined angle from the drum rotation angle of the excavator shown in FIG. 45.

Figure 47:
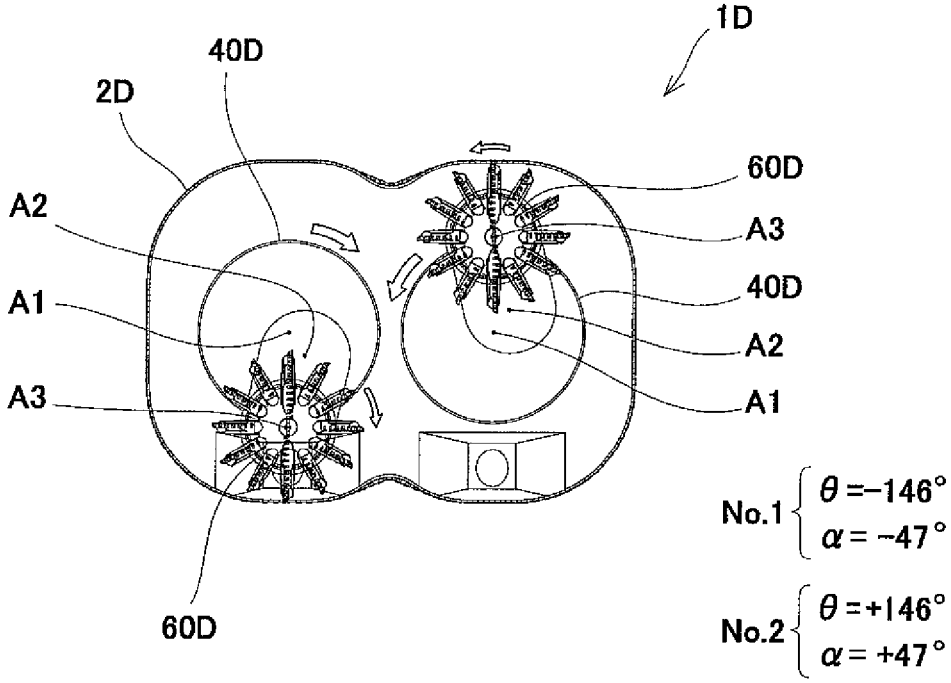

FIG. 47 is a front view showing a state where the excavator is rotated by a predetermined angle from the drum rotation angle of the excavator shown in FIG. 46.

Figure 48:
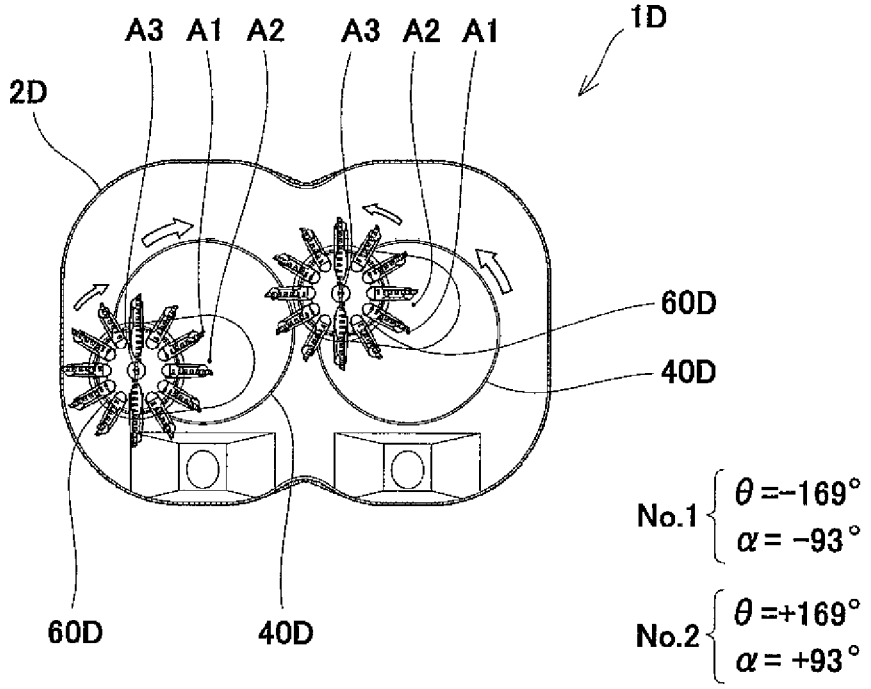

FIG. 48 is a front view showing a state where the excavator is rotated by a predetermined angle from the drum rotation angle of the excavator shown in FIG. 47.

Figure 49:
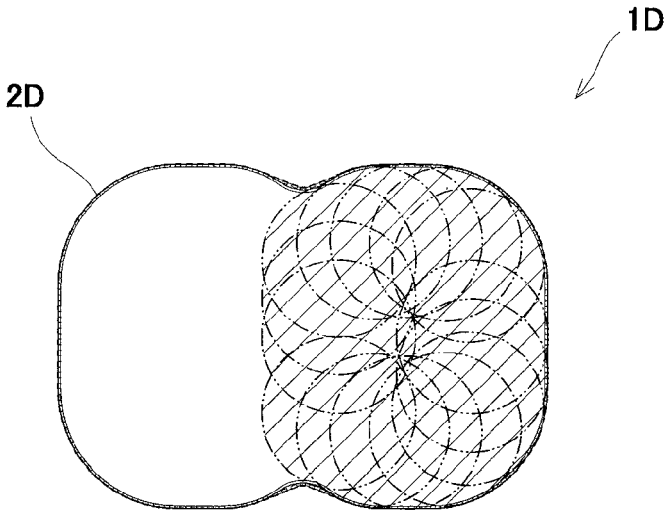

FIG. 49 is a diagram showing an area where the No. 1 cutter head included in the shield machine shown in FIG. 43 excavates.

Figure 50:
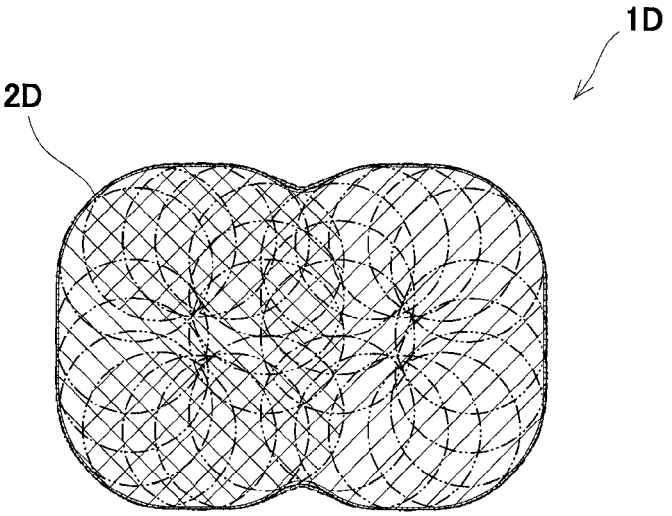

FIG. 50 is a diagram showing an area where the Nos. 1 and 2 cutter heads included in the shield machine shown in FIG. 43 excavates.

Figure 51:
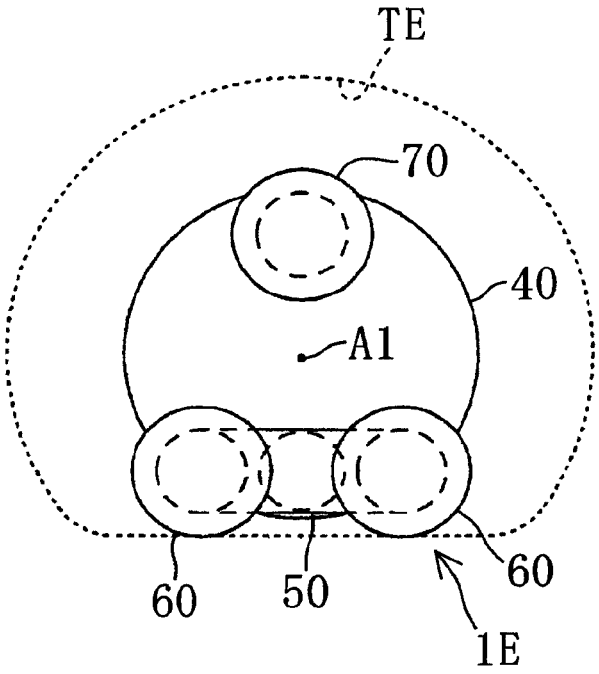

FIG. 51 is a front view of the shield machine according to Embodiment 5 of the present invention.

Figure 52:
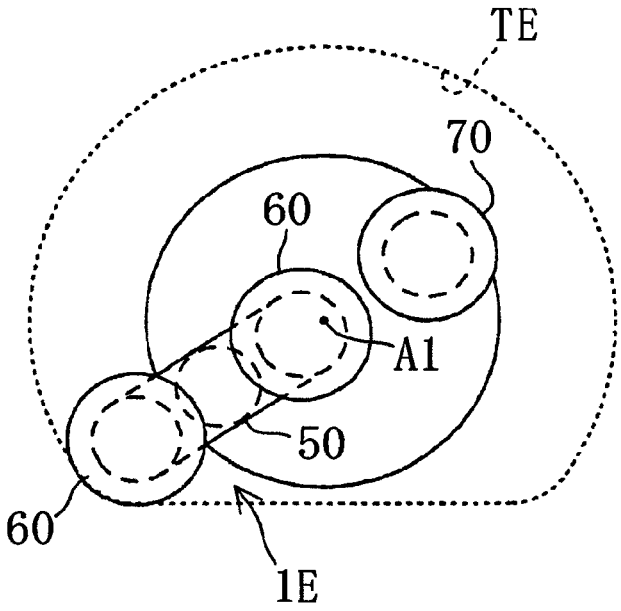

FIG. 52 is a front view showing a state where the excavator included in the shield machine shown in FIG. 51 is in the middle of excavation.

Figure 53:
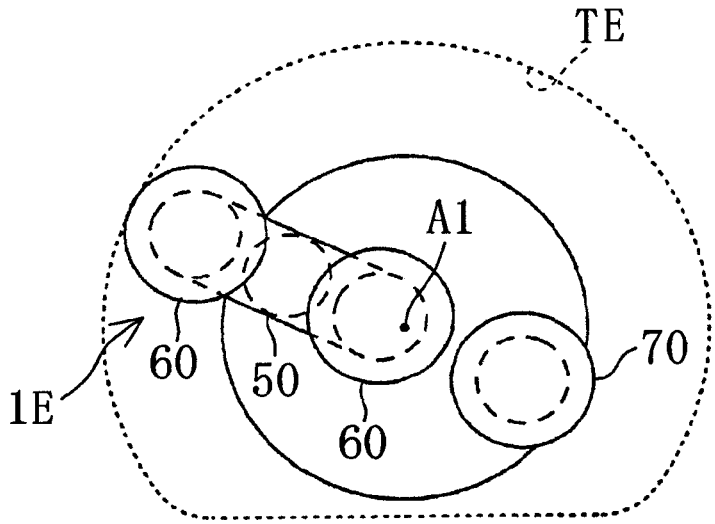

FIG. 53 is a front view showing a state where the excavator included in the shield machine shown in FIG. 51 is in the middle of excavation, and is different from FIG. 52.

Figure 54:
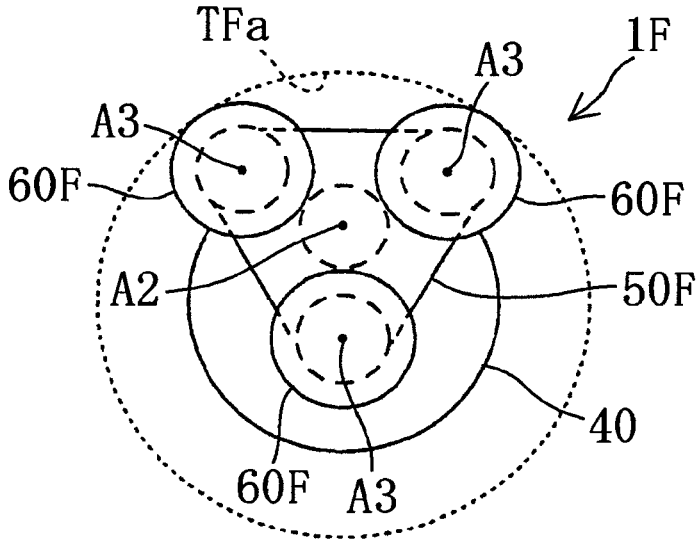

FIG. 54 is a front view of the shield machine according to Embodiment 6 of the present invention.

Figure 55:
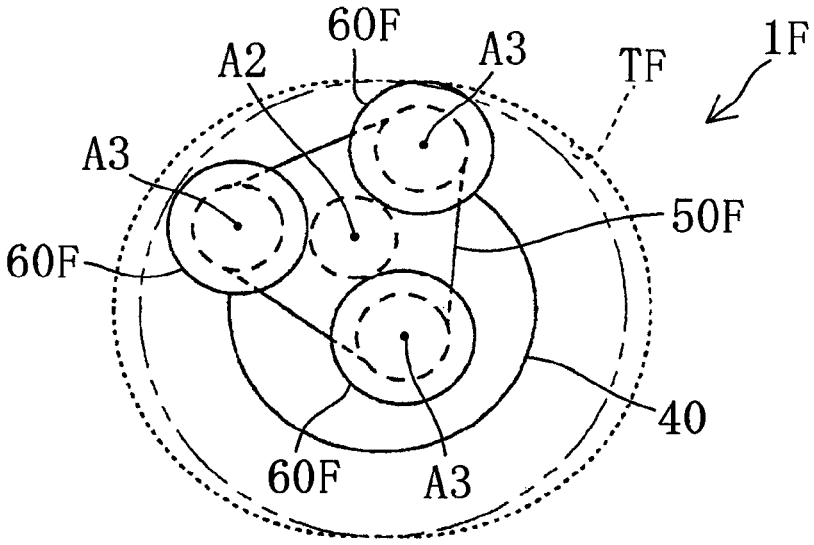

FIG. 55 is a front view showing a state where the excavator included in the shield machine shown in FIG. 54 is in the middle of excavation.

Figure 56:
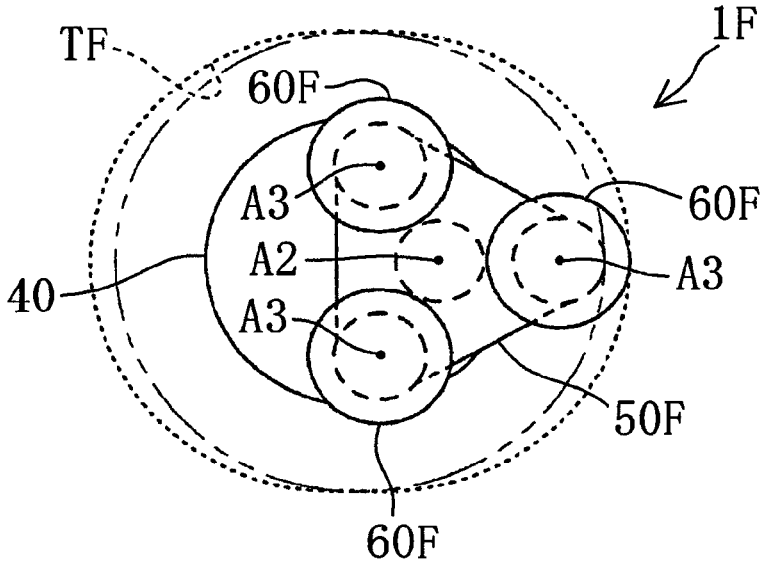

FIG. 56 is a front view showing a state where the excavator included in the shield machine shown in FIG. 54 is in the middle of excavation, and is different from FIG. 52.

Figure 57:
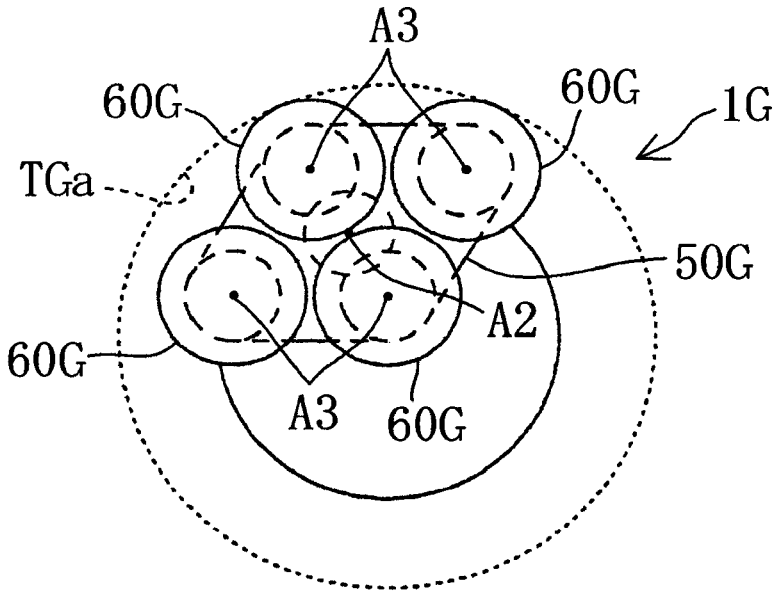

FIG. 57 is a front view of the shield machine according to Embodiment 7 of the present invention.

Figure 58:
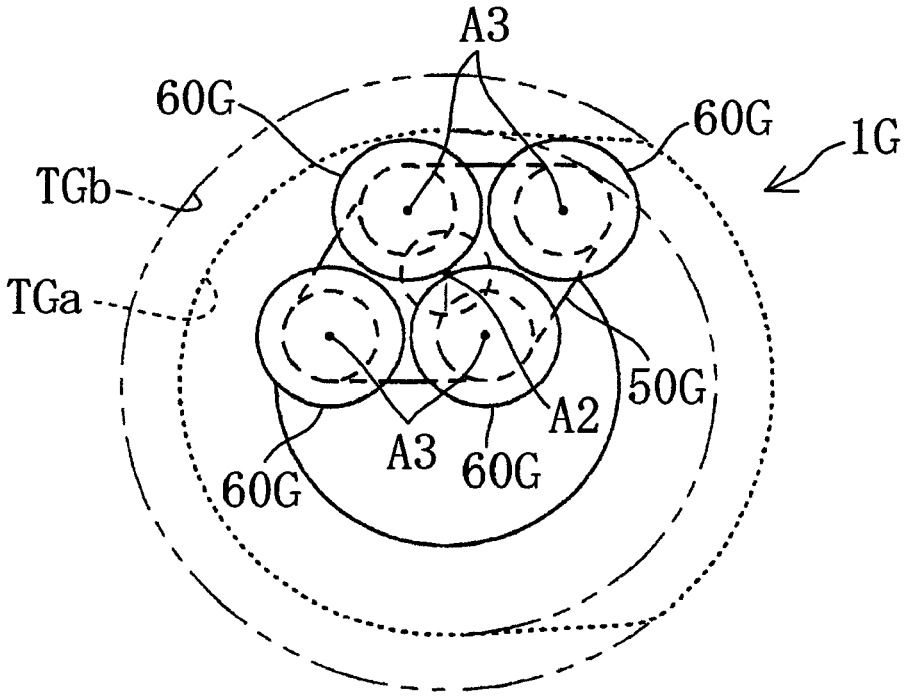

FIG. 58 is a front view showing a state where the excavator included in the shield machine shown in FIG. 57 is in the middle of excavation.

Figure 59:
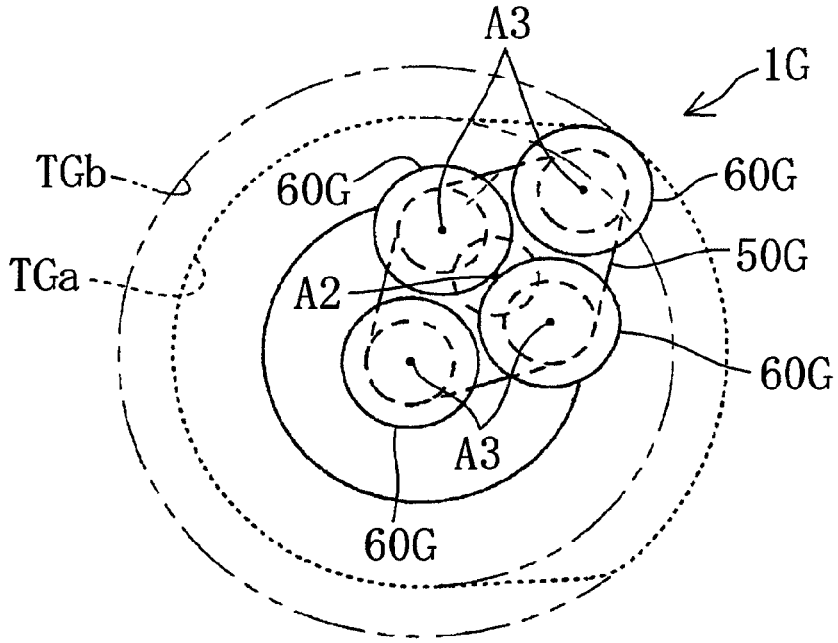

FIG. 59 is a front view showing a state where the excavator included in the shield machine shown in FIG. 57 is in the middle of excavation, and is different from FIG. 52.

Figure 60:
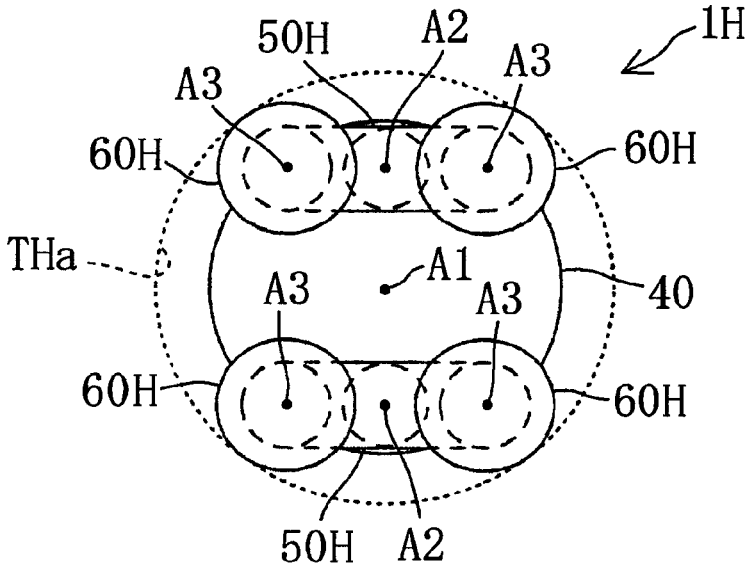

FIG. 60 is a front view of the shield machine according to Embodiment 8 of the present invention.

Figure 61:
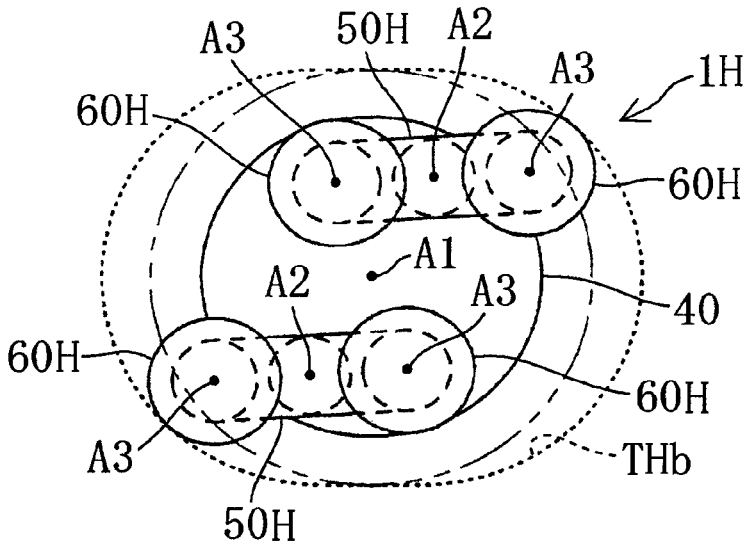

FIG. 61 is a front view showing a state where the excavator included in the shield machine shown in FIG. 60 is in the middle of excavation.

Figure 62:
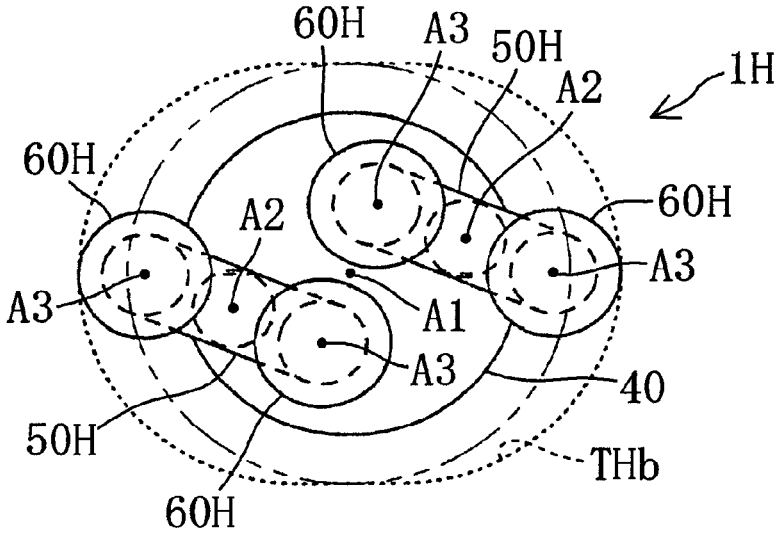

FIG. 62 is a front view showing a state where the excavator included in the shield machine shown in FIG. 60 is in the middle of excavation, and is different from FIG. 52.

EXPLANATION OF REFERENCE NUMBERS

1, 1B to 1H shield machine
2, 2B to 2D shield machine main body
3 shield jack
5, 5B to 5D excavator
10, 10B to 10D body
16, 16B to 16D dividing wall
19, 19B to 19D chamber
40, 40B to 40D rotary drum
45 first rotating mechanism
46 first hydraulic motor
50, 50B to 50D, 5OF to 50H cutter supporting frame
55 swinging drive mechanism
56 second hydraulic motor
60, 60B to 60D, 60F to 60H rotary cutter head
65 third rotating mechanism
66 third hydraulic motor
70, 70B rotary auxiliary cutter head
75 fourth rotating mechanism
80 stirring blade
85 fifth rotating mechanism
90 drive control unit

BEST MODE FOR CARRYING OUT THE INVENTION

Hereinafter, embodiments of the present invention will be explained based on the drawings. The following embodiments will explain examples in which a cutter bit is used as an excavating cutter.

Embodiment 1

Figure 2:
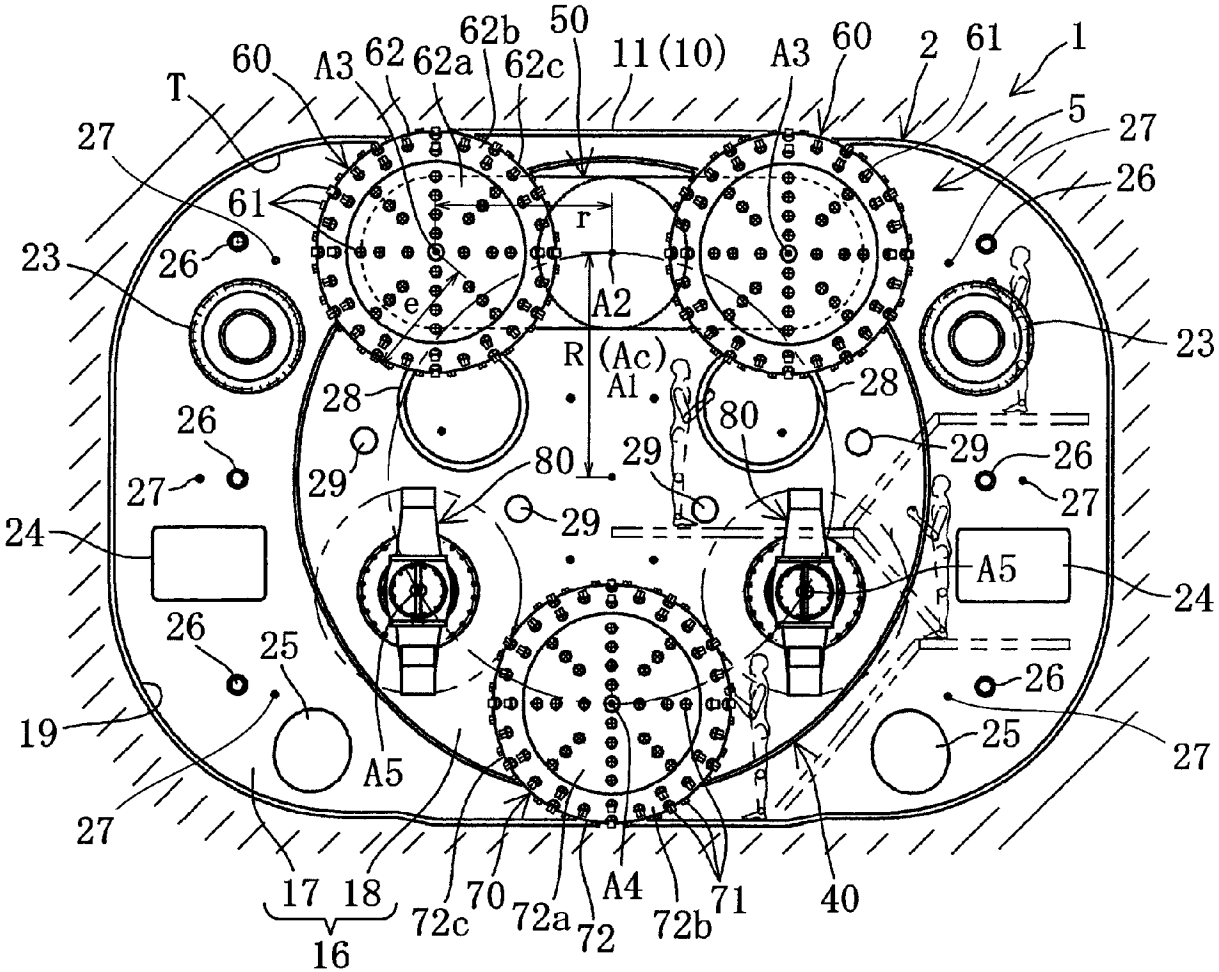
FIG. 2 is a front view of the shield machine shown in FIG. 1.

FIG. 1 is a longitudinal sectional view of a shield machine according to Embodiment 1 of the present invention. FIG. 2 is a front view of the shield machine shown in FIG. 1. A left half of FIG. 3 is a cross-sectional view taken along line Ia-Ia of FIG. 1, and a right half of FIG. 3 is a cross-sectional view taken along line Ib-Ib of FIG. 1. FIG. 4 is a half cross-sectional view showing main components including a cutter supporting frame and a rotary cutter head in the shield machine shown in FIG. 1. FIG. 5 is a block diagram showing a drive control system of the shield machine shown in FIG. 1.

As shown in FIGS. 1 and 3, a shield machine 1 includes a shield machine main body 2 having a body 10, and a plurality of shield jacks 3 configured to cause the shield machine main body 2 to move ahead. The body 10 is constituted by a front body 11 and a rear body 12, and an intermediate bent portion 13 is provided between a rear end portion of the front body 11 and a front end portion of the rear body 12. The front body 11 and the rear body 12 are coupled to each other by the intermediate bent portion 13 such that the body 10 is bendable. A plurality of bending jacks 4 which causes the body 1 to bend are provided between the front body 11 and the rear body 12 at the intermediate bent portion 13. Each of the front body 11 and the rear body 12 is formed to have a square tubular shape having a horizontally-long rectangular cross section in which a ratio of a vertical length to a horizontal length is 1 to 2. Corner portions formed by upper, lower, left, and right walls of the front body 11 and the rear body 12 are curved. Further, an excavator 5 configured to excavate a natural ground is provided on a front end side of the shield machine main body 2. Inside the shield machine main body 2, an excavated sand discharger 6 having a pair of left and right screw conveyors 6*a* configured to discharge sand excavated by the excavator 5 is included. Further, in a rear portion of the excavator main body 2, a pair of left and right erector devices 7 configured to attach segments S to an inner surface of a tunnel T excavated by the excavator 5, a pair of left and right segment supporting devices 8 configured to support the attached segments S, a back fill injecting device 9 configured to inject mortar between the inner surface of the tunnel T and the attached segment S, and the like are included.

As shown in FIG. 1, at the intermediate bent portion 13 provided between the front body 11 and the rear body 12, a partially spherical seat 14 having a circular shape is formed at the front end portion of the rear body 12, the rear end portion of the front body 11 is externally fitted to the partially spherical seat 14, and a circular sealing member 15 is attached to between fitting portions of the front body 11 and the rear body 12. Moreover, a vertical dividing wall 16 is provided at a position inside the front body 11 which position is located about ⅓ the length of the front body 11 in a direction from a front end of the front body 11 to a rear end of the front body 11. The dividing wall 16 is constituted by a fixed dividing wall 17 and a movable dividing wall 18. An outer peripheral portion of the fixed dividing wall 17 is fixed to the inner surface of the front body 11. The movable dividing wall 18 has a circular plate shape and is rotatably and internally fitted to the fixed dividing wall 17. A chamber 19 configured to recover the sand excavated by the excavator 5 is formed in front of the dividing wall 16 in the front body 11. The dividing wall 16 serves as a wall defining a rear end of the chamber 19.

Behind the fixed dividing wall 17, a circular member 20 having a cylindrical portion 21 is fixed to the front body 11. A below-described rotary drum 40 of the excavator 5 is rotatably supported by the cylindrical portion 21. A wall surface of the movable dividing wall 18 is formed by a plate member 41 provided on a front surface of the rotary drum 40. Moreover, a pair of left and right natural ground searching devices 22*a* are provided at an upper end portion in the vicinity of a rear end of the fixed dividing wall 17. The natural ground searching device 22*a* is configured to be extensible and retractable in a radial direction from the front body 11. Further, a pair of left and right movable sleighs 22*b* is provided at a lower end portion of the front body 11. The movable sleigh 22*b* is configured to be extensible and retractable in the radial direction. The movable sleigh 22*b* is configured to prevent the body 10 from rolling and maintain a predetermined posture of the body 10.

As shown in FIG. 2, the fixed dividing wall 17 is provided with a pair of left and right manlocks 23, a pair of left and right manholes 24, and a pair of left and right sand discharging openings 25. In addition, the fixed dividing wall 17 is provided with six earth pressure gauges 26 and six mud adding material inlets 27. An inner space of the manlock 23 is separated from the inner space of the shield machine main body 2, and the manlock 23 can increase the pressure of the inner space up to about the pressure inside the chamber 19. The movable dividing wall 18 is provided with a pair of manholes 28 and four mud adding material inlets 29.

As shown in FIGS. 1 and 3, a ring web 30 is fixed to a front end portion of an inner surface of the rear body 12, and a tail seal 31 is provided at a rear end portion of the inner surface of the rear body 12. The plurality of shield jacks 3 are provided at a front end portion of the rear body 12, and are provided along the inner surface of the rear body 12 in a circumferential direction at predetermined intervals (at substantially regular intervals) so as to face rearward. A rear portion of a jack main body of each of the shield jacks 3 is fixed to the ring web 30 so as to penetrate the ring web 30. The shield machine 1 obtains an ahead power by a reaction force generated when the plurality of shield jacks 3 press rearward the segments S attached by the erector devices 7.

The plurality of bending jacks 4 are provided along the inner surface of the front body 11 and the inner surface of the rear body 12 in the circumferential direction at predetermined intervals (at substantially regular intervals). The bending jacks 4 are provided to face forward so as not to interfere with the plurality of shield jacks 3 (FIG. 3). A front end portion of each bending jack 4 is rotatably coupled to a bracket 32 fixed to the front body 11, and a rear end portion of each bending jack 4 is rotatably coupled to a bracket 33 fixed to the rear body 12.

Meanwhile, as shown in FIG. 1, the rotary drum 40 includes the plate member 41 provided on the front surface of the rotary drum 40 so as to form the wall surface of the movable dividing wall 18 as described above, and a plurality of ribs provided between the rear surface of the plate member 41 and an outer tube 42. This increases the strength and stiffness of the rotary drum 40 with respect to the rotational direction, so that the rotary drum 40 is excellent in view of the strength and durability. The rotary drum 40 is rotatably supported such that the outer tube 42 is internally fitted in the cylindrical portion 21 of the circular member 20. Moreover, a circular sealing member 43 is attached to between the cylindrical portion 21 and the outer tube 42. Further, a ring gear 44 is fixedly provided on a rear end portion of the outer tube 42. The ring gear 44 is configured to be rotatable by a bearing.

A first rotating mechanism 45 configured to cause the rotary drum 40 to rotate includes a plurality of (for example, eight) first hydraulic motors 46 which are attached to the shield machine main body 2 and correspond to first actuators. The plurality of first hydraulic motors 46 are respectively attached to ring-shape motor attaching portions 47 provided at a rear end portion of the circular member 20. The first hydraulic motors 46 are provided in the circumferential direction at predetermined intervals so as to face forward. An output gear of the first hydraulic motor 46 engages the ring gear 44.

Next, the excavator 5 will be explained in detail. As shown in FIGS. 1 and 2, the excavator 5 is provided at a front end side portion of the shield machine main body 2. The shield machine main body 2 is provided with the rotary drum 40 corresponding to a first rotating member supported to be rotatable around a first center axis A1 parallel to a central axis Ac of the shield machine main body 2. The rotary drum 40 is provided with a second center axis A2 spaced apart from the first center axis A1. At the second center axis A2, a cutter supporting frame 50 is provided, which corresponds to a swinging member supported to be swingable around the second center axis A2.

As shown in FIGS. 2 and 4, the cutter supporting frame 50 includes a frame main body 51 provided in the chamber 19 located in front of the rotary drum 40, and a tubular portion 52 coupled to a length-direction center portion of a rear end portion of the frame main body 51 to project rearward. A center of the tubular portion 52 is located at the second center axis A2. The frame main body 51 is formed in a box shape such that a length thereof is about ⅘ of the diameter of the rotary drum 40, and a front-back length thereof is slightly shorter than a front-back length of the chamber 19. A pair of below-described rotary cutter heads 60 is respectively attached to both length-direction end portions of the frame main body 51.

Moreover, as shown in FIG. 1, the cutter supporting frame 50 is rotatably supported such that the tubular portion 52 provided on the shield machine main body 2 side is internally fitted in a cylindrical receiving portion 40*a* provided at an outer periphery adjacent portion of the rotary drum 40. A circular sealing member 53 is attached to between the cylindrical receiving portion 40*a* and the tubular portion 52. A ring gear 54 is fixedly provided at a rear end portion of the tubular portion 52. The ring gear 54 is configured to be rotatable by a bearing. A swinging drive mechanism 55 includes a plurality of (for example, eight) second hydraulic motors 56 which are attached to the rotary drum 40 and correspond to second actuators. The plurality of second hydraulic motors 56 are respectively provided at motor attaching portions of the rotary drum 40. The second hydraulic motors 56 are provided in the circumferential direction at predetermined intervals so as to face forward. An output gear of the second hydraulic motor 56 engages the ring gear 54.

Further, as shown in FIGS. 1 and 2, the cutter supporting frame 50 is caused to swing by the swinging drive mechanism 55 configured to cause the cutter supporting frame 50 to swing with respect to the rotary drum 40. The cutter supporting frame 50 is provided with a pair of third center axes A3 different from each other. A pair of rotary cutter heads 60 are provided at the third center axes A3, respectively.

Moreover, as shown in FIG. 2, the cutter supporting frame 50 is rotatably supported in the vicinity of an outer peripheral portion of the rotary drum 40. The pair of rotary cutter heads 60 rotatably supported by the cutter supporting frame 50 can move to an area outside an outer periphery of the rotary drum 40 when viewed from the front by causing the cutter supporting frame 50 to swing. As above, since the rotary cutter heads 60 can move to the area outside the outer periphery of the rotary drum 40 when viewed from the front, the shield machine 1 can excavate the tunnel T of a cross-sectional shape having a larger diameter than the rotary drum 40.

Further, as shown in FIGS. 1 and 4, each of the pair of rotary cutter heads 60 in the present embodiment includes a cutter frame 62 having a circular front surface 62*a*, an annular tapered surface 62*b* expanding rearward from the front surface 62*a* toward the shield machine main body 2 side to be connected to an outer periphery of the front surface 62*a*, and a cylindrical outer peripheral surface 62*c* connected to a rear end of the annular tapered surface 62*b*. These surfaces form an excavating surface P. In the present embodiment, a surface expanding rearward to the shield machine main body 2 side is the annular tapered surface 62*b*. A plurality of cutter bits 61 are provided on each of the front surface 62*a*, the annular tapered surface 62*b*, and the cylindrical outer peripheral surface 62*c*. As above, since the annular tapered surface 62*b* and the cylindrical outer peripheral surface 62*c* are formed on the rotary cutter head 60, and the cutter bits 61 are provided on these surfaces, the cutter bits 61 can efficiently excavate the natural ground while swinging in a direction intersecting with the central axis Ac of the shield machine main body 2. In addition, the annular tapered surface 62*b* reduces an excavating resistance acting on the rotary cutter head 60 at the time of swinging. The amount of rearward expansion of the annular tapered surface 62*b*, the axial length of the cylindrical outer peripheral surface 62*c*, and the like are set in accordance with, for example, the length of excavation in a below-described one cycle.

The pair of rotary cutter heads 60 are respectively supported by a pair of cutter attaching portions 51*a* provided at the frame main body 51 of the cutter supporting frame 50, and are supported to be rotatable around the third center axes A3, respectively. The rotary cutter head 60 is rotatably supported such that a rear end portion of the cutter frame 62 of the rotary cutter head 60 is internally fitted in the cutter attaching portion 51*a* from a front side. The center of the cutter frame 62 is the third center axis A3. Moreover, the pair of rotary cutter heads 60 is independently rotated by third rotating mechanisms 65 each configured to cause the rotary cutter head 60 to rotate with respect to the cutter supporting frame 50.

Further, a circular sealing member 63 is attached to between the cutter attaching portion 51*a* and the cutter frame 62. A ring gear 64 is fixedly provided at a rear end portion of the cutter frame 62. The ring gear 64 is configured to be rotatable by a bearing. Moreover, the cutter frame 62 is provided with a stirring blade 62*d* projecting rearward.

The third rotating mechanism 65 includes a plurality of (for example, a pair of) third hydraulic motors 66 which are respectively attached to the pair of cutter attaching portions 51*a* and correspond to third actuators. The plurality of third hydraulic motors 66 are provided in the cutter attaching portion 51*a* so as to face forward. An output gear of the third hydraulic motor 66 engages the ring gear 64 of the rotary cutter head 60.

Moreover, in the present embodiment, a hatch 52*a* is provided at a rear end portion of the tubular portion 52 located on a device inner side of the dividing wall 16. An operator can enter the inside of the cutter frame 62 from the hatch 52*a* through the cutter supporting frame 50. With this, the operator can attach and detach the cutter bit 61 in the inside of the cutter frame 62.

Further, the present embodiment does not require a complex configuration in which: a first rotating device is the first hydraulic motors 46 that are a plurality of first actuators provided on the shield machine main body 2; a swinging device is the second hydraulic motors 56 that are a plurality of second actuators provided on the rotary drum 40; a third rotating device is the third hydraulic motors 66 that are a plurality of third actuators provided in the cutter supporting frame 50; and by independently driving these motors to independently rotate the rotary drum 40, the cutter supporting frame 50, and the rotary cutter head 60, the rotary drum 40, the cutter supporting frame 50, and the rotary cutter head 60 link with each other. With this, the first and third rotating mechanisms 45 and 65 and the swinging drive mechanism 55 are simplified in configuration, and quick and easy control can be carried out. In addition, manufacturing costs of the rotary drum 40, the cutter supporting frame 50, and the rotary cutter head 60 can also be reduced. Electric motors may be used as the first and third hydraulic motors 46 and 66 that are the first and third actuators. Moreover, a hydraulic jack may be used as the second hydraulic motor 56.

Further, as shown in FIGS. 1 and 2, the rotary drum 40 is provided with a fourth center axis A4 parallel to the first center axis A1 and spaced apart from the first center axis A1 and the second center axis A2. A rotary auxiliary cutter head 70 is provided at the fourth center axis A4. The rotary auxiliary cutter head 70 is the same in configuration as the rotary cutter head 60, and includes a cutter frame 72 having a circular front surface 72*a*, an annular tapered surface 72*b* connected to an outer periphery of the front surface 72*a*, and a cylindrical outer peripheral surface 72*c* connected to a rear end of the annular tapered surface 72*b*. These surfaces form the excavating surface P. In the rotary auxiliary cutter head 70, a surface expanding rearward to the shield machine main body 2 side is the annular tapered surface 72*b*. A plurality of cutter bits 71 are provided on each of the front surface 72*a*, the annular tapered surface 72*b*, and the cylindrical outer peripheral surface 72*c*. As above, since the annular tapered surface 72*b* and the cylindrical outer peripheral surface 72*c* are formed on the rotary auxiliary cutter head 70, and the cutter bits 71 are provided on these surfaces, the cutter bits 71 can efficiently excavate the natural ground while swinging in a direction intersecting with the central axis of the shield machine main body 2. Again, in the rotary auxiliary cutter head 70, the amount of rearward expansion of the annular tapered surface 72*b*, the axial length of the cylindrical outer peripheral surface 72*c*, and the like are set in accordance with, for example, the length of excavation of the below-described one cycle.

The rotary auxiliary cutter head 70 is rotatably supported such that a rear end portion of the cutter frame 72 is internally fitted in, from the front side, a tubular cutter attaching portion 50*a* provided to project from the rotary drum 40 into the chamber 19. A circular sealing member 73 is attached to between the cutter attaching portion 50*a* and the cutter frame 72. A ring gear 74 is fixedly provided at a rear end portion of the cutter frame 72. The ring gear 74 is configured to be rotatable by a bearing. A fourth rotating mechanism 75 configured to cause the rotary auxiliary cutter head 70 to rotate includes a plurality of (for example, a pair of) fourth hydraulic motors 76 attached to the cutter attaching portion 50*a*. The plurality of fourth hydraulic motors 76 are provided in the cutter attaching portion 50*a* so as to face forward. An output gear of the fourth hydraulic motor 76 engages the ring gear 74. Moreover, in the present embodiment, the rotary auxiliary cutter head 70 is also configured such that the operator can enter the inside of the cutter frame 72 from the dividing wall 16 side through the inside of the cutter attaching portion 50*a*. Since the operator can enter the inside of the cutter frame 72, he or she can replace the cutter bit 71 in the inside of the cutter frame 72. The cutter frame 72 is also provided with a stirring blade 72*d* projecting rearward. Since the rotary auxiliary cutter head 70 is provided, an excavating ability of the shield machine 1 can be improved, and the shield machine 1 can excavate by the rotary auxiliary cutter head 70 an area where the rotary cutter head 60 cannot excavate.

Moreover, the rotary drum 40 is provided with a pair of fifth center axes A5. A pair of stirring blades 80 supported to be rotatable around the fifth center axes A5, respectively, is provided at the fifth center axes A5, respectively. The pair of stirring blades 80 is respectively rotated by fifth rotating mechanisms 85 corresponding to a pair of stirring blade rotating devices configured to cause the stirring blades 80 to rotate with respect to the rotary drum 40. The fifth rotating mechanism 85 includes a plurality of (for example, three) fifth hydraulic motors 86 attached to the rotary drum 40B behind the dividing wall 16.

As shown in FIGS. 1 and 2, in the present embodiment, the positions of the center axes are as below. The first center axis A1 coincides with (is in parallel with) the central axis Ac of the shield machine main body 2. The second center axis A2 is in parallel with the first center axis A1 and is spaced apart from the first center axis A1. The third center axis A3 is in parallel with the second center axis A2 and is spaced apart from the second center axis A2. The fourth center axis A4 is in parallel with the first center axis A1 and is spaced apart from the first and second center axes A1 and A2. The fifth center axis A5 is in parallel with the first center axis A1 and is spaced apart from the first, second, and fourth center axes A1, A2, and A4.

In the present embodiment, as one example, the second center axis A2 is spaced apart from the first center axis A1 by a distance that is about ¾ of the radius of the rotary drum 40. Moreover, the pair of third center axes A3 is located symmetrically about the second center axis A2, and each of the third center axes A3 is spaced apart from the second center axis A2 by a distance that is about ½ of the radius of the rotary drum 40. Further, the fourth center axis A4 and the second center axis A2 are located symmetrically about the first center axis A1, and the fourth center axis A4 is spaced apart from the first center axis A1 by a distance that is about ¾ of the radius of the rotary drum 40. Furthermore, the pair of fifth center axes A5 is respectively located at positions where the fourth center axis A4 is moved in both circumferential directions about the first center axis A1 by about 45 degrees. The positions of these axes are set in accordance with the excavated cross-sectional shape, the condition of the ground to be excavated, and the like.

Meanwhile, as shown in FIG. 1, a rotary joint 91 is provided at a center portion of the rotary drum 40. Driving oil is supplied through the rotary joint 91 to the third to fifth hydraulic motors 66, 76, and 86 of the third to fifth rotating mechanisms 65, 75, and 85. The cutter supporting frame 50 does not swing 180 degrees or more from a predetermined reference phase angle position with respect to the rotary drum 40. Therefore, the driving oil is supplied from the rotary joint 91 by a hydraulic hose. Moreover, a rotary joint may be provided at the second center axis A2 that is the center of swinging of the cutter supporting frame 50, and the driving oil may be supplied to the second hydraulic motor 56 through this rotary joint.

Further, a mud adding material supplying unit (not shown) is provided behind the shield machine main body 2. The mud adding material is supplied from the mud adding material supplying unit to the rotary joint 91. Each of the pair of rotary cutter heads 60 has a mud adding material inlet 60*a*, and the rotary auxiliary cutter head 70 also has a mud adding material inlet 70*a*. The mud adding material is supplied from the rotary joint 91 to the mud adding material inlets 60*a* and 70*a* through a mud adding material hose (not shown), and is then supplied to the excavating surface P. Moreover, each of the pair of stirring blades 80 also has a mud adding material inlet 80*a*. A rotary joint 92 is provided at a center portion of the stirring blade 80. The mud adding material is also supplied from the mud adding material supplying unit to the rotary joint 92. The mud adding material is supplied from the rotary joint 92 through the mud adding material inlet 80*a* to the inside of the chamber 19. The earth pressure at the time of excavation is maintained by the mud adding material supplied to the excavating surface P and the inside of the chamber 19. In addition, by the mud adding material, the cutter is prevented from abrading away, and the flowability of the excavated sand is maintained.

The excavated sand discharger 6, the pair of erector devices 7, the pair of segment supporting devices 8, and the back fill injecting device 9 are existing devices, so that detailed explanations thereof are omitted. Moreover, a center pillar Sa for supporting the segments S attached to the upper portion of the inner surface of the tunnel T is provided at a width-direction center portion of the tunnel T. The center pillar Sa is provided by one of the pair of erector devices 7.

Further, as shown in FIG. 5, the shield machine 1 is provided with a drive control unit 90 including a hydraulic circuit for driving the first, third, fourth, and fifth rotating mechanisms 45, 65, 75, and 85, and the swinging drive mechanism 55. The drive control unit 90 also includes a control panel 95 for operating the first, third, fourth, and fifth rotating mechanisms 45, 65, 75, and 85, and the swinging drive mechanism 55. These are provided behind the tunnel machine 1 shown in FIG. 1, and are not shown in FIG. 1. As shown in FIG. 5, in the present embodiment, the plurality of first hydraulic motors 46 that is the first rotating device of the first rotating mechanism 45 provided at the shield machine main body 2, the plurality of second hydraulic motors 56 that is the swinging device of the swinging drive mechanism 55 provided at the rotary drum 40, and the plurality of third hydraulic motors 66 that is the third rotating device of the third rotating mechanism 65 provided in the cutter supporting frame 50 are independently driven, and the rotary drum 40, the cutter supporting frame 50, and the rotary cutter head 60 are independently rotated by these motors. With this, quick and easy control can be carried out. Moreover, the fourth and fifth rotating mechanisms 75 and 85 in the present embodiment are configured to independently rotate the rotary auxiliary cutter head 70 and the stirring blades 80. respectively.

As shown in FIG. 2, in accordance with the excavator 5 configured as above, the rotary drum 40 is supported by the front end side portion of the shield machine main body 2 so as to be rotatable around the first center axis Al, the cutter supporting frame 50 is supported by the rotary drum 40 so as to be swingable around the second center axis A2, and the rotary cutter heads 60 are supported by the cutter supporting frame 50 so as to be rotatable around the third center axes A3, respectively.

Therefore, in a case where a distance between the first center axis A1 and the second center axis A2 is R, a distance between the second center axis A2 and the third center axis A3 is r, and a radius of excavation of the rotary cutter head 60 centered on the third center axis A3 is e, when viewed from the front, a movement trajectory of the second center axis A2 is the circumference of a circle which is centered on the first center axis A1 and has a radius R, and a movement trajectory of the third center axis A3 is the circumference of a circle which is centered on the second center axis A2 and has a radius r. On this account, an area where the rotary cutter head 60 can excavate is a circle which is centered on the first center axis A1 and has a radius that is a total of R, r, and e.

With this, the rotary drum 40, the rotary cutter head 60, and the cutter supporting frame 50 are independently driven by the first and third rotating mechanism 45 and 65, and the swinging drive mechanism 55, respectively, to control relative positions of the first and third rotating devices and the swinging drive mechanism 55. Thus, the rotary cutter heads 60 and 70 freely move within the above-described excavation area, so that the tunnels T of various cross-sectional shapes can be excavated. In addition, within an area where a distance from the first center axis A1 to the inner surface of the tunnel is the total of R, r, and e at maximum, the distances of movement of the rotary cutter heads 60 and 70 are freely changed, and thus, the various cross-sectional shapes can be excavated.

Moreover, at the time of excavation, the shield machine main body 2 including the body 10 moves ahead by the plurality of shield jacks 3. Then, the rotary cutter heads 60 and the rotary auxiliary cutter head 70 of the excavator 5 provided on the front end side portion of the shield machine main body 2 rotate while revolving together with the rotary drum 40. Thus, the rotary cutter heads 60 and the rotary auxiliary cutter head 70 can excavate the natural ground on the front end side of the shield machine main body 2, and form the tunnel T having the same cross section as the shield machine main body 2. At this time, the natural ground is efficiently excavated in a direction intersecting with an excavating direction by the cutter bits 61 provided on the annular tapered surface 62*b* and the cylindrical outer peripheral surface 62*c* of the cutter head 60 and the cutter bits 71 provided on the annular tapered surface 72*b* and the cylindrical outer peripheral surface 72*c* of the cutter head 70.

As above, in accordance with the shield machine 1, the natural ground on the front end side of the shield machine main body 2 is excavated by the excavator 5, and the shield machine main body 2 moves ahead by the plurality of shield jacks 3. At this time, in the excavator 5, the rotary drum 40 is rotated around the first center axis A1 by the first rotating mechanism 45, and the cutter supporting frame 50, the pair of rotary cutter heads 60, and the rotary auxiliary cutter head 70 also integrally rotate around the first center axis A1. In addition, the cutter supporting frame 50 swings around the second center axis A2 with respect to the rotary drum 40 by the swinging drive mechanism 55, and the pair of rotary cutter heads 60 also integrally rotate around the second center axis A2. Then, the pair of rotary cutter heads 60 rotate around the pair of third center axes A3, respectively, with respect to the cutter supporting frame 50 by the pair of third rotating mechanisms 65, respectively. Further, the rotary auxiliary cutter head 70 is rotated around the fourth center axis A4 with respect to the rotary drum 40 by the fourth rotating mechanism 75, and the pair of stirring blades 80 is rotated with respect to the rotary drum 40 by the pair of fifth rotating mechanisms 85.

Then, the excavated sand is recovered by the chamber 19, and is discharged rearward by the excavated sand discharger 6. Thus, the tunnel T having a predetermined cross-sectional shape is excavated, and a plurality of segments S is sequentially attached in a ring shape by the pair of erector devices 7. With the segments S supported by the pair of segment supporting devices 8, the center pillar Sa is attached by one of the erector devices 7.

As above, the tunnels of various cross-sectional shapes can be excavated by the pair of rotary cutter heads 60 configured to rotate around the pair of third center axes A3, respectively, provided at the cutter supporting frame 50, and the pair of third rotating mechanisms 65 configured to respectively cause the pair of rotary cutter heads 60 to rotate.

Hereinafter, a specific flow of excavation of the excavator 5 of the shield machine 1 will be explained based on FIGS. 6 to 21. FIG. 6 is a front view showing a state where a drum rotation angle of the excavator included in the shield machine shown in FIG. 1 is ±0 degrees. FIGS. 7 to 21 sequentially show a part of a front view showing a state where the excavator is rotated by a predetermined angle from the drum rotation angle of the excavator shown in FIG. 6.

As described above, the shield machine 1 excavates the tunnel T of a rectangular cross section having the same shape as the front surface of the shield machine main body 2 by independently driving the rotary drum 40, the rotary cutter head 60, the rotary auxiliary cutter head 70, the stirring blade 80, and the cutter supporting frame 50 by the first, third, fourth, and fifth rotating mechanisms 45, 65, 75, and 85, and the swinging drive mechanism 55 which are controlled by the drive control unit 90. However, the following will explain the control of the first rotating mechanism 45 and the swinging drive mechanism 55 and will not explain the third to fifth rotating mechanisms 85 which rotate at all times.

Moreover, in the present embodiment, a vertical direction and a crosswise direction when viewed from the front are used for convenience of explanation. Among the pair of rotary cutter heads 60, the rotary cutter head 60 located on a right side in FIG. 6 is referred to as a No. 1 cutter head 60, and the rotary cutter head 60 on a left side in FIG. 6 is referred to as a No. 2 cutter head 60. The rotary auxiliary cutter head 70 is referred to as a No. 3 cutter head 70.

Further, in the state of the excavator 5 shown in FIG. 6, a downwardly extending perpendicular line Ld centered on the first center axis A1 with respect to the shield machine main body 2 is located at a position where a drum rotation angle θ (rotation phase angle θ) of the rotary drum 40 is a reference phase angle that is ±0 degrees. When viewed from the front, a side located in a clockwise direction of the rotary drum 40 from the reference phase angle of the drum rotation angle θ is referred to as a + side. Moreover, an upwardly extending perpendicular line Lu centered on the first center axis A1 is located at a position where a frame swinging angle α (rotation phase angle α) of the cutter supporting frame 50 centered on the second center axis A2 with respect to the rotary drum 40 is the reference phase angle that is ±0 degrees. When viewed from the front, a side located in a clockwise direction of the cutter supporting frame 50 from the reference phase angle of the frame swinging angle α is referred to as a + side.

In the present embodiment, the shape of the shield machine main body 2, the shapes of the cutter heads 60 and 70, and initial positions of the axes A1 to A4 are predetermined. A part of the drum rotation angles θ and the frame swinging angles α which continuously change from their initial positions will be explained as examples. These angles are just examples, and are set to appropriate angles depending on different conditions.

FIG. 6 shows the state of a reference position. In this state, the second center axis A2 is located at an upper limit position, the cutter supporting frame 50 is horizontally positioned, vertical positions of the pair of third center axes A3 coincide with each other, and vertical positions of upper end portions of the No. 1 and No. 2 cutter heads 60 and an upper end portion of the shield machine main body 2 coincide with one another. Moreover, the fourth center axis A4 is located at a lower limit position, and vertical positions of a lower end portion of the No. 3 cutter head 70 and a lower end portion of the shield machine main body 2 coincide with each other.

Then, at the time of excavation, the rotary drum 40 is rotated by the first rotating mechanism 45 in a clockwise direction when viewed from the front, and the No. 1 and No. 2 cutter heads 60, the No. 3 cutter head 70, and the stirring blade 80 are rotated at all times by the third, fourth, and fifth rotating mechanism 65, 75, and 85 in a clockwise direction when viewed from the front. Moreover, the positions of excavation of the No. 1 and No. 2 cutter heads 60 are controlled to be changed by changing the frame swinging angle α of the cutter supporting frame 50 by the swinging drive mechanism 55 in a clockwise direction or in a counterclockwise direction which angle α is associated with the drum rotation angle θ of the rotary drum 40 from the reference phase angle in accordance with the cross-sectional shape of the tunnel T to be excavated. This control is continuous control. For example, by servo control of causing the centers of the No. 1 and No. 2 cutter heads 60 to continuously move at a uniform speed, the drum rotation angle θ and the frame swinging angle α are controlled to be changed smoothly and relatively.

One example of this control is as below. First, as shown in FIGS. 7 to 9, to cause the No. 1 cutter head 60 to excavate an about ¼ upper-right portion of the inner surface of a peripheral portion of the tunnel T from the state of FIG. 6, the rotary drum 40 is rotated such that the drum rotation angle θ changes from 0 degrees through 30 degrees and 60 degrees to 74 degrees, and during this time, the cutter supporting frame 50 swings such that the frame swinging angle α changes from ±0 degrees through −36 degrees and −74 degrees to −53 degrees.

Thus, the No. 1 cutter head 60 is moved from the state of FIG. 6 and located at a vertically central portion on a right side surface of the tunnel T in the state of FIG. 9.

Next, as shown in FIGS. 9 to 11, to cause the No. 2 cutter head 60 to move to the right after the No. 1 cutter head 60 is located at the vertically central portion on the right side surface of the tunnel T, the rotary drum 40 is rotated such that the drum rotation angle θ changes from 74 degrees through 90 degrees to 106 degrees, and during this time, the cutter supporting frame 50 swings such that the frame swinging angle α changes from −53 degrees through ±0 degrees to +53 degrees.

Next, as shown in FIGS. 11 to 14, to cause the No. 2 cutter head 60 to excavate an about ¼ lower-right portion of the inner surface of the peripheral portion of the tunnel T, the rotary drum 40 is rotated such that the drum rotation angle θ changes from 106 degrees through 120 degrees and 150 degrees to 180 degrees, and during this time, the cutter supporting frame 50 swings such that the frame swinging angle α changes from +53 degrees through +74 degrees and +36 degrees to ±0 degrees. In the state of FIG. 14, the second center axis A2 is located at the lower limit position, the cutter supporting frame 50 is horizontally positioned, and the vertical positions of the pair of third center axes A3 coincide with each other. In addition, the vertical positions of the lower end portions of the No. 1 and No. 2 cutter heads 60 and the lower end portion of the shield machine main body 2 coincide with one another. In addition, the fourth center axis A4 is located at the upper limit position, and the vertical positions of the upper end portion of the No. 3 cutter head 70 and the upper end portion of the shield machine main body 2 coincide with each other.

Next, as shown in FIGS. 14 to 17, to cause the No. 1 cutter head 60 to excavate an about ¼ lower-left portion of the inner surface of the peripheral portion of the tunnel T, the rotary drum 40 is rotated such that the drum rotation angle θ changes from 180 degrees through 210 degrees and 240 degrees to 254 degrees, and during this time, the cutter supporting frame 50 swings such that the frame swinging angle α changes from ±0 degrees through −36 degrees and −74 degrees to 31 53 degrees. In the state of FIG. 17, the No. 1 cutter head 60 is located at the vertically central portion on a left side surface of the tunnel T.

Next, as shown in FIGS. 17 to 19, to cause the No. 2 cutter head 60 to be located at the vertically central portion on the left side surface of the tunnel T, the rotary drum 40 is rotated such that the drum rotation angle θ changes from 254 degrees through 270 degrees to 286 degrees, and during this time, the cutter supporting frame 50 swings such that the frame swinging angle α changes from −53 degrees through ±0 degrees to +53 degrees.

Next, as shown in FIGS. 19 to 21, and FIG. 6, to cause the No. 2 cutter head 60 to excavate an about ¼ upper-left portion of the inner surface of the peripheral portion of the tunnel T, the rotary drum 40 is rotated such that the drum rotation angle θ changes from 286 degrees through 300 degrees and 330 degrees to 360 degrees (0 degrees), and during this time, the cutter supporting frame 50 swings such that the frame swinging angle α changes from +53 degrees through +74 degrees and +36 degrees to ±0 degrees. Then, the shield machine 1 returns to the state of FIG. 6.

As above, the rotation of the rotary drum 40 is controlled by the first rotating mechanism 45, and the swinging of the cutter supporting frame 50 is controlled by the swinging drive mechanism 55. Thus, an excavating cross section changes from FIG. 6 to FIG. 21 and returns to the state of FIG. 6, and such control is continuously carried out.

FIG. 22 is a diagram showing an area where the No. 1 cutter head included in the shield machine shown in FIG. 1 excavates. FIG. 23 is a diagram showing an area where the No. 2 cutter head included in the shield machine shown in FIG. 1 excavates. FIG. 24 is a diagram showing an area where the No. 3 cutter head included in the shield machine shown in FIG. 1 excavates. FIG. 25 is a diagram showing an area where the No. 1 to No. 3 cutter heads included in the shield machine shown in FIG. 1 excavate. Each of these drawings shows a part of the excavating cross section.

As described above, in a case where the first hydraulic motor 46 and the second hydraulic motor 56 are controlled to cause the rotary drum 40 to rotate by 360 degrees while causing the cutter supporting frame 50 to swing, the area where the No. 1 cutter head 60 excavates is an area shown by diagonal lines in FIG. 22. The area where the No. 2 cutter head 60 excavates is an area shown by diagonal lines in FIG. 23. The area where the No. 3 cutter head 70 excavates is an area shown by diagonal lines in FIG. 24. The total of these areas is an area shown by diagonal lines in FIG. 25 obtained by overlapping FIGS. 22 to 24, and the entire area of the shield machine main body 2 is the area to be excavated. As above, the No. 1 and No. 2 cutter heads 60 and the No. 3 cutter head 70 can excavate the natural ground in front of the shield machine main body 2 while causing the rotary drum 40 to rotate and the cutter supporting frame 50 to swing.

Moreover, as described above, the excavation by the cutter heads 60 and 70 of the excavator 5 is carried out simultaneously with the forward movement of the shield machine main body 2 by the shield jacks 3. While the rotary drum 40 rotates once, i.e., the state of the rotary drum 40 changes from FIG. 6 through FIG. 21 back to FIG. 6, the cutter supporting frame 50 swings at a predetermined angle, the No. 1 and No. 2 cutter heads 60 excavate, and the No. 3 cutter head 70 excavates. Thus, the natural ground in front of the entire front surface of the shield machine main body 2 is excavated, and the forward movement of a predetermined distance is carried out.

The relation between the excavation by the cutter heads 60 and 70 and the forward movement by the shield jacks 3 is as below. Considering that one cycle is a cycle from FIG. 6 through FIG. 21 back to FIG. 6, plural cycles are carried out by the cutter heads 60 and 70 while the forward movement corresponding to one segment is carried out by the shield jacks 3. To be specific, spiral excavation is carried out in the excavating direction. As a specific example, in a case where the distance of the forward movement in one minute is 2 cm, and one cycle requires four minutes, the forward movement of 8 cm (2 cm×4=8 cm) can be carried out in one cycle. Then, in a case where the length of one segment is 80 cm, the forward movement of one segment can be carried out by 10 cycles (80 cm/8 cm=10). In this case, the forward movement of one segment requires 40 minutes (4 minutes×10=40 minutes). As the excavation trajectory at the time of this forward movement, the spiral excavation of 10 cycles is carried out. This is just one example, and these conditions are set in accordance with the condition of the ground, the excavated cross-sectional shape, and the like.

As explained above, in accordance with the shield machine 1, in the case of excavating the tunnel having a predetermined cross-sectional shape (for example, the tunnel T having a rectangular cross section), the first rotating mechanism 45 and the swinging drive mechanism 55 are driven such that the swinging angle (frame swinging angle α) of the cutter supporting frame 50 is controlled to be associated with the rotation phase angle (drum rotation angle θ) of the rotary drum 40 from the reference phase angle in accordance with the cross-sectional shape. Thus, the shield machine 1 can excavate tunnels of various cross-sectional shapes.

Moreover, even in a case where the outbreak of the natural ground needs to be carried out to slightly expand the tunnel, such as a case where a curved portion of the tunnel is excavated, the outbreak can be easily carried out by the rotary cutter head 60 by adjusting the swinging angle of the cutter supporting frame 50 to change the amount of projection of the rotary cutter head 60. Therefore, a copy cutter is not especially required.

In addition, the cross-sectional shape of the tunnel to be excavated can be easily changed by changing the control of the first rotating mechanism 45 and the swinging drive mechanism 55 without changing the mechanical structure. Therefore, the versatility is extremely high. For example, the excavator 5 which includes a large number of machine parts and requires manufacturing time and cost can be applied to a shield machine main body having a different excavating cross-sectional shape. In this case, the excavation can be carried out only by changing the control without changing the mechanical structure. Moreover, in a case where the shield machine main body 2 is configured to be able to change the tunnel cross-sectional shape, for example a master-slave shield machine capable of changing from a large diameter to a small diameter in the middle of excavation under the ground, the cross-sectional shape of the tunnel can be changed in the middle of excavation by one excavator 5.

Embodiment 2

FIG. 26 is a longitudinal sectional view of the shield machine according to Embodiment 2 of the present invention. FIG. 27 is a front view of the shield machine shown in FIG. 26. A left half of FIG. 28 is a cross-sectional view taken along line IIa-IIa of FIG. 26, and a right half of FIG. 28 is a cross-sectional view taken along line IIb-IIb of FIG. 26. In the present embodiment, the shape of the excavated cross section and the configuration of the excavator 5 are different from those in Embodiment 1, and components (FIG. 28), such as the shield jack 3, the bending jack 4, and the erector device 7, provided inside the shield machine main body 2 are the same as those in Embodiment 1. Therefore, the same reference numbers are used for the same components, and detailed explanations thereof are omitted. Note that a letter "B" is added to each of the reference numbers of the corresponding components. Moreover, the configuration of a rotary cutter head 60B provided in an excavator 5B will be mainly explained, and detailed explanations of components, such as the stirring blade 80 and the mud adding material inlet 29, are omitted.

As shown in FIG. 27, the present embodiment shows an example of excavating a tunnel in which the excavated cross section has a vertically-long rectangular shape and a curve radius of the corner portion of the rectangular shape is small. As shown in FIGS. 26 and 27, in the present embodiment, a central axis of a shield machine main body 2B is the first center axis A1, and a rotary drum 40B corresponding to the first rotating member supported to be rotatable around the first center axis A1 is provided. The rotary drum 40B is rotated by the first rotating mechanism 45.

The rotary drum 40B is provided with a cutter supporting frame 50B corresponding to the swinging member supported to be rotatable around the second center axis A2 spaced apart from the first center axis A1. The cutter supporting frame 50B in the present embodiment is rotatably supported by the rotary drum 40B via a ring-shape bearing 54B. The cutter supporting frame 50B swings by the swinging drive mechanism 55 which causes the cutter supporting frame 50B to swing with respect to the rotary drum 40B. As shown in FIGS. 26 and 28, the swinging drive mechanism 55 in the present embodiment includes a plurality of (for example, two) hydraulic jacks 56B which are attached to the rotary drum 40B and correspond to the second actuators. One end of the hydraulic jack 56B is rotatably supported by the rotary drum 40, and the other end thereof is rotatably supported by an arm 52*b* provided on a device inner side of the tubular portion 52. By extending and retracting the hydraulic jack 56B, the arm 52*b* swings to cause the cutter supporting frame 50B to swing with respect to the rotary drum 40B.

As shown in FIGS. 26 and 27, the cutter supporting frame 50B is provided with the third center axis A3 spaced apart from the second center axis A2, and the rotary cutter head 60B is provided at the third center axis A3. The rotary cutter head 60B is formed to have a diameter capable of excavating the corner portion whose curve radius is small. Moreover, the rotary cutter head 60B is supported to be rotatable around the third center axis A3, and a plurality of cutter bits 61 are provided on a surface of the rotary cutter head 60B.

In the present embodiment, to allow the sand excavated by the cutter bits 61 to be discharged to an outer peripheral side, the cutter bits 61 are spirally provided from the center portion to the outer periphery in accordance with the rotational direction of the rotary cutter head 60B. In this example, the cutter bits 61 are spirally provided in a direction opposite the rotational direction of the rotary auxiliary cutter head 60B. The rotary cutter head 60B is rotated by the third rotating mechanism 65 configured to cause the rotary cutter head 60B to rotate with respect to the cutter supporting frame 50B. The third rotating mechanism 65 in the present embodiment includes the third hydraulic motor 66 corresponding to one third actuator. Moreover, an excavating surface PB of the rotary cutter head 60B is formed as a curved surface whose outer peripheral side curves rearward to the shield machine main body 2B side. By forming such an excavating surface PB, the cutter bits 61 on the excavating surface PB can efficiently excavate the natural ground while swinging in a direction intersecting with the central axis Ac of the shield machine main body 2B.

Further, the rotary drum 40B is provided with the fourth center axis A4 spaced apart from the first center axis A1 and the second center axis A2, and a rotary auxiliary cutter head 70B is provided at the fourth center axis A4. The rotary auxiliary cutter head 70B is supported to be rotatable around the fourth center axis A4, and a plurality of cutter bits 71 are provided on a surface of the rotary auxiliary cutter head 70B. Again, to allow the sand excavated by the cutter bits 71 to be discharged to the outer peripheral side, the cutter bits 71 are spirally provided from the center portion to the outer periphery in accordance with the rotational direction of the rotary auxiliary cutter head 70B. In this example, the cutter bits 71 are spirally provided in a direction opposite the rotational direction of the rotary auxiliary cutter head 70B. The excavating surface PB of the rotary auxiliary cutter head 70B is also formed as a curved surface whose outer peripheral side curves rearward to the shield machine main body 2B side. By forming such an excavating surface PB, the cutter bits 61 on the excavating surface PB can efficiently excavate the natural ground while swinging in a direction intersecting with the central axis Ac of the shield machine main body 2B. Moreover, since the excavating surface PB is formed as the curved surface and is provided with the cutter bits 61, the cutter bits 61 can efficiently excavate while swinging, and the excavating resistance can be reduced by the curved surface PB.

The rotary auxiliary cutter head 70B is rotated by the fourth rotating mechanism 75 configured to cause the rotary auxiliary cutter head 70B to rotate with respect to the rotary drum 40B. The rotary auxiliary cutter head 70B is formed to have a diameter capable of excavating the natural ground in front of the central axis Ac of the shield machine main body 2 and excavating an area which slightly overlaps an area where the rotary cutter head 60B excavates at the corner portion of the shield machine main body 2B. The fourth center axis A4 of the rotary auxiliary cutter head 70B and the third center axis A3 of the rotary cutter head 60B are respectively located at positions opposed to each other so as to sandwich the first center axis A1 that is the center of the rotary drum 40B. As described above, since the components, such as the stirring blade 80 and the earth pressure gauge, provided at the rotary drum 40B are the same as those of Embodiment 1, detailed explanations thereof are omitted.

Hereinafter, a specific flow of excavation by a shield machine 1B of Embodiment 2 configured as above will be explained. FIG. 29 is a front view showing a state where the drum rotation angle of the excavator included in the shield machine shown in FIG. 26 is ±0 degrees. FIGS. 30 to 32 sequentially show a part of a front view showing a state where the excavator is rotated by a predetermined angle from the drum rotation angle of the excavator shown in FIG. 29.

In the present embodiment, a vertical direction and a crosswise direction when viewed from the front are used for convenience of explanation. The rotary cutter head 60B is referred to as a No. 1 cutter head 60B, and the rotary auxiliary cutter head 70B is referred to as a No. 3 cutter head 70B. Moreover, in the state of the excavator 5B shown in FIG. 29, an upwardly extending perpendicular line Lu centered on the first center axis A1 with respect to the shield machine main body 2B is located at a position where the drum rotation angle θ (rotation phase angle θ) of the rotary drum 40 is the reference phase angle that is ±0 degrees. When viewed from the front, a side located in a clockwise direction of the rotary drum 40B from the reference phase angle of the drum rotation angle θ is referred to as a + side. Moreover, the perpendicular line Lu is located at a position where the frame swinging angle α (rotation phase angle α) of the cutter supporting frame 50B centered on the second center axis A2 with respect to the rotary drum 40B is the reference phase angle that is ±0 degrees. When viewed from the front, a side located in a clockwise direction of the cutter supporting frame 50B from the reference phase angle of the frame swinging angle α is referred to as a + side.

Again, in the following explanation, the shape of the shield machine main body 2B, the shapes of the cutter heads 60B and 70B, and the initial positions of the axes A1 to A4 are predetermined. A part of the drum rotation angles θ and the frame swinging angles α which continuously change from their initial positions will be explained as examples. These angles are just examples, and are set to appropriate angles depending on different conditions.

FIG. 29 shows the state of the reference position. In this state, the second center axis A2 is located at the upper limit position, the drum rotation angle θ of the rotary drum 40B is 0 degrees, the frame swinging angle α of the cutter supporting frame 50B is +59 degrees, and the No. 1 cutter head 60B of the third center axis A3 is located at an upper-right corner portion of the shield machine main body 2. Moreover, the fourth center axis A4 is located at the lower limit position, and the No. 3 cutter head 70B is located just under the first center axis A1.

Then, at the time of excavation, the rotary drum 40 is rotated by the first rotating mechanism 45 in a counterclockwise direction when viewed from the front, and the No. 1 cutter head 60B and the No. 3 cutter head 70B are rotated at all times by the third and fourth rotating mechanisms 65 and 75 in a counterclockwise direction when viewed from the front. Moreover, the position of excavation of the No. 1 cutter head 60B is controlled to be changed by changing the frame swinging angle α of the cutter supporting frame 50B by the swinging drive mechanism 55 in a clockwise direction or in a counterclockwise direction which angle α is associated with the drum rotation angle θ of the rotary drum 40B from the reference phase angle in accordance with the cross-sectional shape of a tunnel TB to be excavated. This control is a continuous control, and the drum rotation angle θ and the frame swinging angle α are controlled to be changed smoothly and relatively.

As shown in FIGS. 30 to 32, to cause the No. 1 cutter head 60B in the state of FIG. 29 to excavate along the upper end of the tunnel TB in the horizontal direction from the upper-right corner portion of the tunnel TB to the left side, the rotary drum 40B is rotated such that the drum rotation angle θ changes from 0 degrees through −75 degrees and −81 degrees to −181 degrees, and during this time, the cutter supporting frame 50B swings such that the frame swinging angle α changes from +59 degrees through +103 degrees and +59 degrees to +121 degrees. In the state of FIG. 31, the No. 1 cutter head 60B is located at an upper-left corner portion of the tunnel TB. In the state of FIG. 32, the No. 1 cutter head 60B is located on a horizontally left side of the center of the tunnel TB.

After that, as with Embodiment 1 described above, by controlling the drum rotation angle θ of the rotary drum 40B and the frame swinging angle α of the cutter supporting frame 50B, the No. 1 cutter head 60B moves along the outer periphery of the shield machine main body 2B to excavate the periphery of the tunnel, and the No. 3 cutter head 70B excavates the natural ground in front of the center portion of the shield machine main body 2B which ground cannot be excavated by the No. 1 cutter head 60B.

FIG. 33 is a diagram showing an area where the No. 1 cutter head 60B included in the shield machine shown in FIG. 26 excavates. FIG. 34 is a diagram showing an area where the No. 1 and No. 3 cutter heads 60B and 70B included in the shield machine shown in FIG. 26 excavate. Each of these drawings shows a part of the excavating cross section.

As described above, in a case where the first hydraulic motor 46 and the second hydraulic motor 56 are controlled to cause the rotary drum 40B to rotate by 360 degrees while causing the cutter supporting frame 50B to swing, the area where the No. 1 cutter head 60B excavates is an area shown by diagonal lines in FIG. 33. Moreover, an area obtained by overlapping the area where the No. 1 cutter head 60B excavates and the area where the No. 3 cutter head 70B excavates is an area shown by diagonal lines in FIG. 34. Thus, the entire area of the shield machine main body 2 is the area to be excavated.

As above, the No. 1 cutter head 60B and the No. 3 cutter head 70B can excavate the natural ground in front of the shield machine main body 2B while causing the rotary drum 40B to rotate and the cutter supporting frame 50B to swing. In addition, the outbreak of the natural ground can be easily carried out by adjusting the swinging angle of the cutter supporting frame 50B to change the amount of projection of the rotary cutter head 60B.

Again, the excavation by the cutter heads 60B and 70B of the excavator 5B is carried out simultaneously with the forward movement of the shield machine main body 2B by the shield jacks 3. The natural ground in front of the front surface of the shield machine main body 2B is excavated by the No. 1 cutter head 60B and the No. 3 cutter head 70B, and at the same time, the forward movement of a predetermined distance is carried out by the shield jack 3. The relation between the excavation by the cutter heads 60B and 70B and the forward movement by the shield jacks 3 is the same as that in Embodiment 1, so that a detailed explanation thereof is omitted.

As explained above, in accordance with the shield machine 1B, in the case of excavating the tunnel TB having a predetermined cross-sectional shape, the first rotating mechanism 45 and the swinging drive mechanism 55 are driven such that the swinging angle (frame swinging angle $\alpha$) of the cutter supporting frame 50B is controlled to be associated with the rotation phase angle (drum rotation angle $\theta$) of the rotary drum 40B from the reference phase angle in accordance with the cross-sectional shape. Thus, the shield machine 1B can excavate tunnels of various cross-sectional shapes.

In addition, the cross-sectional shape of the tunnel to be excavated can be easily changed by changing the control of the first rotating mechanism 45 and the swinging drive mechanism 55 without changing the mechanical structure. Therefore, the versatility is extremely high.

Embodiment 3

FIG. 35 is a longitudinal sectional view of the shield machine according to Embodiment 3 of the present invention. FIG. 36 is a front view of the shield machine shown in FIG. 35. A left half of FIG. 37 is a cross-sectional view taken along line IIIa-IIIa of FIG. 35, and a right half of FIG. 37 is a cross-sectional view taken along IIIb-IIIb of FIG. 35. Again, in the present embodiment, the shape of the excavated cross section and the configuration of the excavator 5 are different from those in Embodiment 1, and components (FIG. 37), such as the shield jack 3, the bending jack 4, and the erector device 7, provided inside the shield machine main body 2 are the same as those in Embodiment 1. Therefore, the same reference numbers are used for the same components, and detailed explanations thereof are omitted. Note that a letter "C" is added to each of the reference numbers of the corresponding components. Moreover, the configuration of a rotary cutter head 60C provided in an excavator 5C will be mainly explained, and detailed explanations of components, such as the stirring blade 80, are omitted. The present embodiment shows an example suitable for a case where the excavated sand needs to be quickly recovered in the chamber behind the cutter head, for example a case where clay-rich soil is excavated.

As shown in FIG. 36, the present embodiment shows an example of excavating a rectangular tunnel having an excavated cross section whose vertical and horizontal lengths are substantially the same as each other. As shown in FIGS. 35 and 36, in the present embodiment, a central axis of a shield machine main body 2C is the first center axis A1, and a rotary drum 40C corresponding to the first rotating member supported to be rotatable around the first center axis A1 is provided. The rotary drum 40C is rotated by the first rotating mechanism 45.

The rotary drum 40C is provided with a cutter supporting frame 50C corresponding to the swinging member supported to be rotatable around the second center axis A2 spaced apart from the first center axis A1. The cutter supporting frame 50C in the present embodiment is rotatably supported by the rotary drum 40C via a ring-shape bearing 54C. The cutter supporting frame 50C swings by the swinging drive mechanism 55 which causes the cutter supporting frame 50C to swing with respect to the rotary drum 40C. As shown in FIGS. 35 and 37, the swinging drive mechanism 55 in the present embodiment includes a plurality of (for example, two) hydraulic jacks 56C which are attached to the rotary drum 40C and correspond to the second actuators. One end of the hydraulic jack 56C is rotatably supported by the rotary drum 40C, and the other end thereof is rotatably supported by the arm 52*b* provided on a device inner side of the tubular portion 52. By extending and retracting the hydraulic jack 56C, the arm 52*b* swings to cause the cutter supporting frame 50C to swing with respect to the rotary drum 40C.

As shown in FIG. 36, the cutter supporting frame 50C is provided with the third center axis A3, and the rotary cutter head 60C is provided at the third center axis A3. The rotary cutter head 60C is formed to have such a diameter that the area where the rotary cutter head 60C excavates includes the central axis Ac when the rotary cutter head 60C is located at upper, lower, right, and left positions of the shield machine main body 2C. The rotary cutter head 60C is supported to be rotatable around the third center axis A3, and a plurality of cutter bits 61 are provided on a surface of the rotary cutter head 60C.

Then, the rotary cutter head 60C of the present embodiment includes: the small circular front surface 62*a* at the center thereof; eight spokes 62*e* radially extending from the front surface 62*a*; and a plurality of cutter bits 61 provided on an excavating surface PC (front surface) of each spoke 62*e*. As above, the rotary cutter head 60C is configured such that the excavating surface PC is formed by causing the spokes 62*e* having the cutter bits 61 to rotate.

Thus, portions between the spokes 62*e* and outside the spokes 62*e* can be open at positions of outer end portions of the spokes 62*e*. With this, the sand excavated by the cutter bits 61 can be quickly discharged from between the spokes 62*e* to behind the rotary cutter head 60C to be recovered in the chamber 19. Moreover, the mud adding material inlet 29 is provided at a position which is located in a direction opposite the rotational direction of the spokes 62*e* and located in a direction intersecting with an axial direction of the excavator main body 2C. The flowability of the excavated sand is maintained by supplying the mud adding material from the mud adding material inlet 29. Therefore, the excavated sand can be quickly recovered in the chamber 19, and can be prevented from remaining on the excavating surface PC of the rotary cutter head 60C. On this account, even in the case of excavating the soil, such as the clay-rich soil, stable excavating ability can be maintained. Moreover, the excavating surface PC of the rotary cutter head 60C is formed as a curved surface whose outer peripheral side curves rearward to the shield machine main body 2C side. By forming such an excavating surface PC, the cutter bits 61 on the excavating surface PC can efficiently excavate the natural ground while swinging in a direction intersecting with the central axis Ac of the shield machine main body 2C. Further, since the excavating surface PC is formed as the curved surface and is provided with the cutter bits 61, the cutter bits 61 can efficiently excavate while swinging, and the excavating resistance can be reduced by the curved surface PC.

The rotary cutter head 60C is rotated by the third rotating mechanism 65 which causes the rotary cutter head 60C to rotate with respect to the cutter supporting frame 50C. The third rotating mechanism 65 in the present embodiment includes a plurality of third hydraulic motors 66 corresponding to the third actuators. As described above, since the components, such as the stirring blade 80 and the earth pressure gauge, provided at the rotary drum 40C are the same as those in Embodiment 1, detailed explanations thereof are omitted.

Hereinafter, a specific flow of excavation by a shield machine 1C of Embodiment 3 configured as above will be explained. FIG. 38 is a front view showing a state where the drum rotation angle of the excavator included in the shield machine shown in FIG. 35 is ±0 degrees. FIGS. 39 and 40 sequentially show a part of a front view showing a state where the excavator is rotated by a predetermined angle from the drum rotation angle of the excavator shown in FIG. 38.

In the present embodiment, a vertical direction and a crosswise direction when viewed from the front are used for convenience of explanation. The rotary cutter head 60C is referred to as a No. 1 cutter head 60C. Moreover, in the state of the excavator 5C shown in FIG. 38, a downwardly extending perpendicular line Ld centered on the first center axis A1 with respect to the shield machine main body 2C is located at a position where the drum rotation angle θ (rotation phase angle θ) of the rotary drum 40C is the reference phase angle that is ±0 degrees. When viewed from the front, a side located in a clockwise direction of the rotary drum 40C from the reference phase angle of the drum rotation angle θ is referred to as a + side. Moreover, the perpendicular line Ld is located at a position where a frame swinging angle α (rotation phase angle α) of the cutter supporting frame 50C centered on the second center axis A2 with respect to the rotary drum 40C is the reference phase angle that is ±0 degrees. When viewed from the front, a side located in a clockwise direction of the cutter supporting frame 50C from the reference phase angle of the frame swinging angle α is referred to as a + side.

Again, in the following explanation, the shape of the shield machine main body 2C, the shape of the cutter head 60C, and the initial positions of the axes A1 to A3 are predetermined. A part of the drum rotation angles θ and the frame swinging angles α which continuously change from their initial positions will be explained as examples. These angles are just examples, and are set to appropriate angles depending on different conditions.

FIG. 38 shows the state of the reference position. In this state, the second center axis A2 is located at the lower limit position. The drum rotation angle θ of the rotary drum 40C is 0 degrees, and the frame swinging angle α of the cutter supporting frame 50C is −120 degrees. The No. 1 cutter head 60C of the third center axis A3 is located on a horizontally right side of the central axis Ac of the shield machine main body 2.

Then, at the time of excavation, the rotary drum 40C is rotated by the first rotating mechanism 45 in a counterclockwise direction when viewed from the front, and the No. 1 cutter head 60C is rotated at all times by the third rotating mechanism 65 in a counterclockwise direction when viewed from the front. Moreover, the position of excavation of the No. 1 cutter head 60C is controlled to be changed by changing the frame swinging angle α of the cutter supporting frame 50C by the swinging drive mechanism 55 in a clockwise direction or in a counterclockwise direction which angle α is associated with the drum rotation angle θ of the rotary drum 40C from the reference phase angle in accordance with the cross-sectional shape of a tunnel TC to be excavated. This control is continuous control, and the drum rotation angle θ and the frame swinging angle α are controlled to be changed smoothly and relatively.

As shown in FIGS. 39 and 40, to cause the No. 1 cutter head 60C to move from a right side portion of the tunnel TC in the state of FIG. 38 to an upper-right corner portion of the tunnel TC and further move to the left side in the horizontal direction along the upper end, the rotary drum 40C is rotated such that the drum rotation angle θ changes from ±0 degrees through −88 degrees to −105 degrees, and during this time, the cutter supporting frame 50C swings such that the frame swinging angle α changes from −120 degrees through −66 degrees to −104 degrees. In the state of FIG. 40, the No. 1 cutter head 60C is located at an upper-center end portion of the tunnel TC.

After that, as with Embodiment 1 described above, by controlling the drum rotation angle θ of the rotary drum 40C and the frame swinging angle α of the cutter supporting frame 50C, the No. 1 cutter head 60C moves along the outer periphery of the shield machine main body 2C to excavate the natural ground.

FIG. 41 is a diagram showing an area where the No. 1 cutter head included in the shield machine shown in FIG. 36 excavates. This drawing shows a part of the excavated cross section. As described above, in a case where the first hydraulic motor 46 and the second hydraulic motor 56 are controlled to cause the rotary drum 40C to rotate by 360 degrees while causing the cutter supporting frame 50C to swing, the area where the No. 1 cutter head 60C excavates is an area shown by diagonal lines in FIG. 41. Thus, the natural ground in front of the front surface of the shield machine main body 2 can be excavated. In addition, the outbreak of the natural ground can be easily carried out by adjusting the swinging angle of the cutter supporting frame 50C to change the amount of projection of the rotary cutter head 60C.

Again, the excavation by the cutter head 60C of the excavator 5C is carried out simultaneously with the forward movement of the shield machine main body 2C by the shield jacks 3. The natural ground in front of the front surface of the shield machine main body 2C is excavated by the No. 1 cutter head 60C, and at the same time, the forward movement of a predetermined distance is carried out by the shield jacks 3. The relation between the excavation by the cutter head 60C and the forward movement by the shield jacks 3 is the same as that in Embodiment 1, so that a detailed explanation thereof is omitted.

As explained above, in accordance with the shield machine 1C, in the case of excavating the tunnel TC having a predetermined cross-sectional shape, the first rotating mechanism 45 and the swinging drive mechanism 55 are driven such that the swinging angle (frame swinging angle α) of the cutter supporting frame 50C is controlled to be associated with the rotation phase angle (drum rotation angle θ) of the rotary drum 40C from the reference phase angle in accordance with the cross-sectional shape. Thus, the shield machine 1C can excavate tunnels of various cross-sectional shapes.

In addition, in the present embodiment, the sand excavated by the rotary cutter head 60C can be quickly recovered in the chamber 19 from between the spokes 62*e*. Therefore, the natural ground, such as the clay-rich soil, can be stably excavated.

In addition, the cross-sectional shape of the tunnel to be excavated can be easily changed by changing the control of the first rotating mechanism 45 and the swinging drive mechanism 55 without changing the mechanical structure. Therefore, the versatility is extremely high.

Embodiment 4

FIG. 42 is a longitudinal sectional view of the shield machine according to Embodiment 4 of the present invention. FIG. 43 is a front view of the shield machine shown in FIG. 42. A left half of FIG. 44 is a cross-sectional view taken along line IVa-IVa of FIG. 42, and a right half of FIG. 44 is a cross-sectional view taken along line IVb-IVb of FIG. 42. Again, in the present embodiment, the shape of the excavated cross section and the configuration of the excavator 5 are different from those in Embodiment 1, and components (FIG. 44), such as the shield jack 3, the bending jack 4, and the erector device 7, provided inside the shield machine main body 2 are the same as those in Embodiment 1. Therefore, the same reference numbers are used for the same components, and detailed explanations thereof are omitted. Note that a letter "D" is added to each of the reference numbers of the corresponding components. Moreover, the configuration of a rotary cutter head 60D provided in an excavator 5D will be mainly explained, and detailed explanations of components, such as the stirring blade 80, are omitted.

Further, again, the present embodiment shows an example suitable for a case where the excavated sand needs to be quickly recovered in the chamber behind the cutter head, for example a case where the clay-rich soil is excavated. In the present embodiment, when viewed from the front of FIG. 42, the rotary cutter head 60D provided on a right side is referred to as a No. 1 cutter head 60D, and the rotary cutter head 60D provided on a left side is referred to as a No. 2 cutter head 60D. Moreover, a rotary drum 40D provided on a right side is referred to as a No. 1 rotary drum 40D, and a rotary drum 40D provided on a left side is referred to as a No. 2 rotary drum 40D.

As shown in FIG. 43, the present embodiment shows an example of excavating a double tunnel having an excavated cross section in which two substantially circular cross sections are coupled to each other in a horizontal direction. These two cross sections are formed to be bilaterally symmetrical about the central axis Ac of a shield machine main body 2D. As shown in FIGS. 42 and 43, in the present embodiment, the first center axes A1 are provided at left and right positions, respectively, spaced apart from the central axis Ac of the shield machine main body 2D by a predetermined distance, and the rotary drums 40D each corresponding to the first rotating member supported to be rotatable around the first center axis A1 are provided. These rotary drums 40D are independently rotated by the first rotating mechanisms 45, respectively.

At each of the rotary drums 40D, a cutter supporting frame 50D corresponding to the swinging member supported to be rotatable around the second center axis A2 spaced apart from the first center axis A1 is provided. The cutter supporting frame 50D swings by the swinging drive mechanism 55 which causes the cutter supporting frame 50D to swing with respect to the rotary drum 40D. The swinging drive mechanism 55 of the present embodiment includes a plurality of hydraulic jacks 56B which are attached to the rotary drums 40D and correspond to the second actuators. Moreover, the frame main body 51 of the cutter supporting frame 50D of the present embodiment is provided with stirring blades 51*b*. The stirring blades 51*b* of the cutter supporting frame 50D which rotates together with the rotary drum 40D stir the excavated sand recovered in the chamber 19.

The cutter supporting frames 50D are provided with the third center axes A3, respectively, and the No. 1 and No. 2 cutter heads 60D are provided at the third center axes A3, respectively. The No. 1 cutter head 60D located on the right side and the No. 2 cutter head 60D located on the left side have the same configuration as each other. The No. 1 cutter head 60D located on the right side excavates the natural ground in front of a right half of the front surface of the shield machine main body 2D, and the No. 2 cutter head 60D located on the left side excavates the natural ground in front of a left half of the front surface of the shield machine main body 2D. In the present embodiment, the areas where the No. 1 and No. 2 cutter heads 60D excavate are as below. Each of the cutter heads 60D has such a diameter that when the cutter head 60D moves in the vertical direction along the outer peripheral portion of the shield machine main body 2D to excavate the natural ground, it can excavate the natural ground in front of the first center axis A1 and an outer portion of the shield machine main body 2D. In addition, each of the cutter heads 60D is provided such that when the cutter head 60D moves between the first center axes A1 in the vertical direction to excavate the natural ground, it can excavate the natural ground in front of the first center axis A1 and the central axis Ac of the shield machine main body 2D. Each of the rotary cutter heads 60D is supported to be rotatable around the third center axis A3, and a plurality of cutter bits 61 are provided on a surface of the rotary cutter head 60D.

Then, each of the rotary cutter heads 60D of the present embodiment includes: the small circular front surface 62*a* at the center thereof; twelve spokes 62*e* radially extending from the front surface 62*a*; and a plurality of cutter bits 61 provided on an excavating surface PD (front surface) of each spoke 62*e*. As above, each of the No. 1 and No. 2 cutter heads 60D is configured such that the excavating surface PD is formed by causing the spokes 62*e* having the cutter bits 61 to rotate. Thus, the portions between the spokes 62*e* and outside the spokes 62*e* can be open at positions of outer end portions of the spokes 62*e*. With this, the sand excavated by the cutter bits 61 can be quickly discharged from between the spokes 62*e* to behind the No. 1 and No. 2 cutter heads 60D to be recovered in the chamber 19. Moreover, the mud adding material inlet 29 is also provided at a position which is located in a direction opposite the rotational direction of the spokes 62*e* and located in a direction intersecting with the axial direction of the excavator main body 2C. The flowability of the excavated sand is maintained by supplying the mud adding material from the mud adding material inlet 29. Therefore, the excavated sand can be quickly recovered in the chamber 19, and can be prevented from remaining on the excavating surfaces PD of the No. 1 and No. 2 cutter heads 60D. On this account, even in the case of excavating the soil, such as the clay-rich soil, stable excavating ability can be maintained. Moreover, the excavating surface PD of each of the No. 1 and No. 2 cutter heads 60D of the present embodiment is also formed as a curved surface whose outer peripheral side curves rearward to the shield machine main body 2D side. By forming such an excavating surface PD, the cutter bits 61 on the excavating surface PD can efficiently excavate the natural ground while swinging in a direction intersecting with the central axis Ac of the shield machine main body 2D. Further, since the excavating surface PD is formed as the curved surface and is provided with the cutter bits 61, the cutter bits 61 can efficiently excavate while swinging, and the excavating resistance can be reduced by the curved surface PD.

The No. 1 and No. 2 cutter heads 60D are respectively rotated by the third rotating mechanisms 65 configured to respectively cause the No. 1 and No. 2 cutter heads 60D to rotate with respect to the cutter supporting frame 50D. The third rotating mechanism 65 of the present embodiment includes a plurality of third hydraulic motors 66 corresponding to third actuators. Moreover, in the present embodiment, the No. 1 cutter head 60D located on the right side and the No. 2 cutter head 60D located on the left side are rotated in directions opposite to each other, so that an excavation reaction force applied to the No. 1 cutter head 60D and an excavation reaction force applied to the No. 2 cutter head 60D at the time of excavation cancel each other. Thus, a largely unbalanced excavation reaction force is prevented from acting on the shield machine main body 2D. As described above, since the components, such as the stirring blade 80 and the earth pressure gauge, provided at the No. 1 and No. 2 rotary drums 40D are the same as those in Embodiment 1, detailed explanations thereof are omitted.

Hereinafter, a specific flow of excavation by a shield machine 1D of Embodiment 4 configured as above will be explained. FIG. 45 is a front view showing a state where the drum rotation angle of the excavator included in the shield machine shown in FIG. 42 is ±0 degrees. FIGS. 46 to 48 sequentially show a part of a front view showing a state where the excavator is rotated by a predetermined angle from the drum rotation angle of the excavator shown in FIG. 45.

In the present embodiment, a vertical direction and a crosswise direction when viewed from the front are used for convenience of explanation. Moreover, in the state of the excavator 5D shown in FIG. 45, at the No. 1 cutter head 60D located on the right side, a perpendicular line Ld downwardly extending from the first center axis A1 of the No. 1 drum 40D is located at a position where the drum rotation angle θ (rotation phase angle θ) of the No. 1 rotary drum 40D is the reference phase angle that is ±0 degrees. When viewed from the front, a side located in a clockwise direction of the No. 1 rotary drum 40D from the reference phase angle of the drum rotation angle θ is referred to as a + side. Further, the perpendicular line Ld is located at a position where the frame swinging angle α (rotation phase angle α) of the cutter supporting frame 50D centered on the second center axis A2 with respect to the No. 1 rotary drum 40D is the reference phase angle that is ±0 degrees. When viewed from the front, a side located in a clockwise direction of the cutter supporting frame 50D from the reference phase angle of the frame swinging angle α is referred to as a + side. At the No. 2 cutter head 60D located on the left side, a perpendicular line Lu upwardly extending from the first center axis A1 of the No. 2 rotary drum 40D is located at a position where the drum rotation angle θ (rotation phase angle θ) of the No. 2 rotary drum 40D is the reference phase angle that is ±0 degrees. When viewed from the front, a side located in a clockwise direction of the No. 2 rotary drum 40D from the reference phase angle of the drum rotation angle θ is referred to as + side. Moreover, the perpendicular line Lu is located at a position where the frame swinging angle α (rotation phase angle α) of the cutter supporting frame 50D centered on the second center axis A2 with respect to the No. 2 rotary drum 40D is the reference phase angle that is ±0 degrees. When viewed from the front, a side located in a clockwise direction of the cutter supporting frame 50D from the reference phase angle of the frame swinging angle α is referred to as a + side.

Again, in the following explanation, the shape of the shield machine main body 2D, the shapes of the No. 1 and No. 2 cutter heads 60D, and the initial positions of the axes A1 to A3 are predetermined. A part of the drum rotation angles θ and the frame swinging angles α which continuously change from their initial positions will be explained as examples. These angles are just examples, and are set to appropriate angles depending on different conditions.

FIG. 45 shows the state of the reference position. In this state, the second center axis A2 on the right side is located at the lower limit position. The drum rotation angle θ of the No. 1 rotary drum 40D is ±0 degrees, and the frame swinging angle α of the cutter supporting frame 50D is −114 degrees. The No. 1 cutter head 60D of the third center axis A3 is located on a horizontally right side of the central axis Ac of the shield machine main body 2D. The second center axis A2 on the left side is located at the upper limit position. The drum rotation angle θ of the No. 2 rotary drum 40D is ±0 degrees, and the frame swinging angle α of the cutter supporting frame 50D is 114 degrees. The No. 2 cutter head 60D of the third center axis A3 is located on a horizontally right side of the central axis Ac of the shield machine main body 2.

Then, at the time of excavation, the No. 1 rotary drum 40D is rotated by the first rotating mechanism 45 in a counterclockwise direction when viewed from the front, and the No. 2 rotary drum 40D is rotated by the first rotating mechanism 45 in a clockwise direction when viewed from the front. To be specific, the No. 1 rotary drum 40D and the No. 2 rotary drum 40D are rotated in directions opposite to each other. In addition, the No. 1 cutter head 60D is rotated at all times by the third rotating mechanism 65 in a counterclockwise direction when viewed from the front, and the No. 2 cutter head 60D is rotated at all times by the third rotating mechanism 65 in a clockwise direction when viewed from the front. To be specific, the No. 1 cutter head 60D on the right side and the No. 2 cutter head 60D on the left side are rotated in directions opposite to each other. Further, the positions of excavation of the No. 1 and No. 2 cutter heads 60D are controlled to be changed by changing the frame swinging angle α of the cutter supporting frame 50D by the swinging drive mechanism 55 in a clockwise direction or in a counterclockwise direction which angle α is associated with the drum rotation angle θ of the No. 1 and No. 2 rotary drums 40D from the reference phase angle in accordance with the cross-sectional shape of a tunnel TD to be excavated. This control is continuous control, and the drum rotation angle θ and the frame swinging angle α are controlled to be changed smoothly and relatively.

As shown in FIGS. 46 to 48, to cause the No. 1 cutter head 60D to move upwardly from a right side portion of the tunnel TD shown in FIG. 45 to an upper-right corner portion, then move to the left side in the horizontal direction along the upper end, and further move toward the central axis Ac, the No. 1 rotary drum 40D is rotated such that the drum rotation angle θ changes from 0 degrees through −103 degrees and −146 degrees to −169 degrees, and during this time, the cutter supporting frame 50D swings such that the frame swinging angle α changes from −114 degrees through −49 degrees and −47 degrees to −93 degrees. Moreover, to cause the No. 2 cutter head 60D to move from the center portion of the tunnel TD shown in FIG. 45 to an upper-center portion, then move to the left side in the horizontal direction along the upper end to an upper left corner portion, and further move downwardly to a left side portion, the No. 2 rotary drum 40D is rotated such that the drum rotation angle θ changes from 0 degrees through +124 degrees and +146 degrees to +169 degrees, and during this time, the cutter supporting frame 50D swings such that the frame swinging angle α changes from +114 degrees through +20 degrees and +47 degrees to +93 degrees.

After that, as with Embodiment 1 described above, the drum rotation angles θ of the No. 1 and No. 2 rotary drums 40D and the frame swinging angles α of the cutter supporting frames 50D are controlled such that excavating outer end portions of the No. 1 and No. 2 cutter heads 60D move along the outer shape of the shield machine main body 2D. At this time, the No. 1 cutter head 60D is rotated in a counterclockwise direction, and the No. 2 cutter head 60D is rotated in a clockwise direction. With this, the natural ground in front of the entire front surface of the shield machine main body 2D is excavated.

FIG. 49 is a diagram showing an area where the No. 1 cutter head included in the shield machine shown in FIG. 43 excavates. FIG. 50 is a diagram showing an area where the No. 1 and No. 2 cutter heads included in the shield machine shown in FIG. 43 excavate.

As described above, in a case where the first hydraulic motor 46 and the second hydraulic motor 56 are controlled to cause the No. 1 and No. 2 rotary drums 40D to rotate by 360 degrees while causing the cutter supporting frames 50D to swing, the area where the No. 1 cutter head 60D excavates is, as shown by diagonal lines in FIG. 49, an area of the right half of the shield machine main body 2D and an area slightly expanding over the central axis Ac when viewed from the front. Moreover, the area where the No. 2 cutter head 60D excavates is, as shown by diagonal lines on the left side of FIG. 50, an area of the left half of the shield machine main body 2D and an area slightly expanding over the central axis Ac when viewed from the front. Therefore, in a case where the No. 1 and No. 2 cutter heads 60D are rotated by 360 degrees, the area where the No. 1 and No. 2 cutter heads 60D excavate is the area of the front surface of the shield machine main body 2D. Therefore, the natural ground in front of the entire front surface of the shield machine main body 2D can be excavated. In addition, the outbreak of the natural ground can be easily carried out by adjusting the swinging angle of the cutter supporting frame 50D to change the amount of projection of the rotary cutter head 60D.

Again, the excavation by the cutter head 60D of the excavator 5D is carried out simultaneously with the forward movement of the shield machine main body 2D by the shield jacks 3. The natural ground in front of the front surface of the shield machine main body 2D is excavated by the No. 1 and No. 2 cutter heads 60D, and at the same time, the forward movement of a predetermined distance is carried out by the shield jacks 3. The relation between the excavation by the cutter heads 60D and the forward movement by the shield jacks 3 is the same as that in Embodiment 1, so that a detailed explanation thereof is omitted.

As explained above, in accordance with the shield machine 1D, in the case of excavating the tunnel TD having a predetermined cross-sectional shape, the first rotating mechanism 45 and the swinging drive mechanism 55 are driven such that the swinging angle (frame swinging angle $\alpha$) of the cutter supporting frame 50D is controlled to be associated with the rotation phase angles (drum rotation angles $\theta$) of the No. 1 and No. 2 rotary drums 40D from the reference phase angles in accordance with the cross-sectional shape. Thus, the shield machine 1D can excavate tunnels of various cross-sectional shapes.

In addition, in the present embodiment, the sand excavated by the rotary cutter head 60D can be quickly recovered in the chamber 19 from between the spokes 62*e*. Therefore, the natural ground, such as the clay-rich soil, can be stably excavated.

In addition, the cross-sectional shape of the tunnel to be excavated can be easily changed by changing the control of the first rotating mechanism 45 and the swinging drive mechanism 55 without changing the mechanical structure. Therefore, the versatility is extremely high.

Hereinafter, outlines of embodiments other than the above embodiments will be explained using the reference numbers of Embodiment 1 described above. The following embodiments will explain only the configurations of the rotary drum 40 corresponding to the first rotating member, the cutter supporting frame 50 corresponding to the swinging member, the rotary cutter head 60, and the rotary auxiliary cutter head 70 in Embodiment 1. The configurations of the shield machine main body 2 and the excavator 5 are the same as those in the shield machine 1 of Embodiment 1, so that detailed explanations thereof are omitted.

Embodiment 5

FIG. 51 is a front view of the shield machine according to Embodiment 5 of the present invention. FIG. 52 is a front view showing a state where the excavator included in the shield machine shown in FIG. 51 is in the middle of excavation. FIG. 53 is a front view showing a state where the excavator included in the shield machine shown in FIG. 51 is in the middle of excavation, and is different from FIG. 52. As shown in FIG. 51, Embodiment 5 shows an example of excavating a tunnel TE having a horseshoe-shape excavated cross section by the same configuration as the shield machine 1 of Embodiment 1. Note that a letter "E" is added to each of the reference numbers of the corresponding components.

As shown in FIG. 51, in the case of excavating a flat bottom surface of the tunnel TE, the rotation angle of the first rotating mechanism 45 and the swinging angle of the swinging drive mechanism 55 are controlled as with the case of forming the flat bottom surface of the tunnel T having the rectangular cross section in Embodiment 1. Thus, the excavated cross section by the rotary cutter head 60 extends in the horizontal direction.

Moreover, as shown in FIGS. 52 and 53, in the case of excavating a circular-arc surface of the tunnel TE, one of a pair of rotary cutter heads 60 projects to the outside of the outer periphery of the rotary drum 40 when viewed from the front, and the cutter supporting frame 50 is fixed to the rotary drum 40. To be specific, a distance from the first center axis A1 to one of the pair of rotary cutter heads 60 is fixed, and the rotary drum 40 is rotated. With this, the excavation is carried out.

In accordance with a shield machine 1E of Embodiment 5, the tunnel TE having the horseshoe-shape cross section can be directly excavated. In the case of excavating a tunnel having a circular cross section and forming a road having a predetermined width on which vehicles run and a pathway on which people walk, the lower portion of the circular tunnel needs to be filled with sand, and the road needs to be constructed on the sand whose surface is located at a position largely upwardly spaced apart from the lower end portion of the circular tunnel. However, in accordance with the shield machine 1E of Embodiment 5, without filling the lower portion of the tunnel with the sand, the road and the pathway each having a predetermined width can be easily formed on the bottom surface of the tunnel having the horseshoe-shape cross section.

Embodiment 6

FIG. 54 is a front view of the shield machine according to Embodiment 6 of the present invention. FIG. 55 is a front view showing a state where the excavator included in the shield machine shown in FIG. 54 is in the middle of excavation. FIG. 56 is a front view showing a state where the excavator included in the shield machine shown in FIG. 54 is in the middle of excavation, and is different from FIG. 52. In Embodiment 6, the rotary auxiliary cutter head 70 of the shield machine 1 in Embodiment 1 described above is omitted. The other components herein are the same as those of the shield machine 1 of Embodiment 1. Note that a letter "F" is added to the reference numbers of the corresponding components.

As shown in FIGS. 54 to 56, a shield machine 1F includes: a cutter supporting frame 50F which is supported by the rotary drum 40 to be rotatable around the second center axis A2 and has a triangular shape when viewed from the front; three rotary cutter heads 60F supported by the cutter supporting frame 50F to be rotatable around three third center axes A3, respectively; and three third rotating mechanisms (not shown) configured to respectively cause these three rotary cutter heads 60F to rotate. In the present embodiment, the rotary auxiliary cutter head 70 in Embodiment 1 described above is omitted. The other components herein are the same as those of the shield machine 1 of Embodiment 1. The shield machine 1F of the present embodiment can excavate both a tunnel TFa having a circular cross section shown in FIG. 54 and a tunnel TFb having an oval cross section shown in FIGS. 55 and 56.

Embodiment 7

FIG. 57 is a front view of the shield machine according to Embodiment 7 of the present invention. FIG. 58 is a front view showing a state where the excavator included in the shield machine shown in FIG. 57 is in the middle of excavation. FIG. 59 is a front view showing a state where the excavator included in the shield machine shown in FIG. 57 is in the middle of excavation, and is different from FIG. 52. Again, in Embodiment 7, the rotary auxiliary cutter head 70 of the shield machine 1 in Embodiment 1 described above is omitted. The other components herein are the same as those of the shield machine 1 of Embodiment 1. Note that a letter "G" is added to each of the reference numbers of the corresponding components.

As shown in FIGS. 57 to 59, a shield machine 1G of Embodiment 7 includes a cutter supporting frame 50G supported by the rotary drum 40 to be rotatable around the second center axis A2. The cutter supporting frame 50G of the present embodiment is formed to have a rhombic shape when viewed from the front. The cutter supporting frame 50G is provided with four third center axes A3. Four rotary cutter heads 60G are supported at these third center axes A3, respectively, to be rotatable around the third center axes A3, respectively. These four rotary cutter heads 60G respectively include four third rotating mechanisms (not shown) configured to respectively causes the rotary cutter heads 60G to rotate.

The shield machine 1G of the present embodiment can excavate both a tunnel TGa having a circular cross section shown in FIG. 57 and a tunnel TGb whose one side portion is expanded as shown in FIGS. 58 and 59.

Embodiment 8

FIG. 60 is a front view of the shield machine according to Embodiment 8 of the present invention. FIG. 61 is a front view showing a state where the excavator included in the shield machine shown in FIG. 60 is in the middle of excavation. FIG. 62 is a front view showing a state where the excavator included in the shield machine shown in FIG. 60 is in the middle of excavation, and is different from FIG. 52. Again, in Embodiment 8, the rotary auxiliary cutter head 70 of the shield machine 1 in Embodiment 1 described above is omitted. The other components herein are the same as those of the shield machine 1 of Embodiment 1. Note that a letter "H" is added to each of the reference numbers of the corresponding components.

As shown in FIGS. 60 to 62, a shield machine 1H includes: a pair of cutter supporting frames 50H supported to be rotatable around a pair of second center axes A2, respectively, which are located symmetrically about the first center axis A1 of the rotary drum 40; and a pair of swinging drive mechanisms (not shown) configured to respectively cause the pair of cutter supporting frames 50H to rotate. Then, a pair of rotary cutter heads 60H supported to be rotatable around a pair of third center axes A3, respectively, are provided at each of the cutter supporting frames 50H (in total, four rotary cutter heads 60H are provided), and four third rotating mechanisms (not shown) configured to respectively cause these four rotary cutter heads 60H to rotate are included in the shield machine 1H.

The shield machine 1H of the present embodiment can excavate both a tunnel THa having a circular cross section shown in FIG. 60 and a tunnel THb having an oval cross section shown in FIGS. 61 and 62.

The above embodiments can be combined with one another. The above embodiments may be suitably combined depending on the type of the natural ground, the cross-sectional shape of the tunnel, and the like. Therefore, it is possible to easily deal with cases of excavating any type of natural grounds. In addition, by setting the trajectory of the rotary cutter head such that the natural ground can be efficiently excavated, the excavating ability can be significantly improved.

Moreover, the excavated cross sections in the above embodiments are just examples. In the case of excavating the natural ground of the excavated cross section which is not within the area where the shield machine can excavate in each embodiment, the first rotating member, the swinging member, the rotary cutter head, and the center axis positions of these components are set in accordance with the excavated cross section of the natural ground to be excavated. With this, the shield machine can easily deal with this excavated cross section, and the present invention is not limited to the above embodiments.

Further, the above embodiments are just examples, and various modifications can be made within the spirit of the present invention. The present invention is applicable to various shield machines 1. For example, in a case where the present invention is applied to a shield machine which excavates the natural ground containing very hard rocks and the like, a plurality of roller cutters may be attached instead of a plurality of cutter bits provided at the rotary cutter head 60 and the rotary auxiliary cutter head 70. With this, the shield machine can excavate the natural ground containing vary hard rocks and the like. Moreover, the excavator of the present invention is applicable to a tunnel machine which does not attach the segments S, and the present invention is not limited to the above embodiments.

INDUSTRIAL APPLICABILITY

A shield machine according to the present invention can be utilized as a shield machine which excavates not only a circular cross section but also various cross sections.

The invention claimed is:

1. A shield machine comprising: a shield machine main body including a body; a plurality of shield jacks configured to cause the shield machine main body to move ahead; and an excavator configured on a front end side of the shield machine main body to excavate natural ground, the shield machine further comprising:

a first rotating member supported at a front end side portion of the shield machine main body to be rotatable around a first center axis parallel to a central axis of the shield machine main body;

a first rotating device configured to cause the first rotating member to rotate;

a swinging member supported by the first rotating member so as to be swingable around a second center axis parallel to the first center axis and spaced apart from the first center axis;

a swinging device configured to cause the swinging member to swing with respect to the first rotating member independently from the first rotating device;

a rotary cutter head supported by the swinging member so as to be rotatable around a third center axis parallel to the second center axis and spaced apart from the second center axis, and including a plurality of cutters on an excavating surface thereof;

a third rotating device including an actuator configured to cause the rotary cutter head to rotate with respect to the swinging member independently from the first rotating device and the swinging device, the actuator being a hydraulic motor or electric motor provided in the swinging member; and a controller configured to control the first rotating device, the swinging device, and the third rotating device, wherein the rotary cutter head is configured to be able to excavate the natural ground located in front of a vicinity of the central axis of the shield machine main body while swinging in a direction intersecting with the central axis of the shield machine main body.

2. The shield machine according to claim 1, wherein:

the shield machine main body includes a chamber configured to recover excavated sand, and a dividing wall defining a rear end of the chamber; and the first rotating member is constituted by a rotary drum which forms a part of a wall surface of the dividing wall.

3. The shield machine according to claim 1, wherein the actuator is one of a plurality of actuators, and wherein the first rotating device, the swinging device, and the third rotating device are respectively constituted by a respective one of the plurality of actuators.

4. The shield machine according to claim 1, wherein:

the swinging member is constituted by a cutter supporting frame rotatably supported by an outer peripheral portion of the first rotating member; and the rotary cutter head as supported by the cutter supporting frame is configured to be able to move to an area outside an outer periphery of the first rotating member when viewed from front.

5. The shield machine according to claim 1, wherein the controller is configured to control the first rotating device and the swinging device such that a rotation angle of the swinging member is controlled to be associated with a rotation phase angle of the first rotating member from a reference phase angle in accordance with a cross-sectional shape of a tunnel to be excavated.

6. The shield machine according to claim 5, wherein a center of the rotary cutter head continuously moves at a uniform speed.

7. The shield machine according to claim 1, wherein:

a front surface of the rotary cutter head is formed to curve from a center portion of the front surface to an outer peripheral side toward the shield machine main body; and the excavating surface is formed by providing the plurality of cutters on the front surface.

8. The shield machine according to claim 7, wherein the plurality of cutters are spirally provided from a center portion of the front surface to an outer periphery of the front surface in a direction opposite a rotational direction of the rotary cutter head.

9. The shield machine according to claim 1, wherein:

the rotary cutter head is provided with a central supporting portion having a surface plate, and a plurality of spokes radially extending from the central supporting portion; and the plurality of cutters are provided on front surfaces of the spokes.

10. The shield machine according to claim 9, wherein a mud adding material inlet is provided at a position which is located in a direction intersecting with an axial direction of the shield machine main body of the spokes and located in a direction opposite a rotational direction of the spokes.

11. The shield machine according to claim 9, wherein:

a plurality of the first rotating members are provided at the front end side portion of the shield machine main body;

the first rotating members, respectively being provided with the rotary cutter heads, configure a plurality of the excavators; and the first rotating members are rotated in directions opposite to each other.

12. The shield machine according to claim 11, wherein the rotary cutter head provided on each of the first rotating members respectively rotating in the directions opposite to each other is rotated in a direction which is the same as the rotational direction of the first rotating member provided with that rotary cutter head.

13. The shield machine according to claim 4, wherein the cutter supporting frame is provided with a plurality of third center axes, the shield machine further comprising:

a plurality of the rotary cutter heads supported to be rotatable around the plurality of third center axes, respectively; and a plurality of the third rotating devices configured to respectively cause the plurality of rotary cutter heads to rotate.

14. The shield machine according to claim 4, wherein the first rotating member is provided with a plurality of second center axes, the shield machine comprising:

a plurality of the cutter supporting frames supported to be swingable around the plurality of second center axes, respectively; and a plurality of the swinging devices configured to respectively cause the plurality of cutter supporting frames to rotate.

15. The shield machine according to claim 1, wherein:

the first rotating member includes a rotary auxiliary cutter head configured to rotate around a fourth center axis parallel to the first center axis and spaced apart from the first center axis and the second center axis; and the rotary auxiliary cutter head includes a plurality of cutters provided on an excavating surface thereof, and a fourth rotating device configured to cause the rotary auxiliary cutter head to rotate.

16. The shield machine according to claim 2, wherein the chamber includes therein:

a stiffing blade rotatably supported by the first rotating member; and a stiffing blade rotating device configured to cause the stirring blade to rotate.

* * * * *

UNITED STATES PATENT AND TRADEMARK OFFICE

CERTIFICATE OF CORRECTION

PATENT NO. : 8,328,293 B2
APPLICATION NO. : 12/524550
DATED : December 11, 2012
INVENTOR(S) : Yasunori Kondo et al.

It is certified that error appears in the above-identified patent and that said Letters Patent is hereby corrected as shown below:

In the Claims:

In Column 38, Claim 16, at lines 48 and 50, delete "stiffing" and replace with --stirring--.

Signed and Sealed this
Thirtieth Day of April, 2013

Teresa Stanek Rea
*Acting Director of the United States Patent and Trademark Office*